US006561150B1

(12) United States Patent
Kikuoka et al.

(10) Patent No.: US 6,561,150 B1
(45) Date of Patent: May 13, 2003

(54) ENGINE VALVE CHARACTERISTIC CONTROLLER

(75) Inventors: Shinichiro Kikuoka, Aichi-ken (JP); Yoshihiko Masuda, Okazaki (JP); Yoshihito Moriya, Nagoya (JP); Hideo Nagaosa, Aichi-ken (JP); Shuuji Nakano, Nagoya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/048,791

(22) PCT Filed: Aug. 21, 2000

(86) PCT No.: PCT/JP00/05581

§ 371 (c)(1),
(2), (4) Date: Feb. 5, 2002

(87) PCT Pub. No.: WO01/14694

PCT Pub. Date: Mar. 1, 2001

(30) Foreign Application Priority Data

Aug. 23, 1999 (JP) ..... 11/236011
Sep. 16, 1999 (JP) ..... 11/262601

(51) Int. Cl.[7] ..... F01L 1/34
(52) U.S. Cl. ..... 123/90.18; 123/90.17; 123/90.16
(58) Field of Search ..... 123/90.18, 90.17, 123/90.16, 90.6, 90.1

(56) References Cited

U.S. PATENT DOCUMENTS

| | | | | |
|---|---|---|---|---|
| 1,688,164 A | | 10/1928 | Tarrant | |
| 4,753,198 A | | 6/1988 | Heath | |
| 5,080,055 A | | 1/1992 | Komatsu et al. | |
| 5,086,738 A | | 2/1992 | Kubis et al. | |
| 5,893,345 A | * | 4/1999 | Sugimoto et al. | 123/90.17 |
| 6,062,183 A | * | 5/2000 | Sato et al. | 123/90.17 |
| 6,131,541 A | * | 10/2000 | Hasegawa et al. | 123/90.18 |
| 6,170,448 B1 | * | 1/2001 | Asakura | 123/90.18 |

FOREIGN PATENT DOCUMENTS

| | | |
|---|---|---|
| DE | 199 03 594 A1 | 8/1999 |
| EP | 0 867 601 A1 | 9/1998 |
| EP | 1 035 303 A2 | 9/2000 |
| FR | 2 289 734 A1 | 5/1976 |
| GB | 1 296 157 | 11/1972 |
| JP | A 55-81253 | 6/1980 |
| JP | U 61-19606 | 2/1986 |
| JP | A 61-182430 | 8/1986 |
| JP | A 61-234209 | 10/1986 |
| JP | A 5-71322 | 3/1993 |
| JP | A 7-26921 | 1/1995 |
| JP | A 9-280022 | 10/1997 |
| JP | A 10-89033 | 4/1998 |
| JP | A 10-205362 | 8/1998 |

OTHER PUBLICATIONS

U.S. patent application Ser. No. 09/506,958, Moriya et al., filed Feb. 18, 2000.

* cited by examiner

*Primary Examiner*—Thomas Denion
*Assistant Examiner*—Kyle Riddle
(74) *Attorney, Agent, or Firm*—Oliff & Berridge, PLC

(57) ABSTRACT

The cam face of an intake cam has a main lift portion, which causes an intake valve to execute a basic lift operation, and a sub lift portion, which assists the action of the main lift portion. The main lift portion and the sub lift portion continuously change in an axial direction of the intake cam. An axial movement mechanism moves the intake cam in the axial direction to adjust the axial position of the cam face that drives the intake valve. The axial movement of the intake cam results in the valve being given a variety of valve lift characteristics in the form of a combination of a cam lift pattern realized by the main lift portion and a cam lift pattern realized by the sub lift portion. Therefore, various engine performances required according to the running conditions of the engine can be fully satisfied by the valve characteristics.

20 Claims, 53 Drawing Sheets

24
60
59
65
53
24a
52
80
58
65a
84
51b
51a
14b
61
56a
51
27
61b
56
22
61c
54b
54a
88
86
56b
S
60a
55
57
F
R
54
91
90
54b
87
89
87
51c
56b
22b
56
51a
61
56a
85
58
81
51b
14a
63
63b
53
ECU
130
92
93
94
116
106
107
104
102
114
118
108
107
112
107
110
107
96
95
Pm
13a

Fig.28

| Control Value / Operational State | (A) Target Axial Position Lt [mm] (Delayed Angle Value [° CA]) | (B) Target Advancing Angle Value θt [°CA] | (C) Advancing Angle Value [°CA] | (D) Opening Timing BTDC [°CA] | (E) Closing Timing ABDC [°CA] | (F) Angle Of Action [°CA] |
|---|---|---|---|---|---|---|
| P1 | 0 (0) | 0 | 0 | -10 | 54 | 224 |
| P2 | 0 (0) | 34 | 34 | 24 | 20 | 224 |
| P3 | 9 (21) | 57 | 36 | 180 | 82 | 442 |
| P4 | 5.2 (12) | 0 | -12 | 48 | 110 | 338 |
| P5 | 2 (5) | 14 | 9 | 18 | 71 | 269 |

| | (A) | (B) | (C) | (D) |
|---|---|---|---|---|
| Control Value / Operational State | Target Axial Position Lt [mm] (Advancing Angle Value [° CA]) | Opening Timing BTDC [° CA] | Closing Timing ABDC [° CA] | Angle Of Action [° CA] |
| P11 | 0 (0) | 4 | 40 | 224 |
| P12 | 9 (22) | 180 | 82 | 442 |
| P13 | 2 (5) | 28 | 61 | 269 |

Fig.48

| Control Value / Operational State | (A) Target Axial Position Lt [mm] | (B) Target Advancing Angle Value βt [°CA] | (C) Target Degree Of Opening θv |
|---|---|---|---|
| P21 | 0 | 0 | Closed |
| P22 | 3~6 | 0~20 | Opened |
| P23 | 7~9 | 20~40 | Opened |
| P24 | 3~6 | 30 | Half Opened - Closed |
| P25 | 0 | 10~25 | Half Opened |
| P26 | 0 | 10~40 | Opened |

Valve Opening Side ← | → Valve Closing Side R ← → F

ENGINE VALVE CHARACTERISTIC CONTROLLER

BACKGROUND OF THE INVENTION

The present invention relates to a valve characteristic controller for use for an engine, and, more particularly, to a valve characteristic controller which can be suitably used for a direct injection type engine which directly injects fuel into combustion chambers.

Conventionally, a cam which has a sub lift portion on its cam face in addition to a main lift portion is known as an intake valve or exhaust valve to be used in a valve drive mechanism of an engine. The height of the sub lift portion changes in the axial direction of the cam. By moving a camshaft in accordance with the operational state of the engine, the position of the cam face that drives the valve changes in the axial direction. As a result, a valve lift pattern is changed to adjust, for example, the amount of an exhaust gas or the like to be taken into a combustion chamber of the engine. The exhaust gas to be taken into a combustion chamber significantly affects the combustion state or the like of the engine.

However, merely changing the height of the sub lift portion in the axial direction of the cam cannot realize a valve characteristic that sufficiently satisfies various engine performances demanded according to the operational states of the engine. Particularly, a direct injection type engine which directly injects fuel into combustion chambers needs complicated engine control as compared with an ordinary engine which feeds fuel and air, previously mixed, into combustion chambers, and a variety of engine performances are demanded. Therefore, it was not conventionally possible to realize a valve characteristic that could sufficiently satisfy the performances demanded of the direct injection type engine.

BRIEF SUMMARY OF THE INVENTION

It is therefore an object of the present invention to provide a valve characteristic controller capable of realizing a valve characteristic that sufficiently satisfies various engine performances demanded.

To achieve the object, the present invention provides a valve characteristic controller for an engine that generates power by combusting a mixture of air and fuel in a combustion chamber. The engine has a valve for selectively opening and closing the combustion chamber. The valve characteristic controller has a cam for driving the valve, and the cam have a cam face about an axis thereof. The cam face has a main lift portion, which causes the valve to execute a basic lift operation, and a sub lift portion, which assists the action of the main lift portion. The main lift portion and the sub lift portion continuously change in an axial direction of the cam. The cam face realizes different valve motion characteristics in accordance with the axial position of the cam face. An axial movement mechanism moves the cam in the axial direction in order to adjust the axial position of the cam face that drives the valve.

As the cam is moved in the axial direction, the valve is provided with various valve lift characteristics which are a combination of a cam lift pattern realized by the main lift portion and a cam lift pattern realized by the sub lift portion. The main lift portion and sub lift portion which change in the axial direction cooperate with each other to ensure diverse adjustments of the valve characteristic. It is therefore possible to allow the valve characteristic to sufficiently match with various engine performances demanded in accordance with the operational states of the engine.

BRIEF DESCRIPTION OF THE DRAWINGS

FIG. 28 is a table showing various control values which are respectively set in association with the engine operational states P1–P5.

FIG. 48 is a table showing various control values which are respectively set in association with the engine operational states P21–P26.

FIG. 55(B) is a side view of the exhaust cam in FIG. 55(A).

DETAILED DESCRIPTION OF THE PREFERRED EMBODIMENTS

First Embodiment

Figure 1:
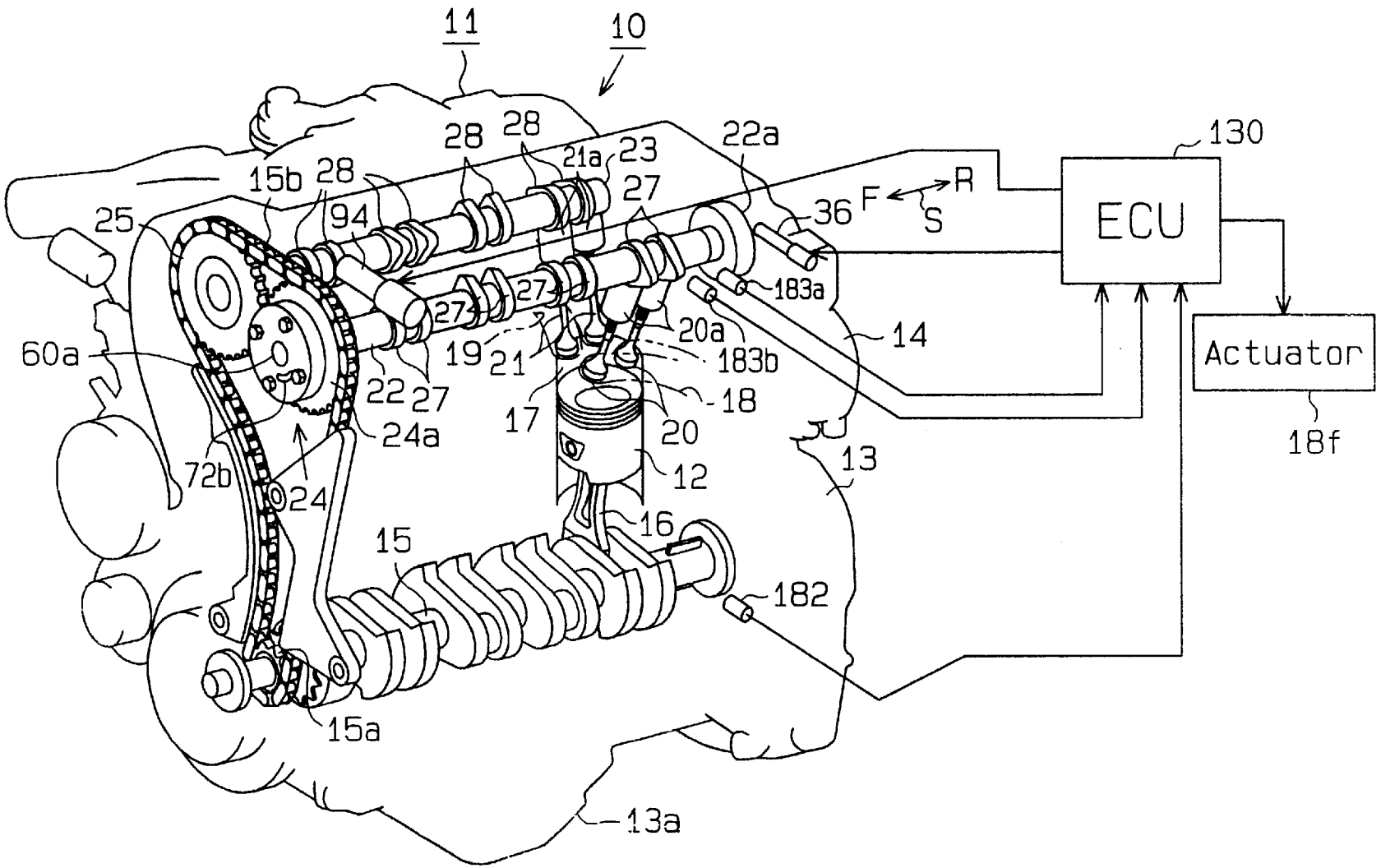
FIG. 1 is a schematic structural diagram illustrating an engine according to a first embodiment of the present invention.

A first embodiment of the present invention as adapted to an inline four-cylinder gasoline engine 11 for an automobile will now be described with reference to FIGS. 1 to 29. As shown in FIG. 1, the engine 11 has a cylinder block 13, an oil pan 13*a* attached to the lower portion of the cylinder block 13, and a cylinder head 14 attached to the upper portion of the cylinder block 13. Four pistons 12 (only one shown) are retained in the cylinder block 13 in a reciprocal manner.

Figure 2:
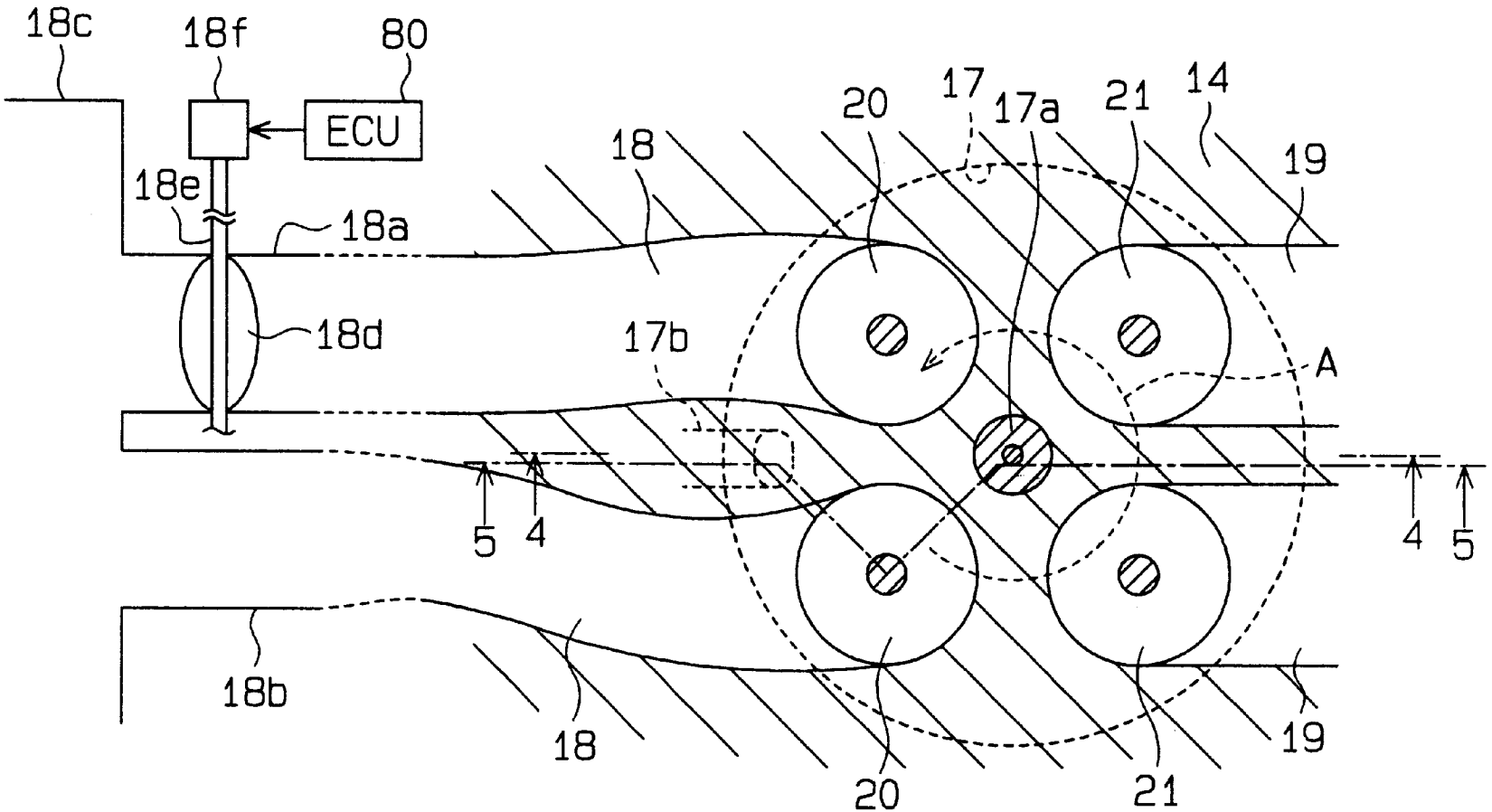
FIG. 2 is a horizontal cross-sectional view showing one of cylinders of the engine in FIG. 1.

A crankshaft 15 which is a power shaft is rotatably supported at the lower portion of the engine 11. The pistons 12 are coupled to the crankshaft 15 via connecting rods 16, respectively. The reciprocal movements of the pistons 12 are converted to the rotation of the crankshaft 15 by the connecting rods 16. A combustion chamber 17 is provided above each piston 12. As shown in FIGS. 1 and 2, a pair of intake ports 18 and a pair of exhaust ports 19 are connected to each combustion chamber 17. Intake valves 20 selectively connect and disconnect the intake ports 18 with respect to the combustion chamber 17. Exhaust valves 21 selectively connect and disconnect the exhaust ports 19 with respect to the combustion chamber 17.

As shown in FIG. 1, an intake camshaft 22 and an exhaust camshaft 23 are supported on the cylinder head 14 in parallel to each other. The intake camshaft 22 is supported on the cylinder head 14 in such a way as to be rotatable and movable in an axial direction, and the exhaust camshaft 23 is supported on the cylinder head 14 in such a way as to be rotatable but not movable in the axial direction.

The engine 11 has a valve characteristic controller 10. The valve characteristic controller 10 includes a rotational phase changing actuator 24 for changing the rotational phase of the intake camshaft 22 with respect to the crankshaft 15, and an axial movement actuator 22*a* for moving the intake camshaft 22 in the axial direction. The rotational phase changing actuator 24 is a mechanism for changing the valve timings of the intake valves 20. The axial movement actuator 22*a* is a mechanism for changing the lift amounts of the intake valves 20. The rotational phase changing actuator 24 is provided at one end of the intake camshaft 22 and the axial movement actuator 22*a* is provided at the other end of the intake camshaft 22.

The rotational phase changing actuator 24 has a timing sprocket 24*a*. A timing sprocket 25 is attached to one end of the exhaust camshaft 23. Those timing sprockets 24*a* and 25 are coupled to a timing sprocket 15*a* attached to the crankshaft 15 via a timing chain 15*b*. The rotation of the crankshaft 15 which is a drive rotational shaft is transmitted via the timing chain 15*b* to both camshafts 22 and 23 which are driven rotational shafts. In the example in FIG. 1, those shafts 15, 22 and 23 rotate clockwise as seen from the timing sprockets 15*a*, 24*a* and 25.

The intake camshaft 22 is provided with intake cams 27 which abut on valve lifters 20*a* attached to the upper ends of the intake valves 20. The exhaust camshaft 23 is provided with exhaust cams 28 which abut on valve lifters 21*a* attached to the upper ends of the exhaust valves 21. As the intake camshaft 22 rotates, the intake valves 20 are opened and closed by the intake cams 27. As the exhaust camshaft 23 rotates, the exhaust valves 21 are opened and closed by the exhaust cams 28. In addition to the exhaust cams 28, a pump cam (not shown) is attached to the exhaust camshaft 23. The pump cam drives a high-pressure fuel pump (not shown) as the exhaust camshaft 23 rotates. The high-pressure fuel pump feeds high-pressure fuel to fuel injection valves 17*b* to be discussed later.

FIG. 2 is a partially horizontal cross-sectional view of the cylinder head 14. As shown in FIG. 2, two intake ports 18 corresponding to each combustion chamber 17 are straight intake ports extending approximately straight. Ignition plugs 17*a* are attached to the cylinder head 14 in such a way as to be associated with the combustion chambers 17. The fuel injection valves 17*b* are attached to the cylinder head 14 in such a way as to be associated with the combustion chambers 17. The fuel injection valves 17*b* directly inject fuels into the associated combustion chambers 17.

Figure 17:
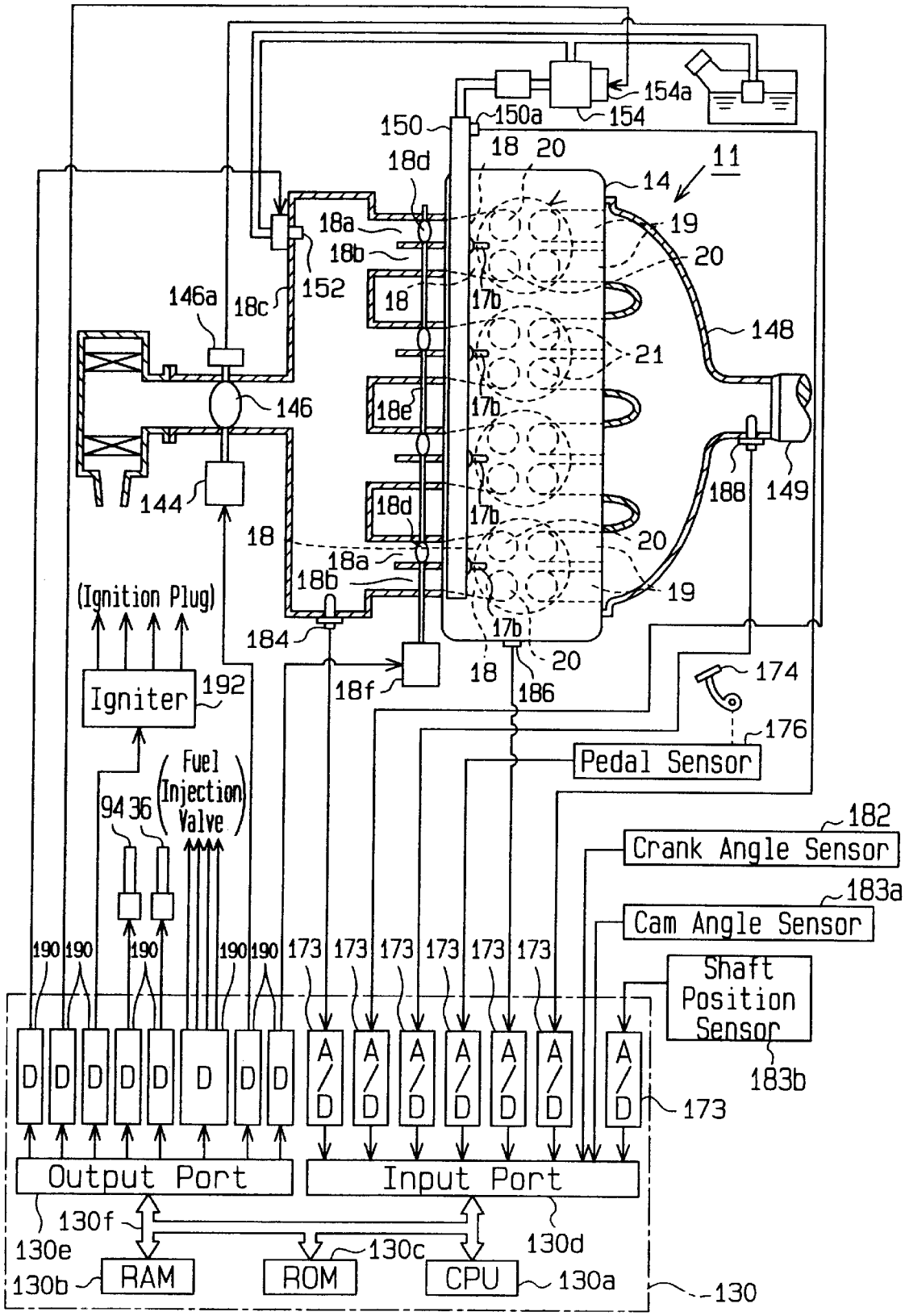
FIG. 17 is a schematic structural diagram illustrating a control system of the engine in FIG. 1.

As shown in FIG. 2, two intake ports 18 corresponding to each combustion chamber 17 are connected to a surge tank 18*c* via intake passages 18*a* and 18*b*, respectively. An air-flow control valve 18*d* is disposed in one intake passage 18*a*. As shown in FIG. 17, air-flow control valves 18*d* respectively corresponding to four intake passages 18*a* are provided on a common shaft 18*e*. An actuator 18*f* which is comprised of a motor or the like drives the air-flow control valves 18*d* via the shaft 18*e*. When the air-flow control valve 18*d* closes the intake passage 18*a*, air is fed into the combustion chamber 17 only from the remaining intake passage 18*b*, thus producing a strong swirl current A (see FIG. 2) in the combustion chamber 17.

Although both intake ports 18 shown in FIG. 2 are straight intake ports, the intake port 18 that does not correspond to the air-flow control valve 18*d* may be a helical intake port.

Figure 3:
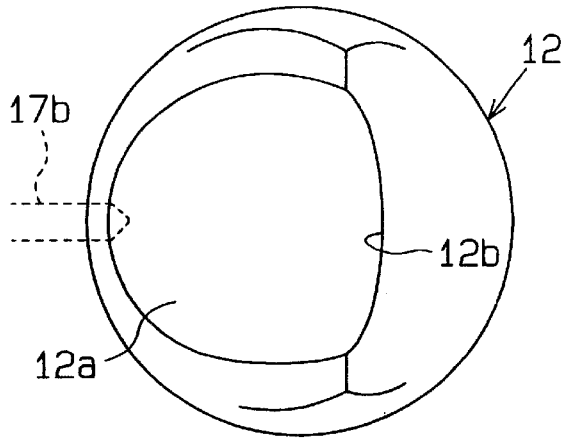
FIG. 3 is a plan view of a piston in the engine in FIG. 1.
Figure 4:
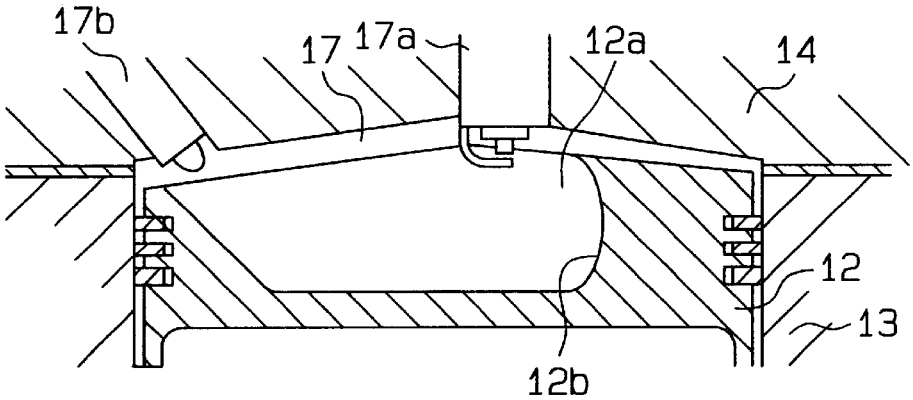
FIG. 4 is a cross-sectional view taken along the line 4—4 in FIG. 2.
Figure 5:
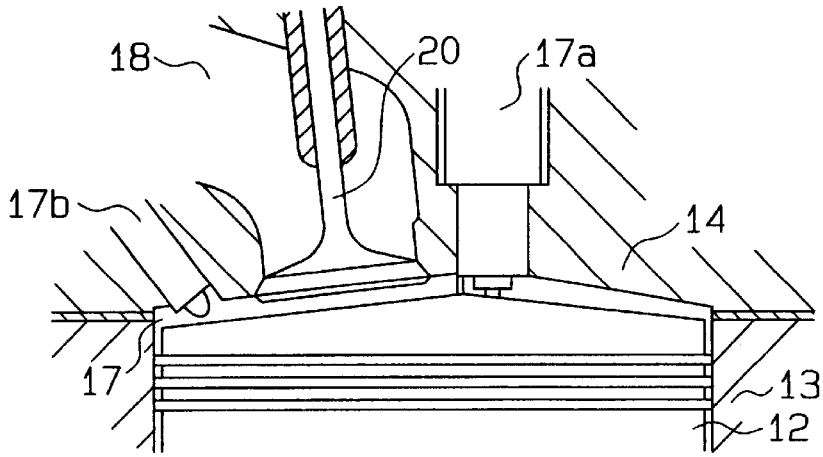
FIG. 5 is a cross-sectional view taken along the line 5—5 in FIG. 2.

As shown in FIGS. 3 to 5, the top of the piston 12 which has an approximately angle shape has a recess 12*a* at a position correspondingly directly under the fuel injection valve 17*b* and ignition plug 17*a*.

Figure 13:
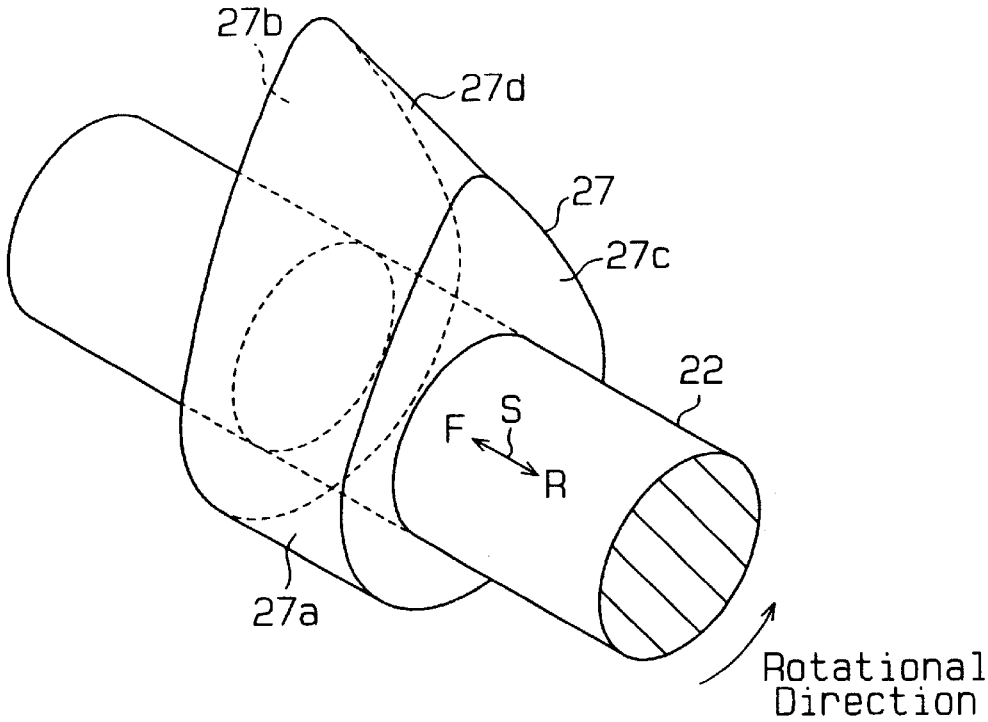
FIG. 13 is a perspective view showing an intake cam provided in the engine in FIG. 1.

The cam faces of the exhaust cams 28 are parallel to the axis of the exhaust camshaft 23. By contrast, as shown in FIG. 13, the cam faces of the intake cams 27 are tilted to the axis of the intake camshaft 22. That is, the intake cams 27 are constructed as three-dimensional cams.

Figure 6:
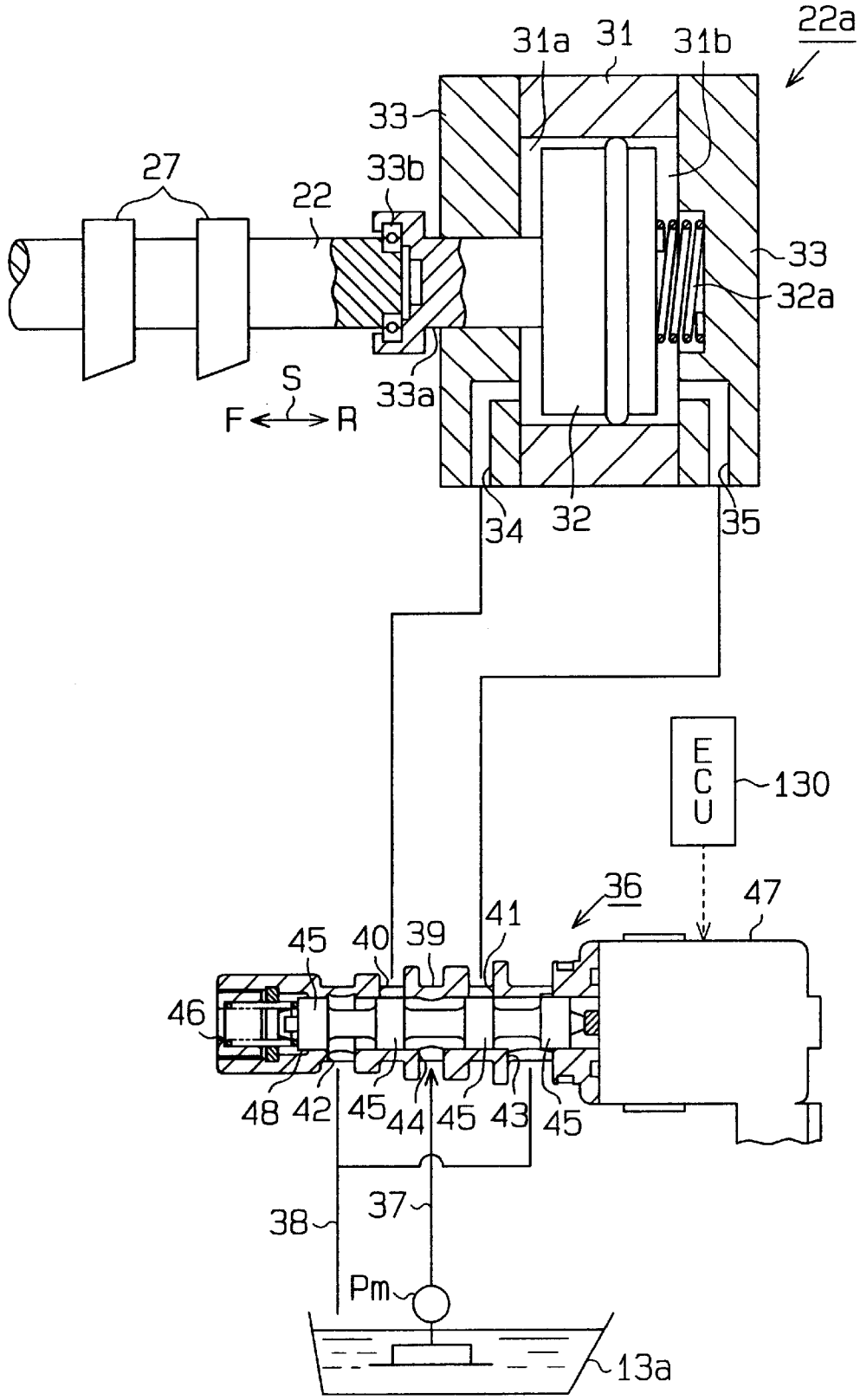
FIG. 6 is a structural diagram of an axial movement actuator in the engine in FIG. 1.

Next, the axial movement actuator 22*a* and a hydraulic drive mechanism for the axial movement actuator 22*a* will be described based on FIG. 6. As shown in FIG. 6, the axial movement actuator 22*a* has a cylinder tube 31, a piston 32 provided in the cylinder tube 31, a pair of end covers 33 which close both end openings of the cylinder tube 31, and a coil spring 32*a* disposed between the piston 32 and the outer end cover 33. The cylinder tube 31 is fixed to the cylinder head 14.

The piston 32 is coupled to one end of the intake camshaft 22 via an auxiliary shaft 33*a* which runs through the inner end cover 33. A rolling bearing 33*b* is provided between the auxiliary shaft 33*a* and the intake camshaft 22 to permit the relative rotation of both shafts 33*a* and 22.

The piston 32 defines the interior of the cylinder tube 31 into a first pressure chamber 31*a* and a second pressure chamber 31*b*. A first oil passage 34 formed in the outer end cover 33 is connected to the first pressure chamber 31*a*. A second oil passage 35 formed in the inner end cover 33 is connected to the second pressure chamber 31*b*. When an oil is selectively supplied to the first pressure chamber 31*a* and the second pressure chamber 31*b* via the first oil passage 34 or the second oil passage 35, the piston 32 moves the intake camshaft 22 in the axial direction. An arrow S shown in FIG. 6 represents moving directions F, R of the intake camshaft 22. F is the forward direction and R is the rearward direction.

The first oil passage 34 and the second oil passage 35 are connected to a first oil control valve 36. A feed passage 37 and an exhaust passage 38 are connected to the first oil control valve 36. The feed passage 37 is connected to the oil pan 13*a* via an oil pump Pm which is driven as the crankshaft 15 rotates. The exhaust passage 38 serves to return the oil to the oil pan 13*a*.

The first oil control valve 36 has a casing 39. The casing 39 has a first feed and exhaust port 40, a second feed and exhaust port 41, a first exhaust port 42, a second exhaust port 43 and a feed port 44. The first oil passage 34 is connected to the first feed and exhaust port 40, and the second oil passage 35 is connected to the second feed and exhaust port 41. The feed passage 37 is connected to the feed port 44, and the exhaust passage 38 is connected to the first exhaust port 42 and the second exhaust port 43. A spool 48 is provided in the casing 39. The spool 48 has four valve portions 45 which are urged in the opposite directions by a coil spring 46 and an electromagnetic solenoid 47.

When the electromagnetic solenoid 47 is de-excited, the spool 48 is placed to the right of the position shown in FIG. 6 by the force of the coil spring 46. In this state, the first feed and exhaust port 40 communicates with the first exhaust port 42 and the second feed and exhaust port 41 communicates with the feed port 44. Therefore, a hydraulic fluid in the oil pan 13*a* is supplied to the second pressure chamber 31*b* through the feed passage 37, the first oil control valve 36 and the second oil passage 35. Further, a hydraulic fluid in the first pressure chamber 31*a* is returned to the oil pan 13*a* through the first oil passage 34, the first oil control valve 36 and the exhaust passage 38. As a result, the piston 32 moves the intake camshaft 22 in the forward direction F.

When the electromagnetic solenoid 47 is excited, the spool 48 is placed to the left of the position shown in FIG. 6 against the force of the coil spring 46. In this state, the second feed and exhaust port 41 communicates with the second exhaust port 43 and the first feed and exhaust port 40 communicates with the feed port 44. Therefore, the hydraulic fluid in the oil pan 13*a* is supplied to the first pressure chamber 31*a* through the feed passage 37, the first oil control valve 36 and the first oil passage 34. Further, the hydraulic fluid in the second pressure chamber 31*b* is returned to the oil pan 13*a* through the second oil passage 35, the first oil control valve 36 and the exhaust passage 38. As a result, the piston 32 moves the intake camshaft 22 in the rearward direction R.

When the spool 48 is placed at an intermediate position shown in FIG. 6 by subjecting a current to be supplied to the electromagnetic solenoid 47 to duty ratio control, the first feed and exhaust port 40 and the second feed and exhaust port 41 are closed. In this state, the supply and discharge of the hydraulic fluid are not carried out with respect to the first pressure chamber 31*a* and the second pressure chamber 31*b*, so that the hydraulic fluid is kept filled in the first pressure chamber 31*a* and the second pressure chamber 31*b*. As shown in FIG. 6, therefore, the axial positions of the piston 32 and the intake camshaft 22 are fixed.

The duty ratio control of the current to be supplied to the electromagnetic solenoid 47 can adjust the degree of opening of the first feed and exhaust port 40 or the second feed and exhaust port 41 to thereby control the speed of supplying the hydraulic fluid to the first pressure chamber 31*a* or the second pressure chamber 31*b*.

Figure 7:
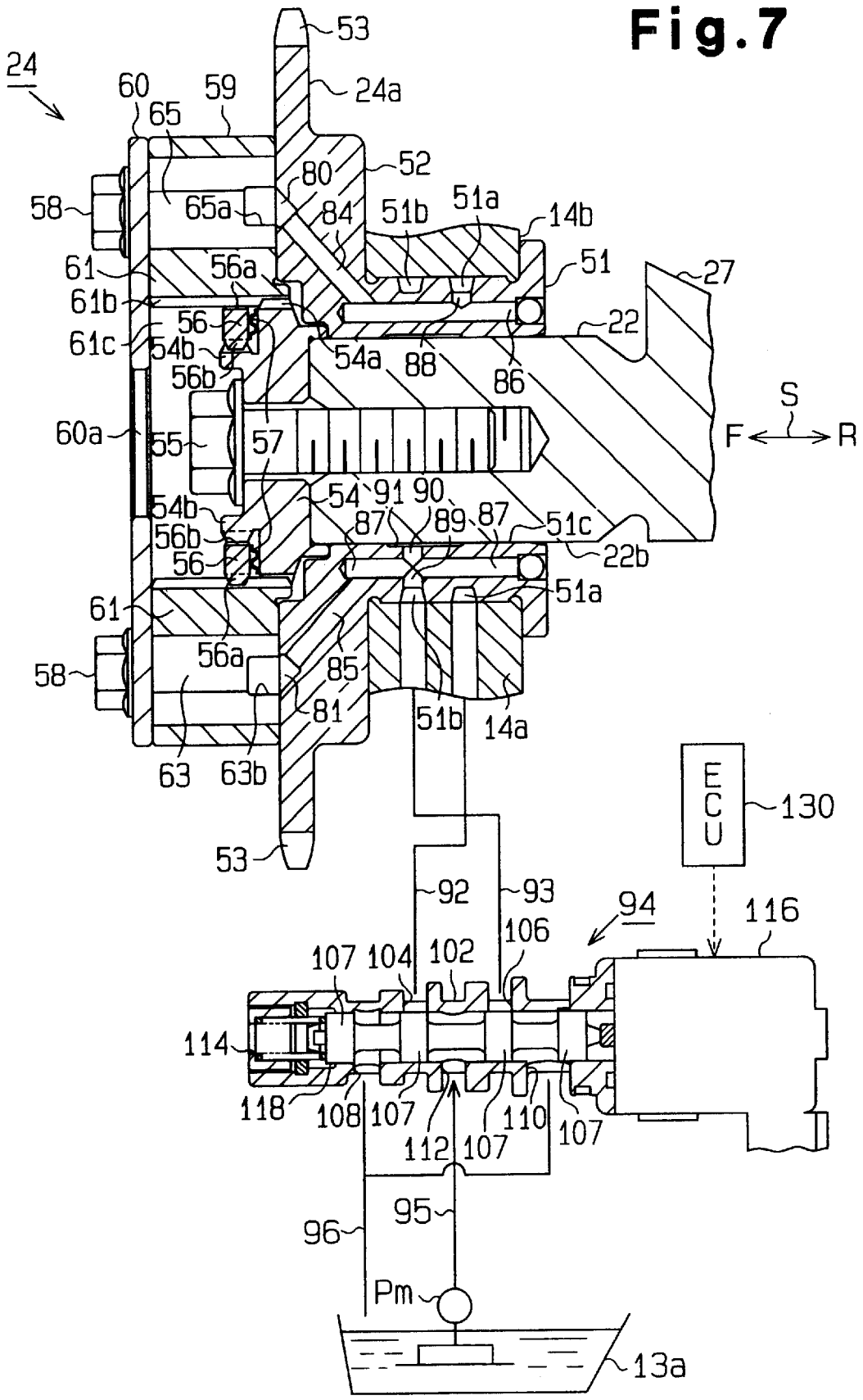
FIG. 7 is a cross-sectional view taken along the line 7—7 in FIG. 9 showing a rotational phase changing actuator in the engine in FIG. 1.

Next, the rotational phase changing actuator 24 will be discussed based on FIG. 7. As shown in FIG. 7, the timing sprocket 24*a* has a cylinder portion 51 through which the intake camshaft 22 runs and a disk portion 52 provided on the outer surface of the cylinder portion 51. A plurality of outer teeth 53 are formed on the outer surface of the disk portion 52. The cylinder portion 51 is rotatably retained by a journal bearing 14*a* and a bearing cap 14*b* which are provided at the cylinder head 14. The intake camshaft 22 is held in the cylinder portion 51 in such a way as to be movable in the axial direction and relatively rotatable with respect to the cylinder portion 51.

Figure 8:
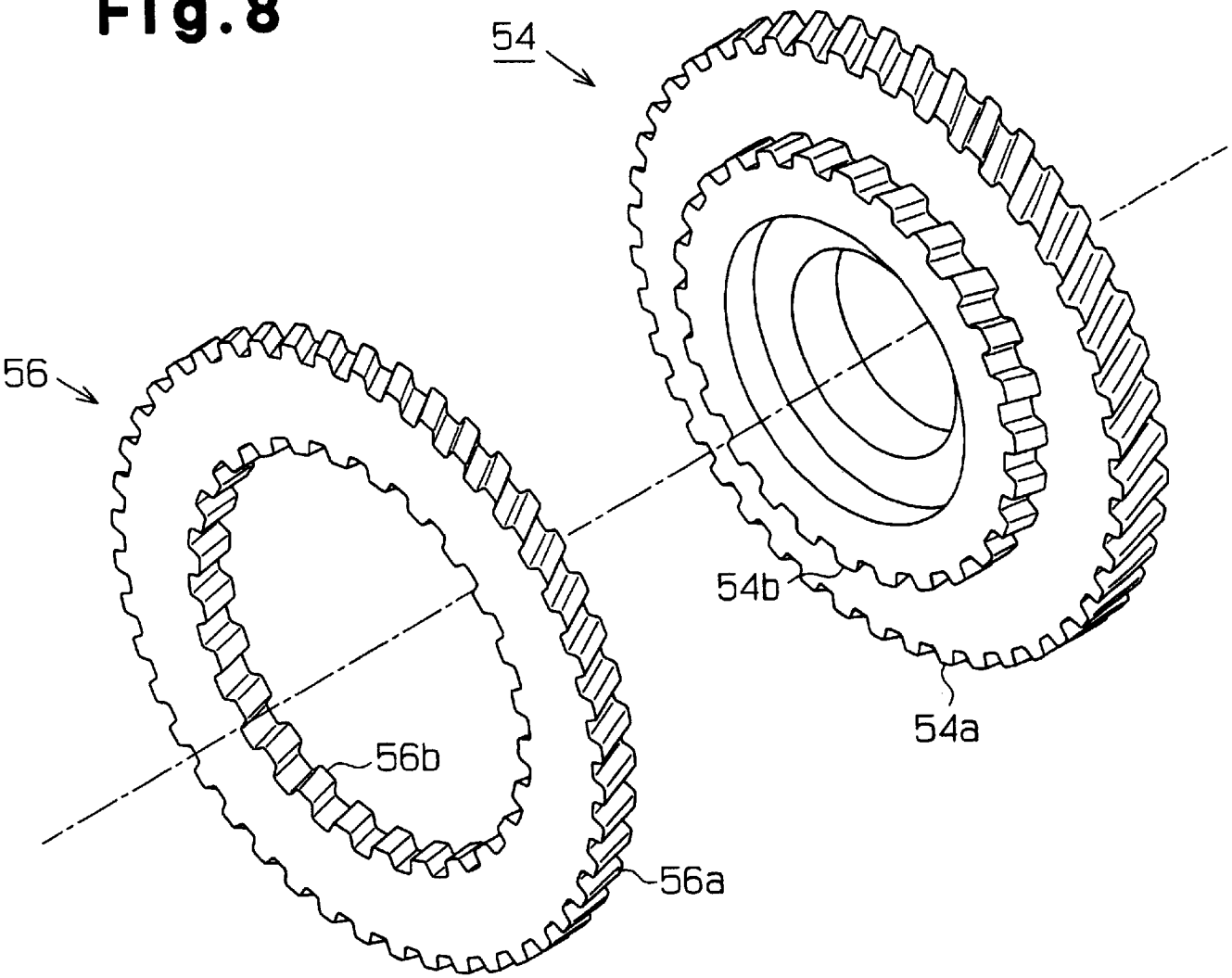
FIG. 8 is a perspective view showing an inner gear and a sub gear in the rotational phase changing actuator in FIG. 7.

An inner gear 54 is fixed to the distal end of the intake camshaft 22 by a bolt 55. As shown in FIG. 8, the inner gear 54 has a large-diameter gear portion 54*a* having oblique teeth in a left-hand screw direction and a small-diameter gear portion 54*b* having oblique teeth in a right-hand screw direction.

A sub gear 56 is engaged with the small-diameter gear portion 54*b* as shown in FIG. 7. As shown in FIG. 8, the sub gear 56 has outer teeth 56*a* or oblique teeth in a left-hand screw direction and inner teeth 56*b* or oblique teeth in a right-hand screw direction, and the inner teeth 56*b* are engaged with the oblique teeth of the small-diameter gear portion 54*b*. A ring-shaped spring washer 57 is placed between the inner gear 54 and the sub gear 56 and urges the sub gear 56 in the axial direction away from the inner gear 54. The outside diameter of the large-diameter gear portion 54*a* is the same as the outside diameter of the sub gear 56, and the inclination of the oblique teeth of the large-diameter gear portion 54*a* is the same as the inclination of the outer teeth 56*a* of the sub gear 56.

As shown in FIG. 7, a housing 59 and a cover 60 are attached to the disk portion 52 of the timing sprocket 24*a* by four bolts 58 (only two shown in FIG. 7). The cover 60 has a hole 60*a* in the center.

Figure 9:
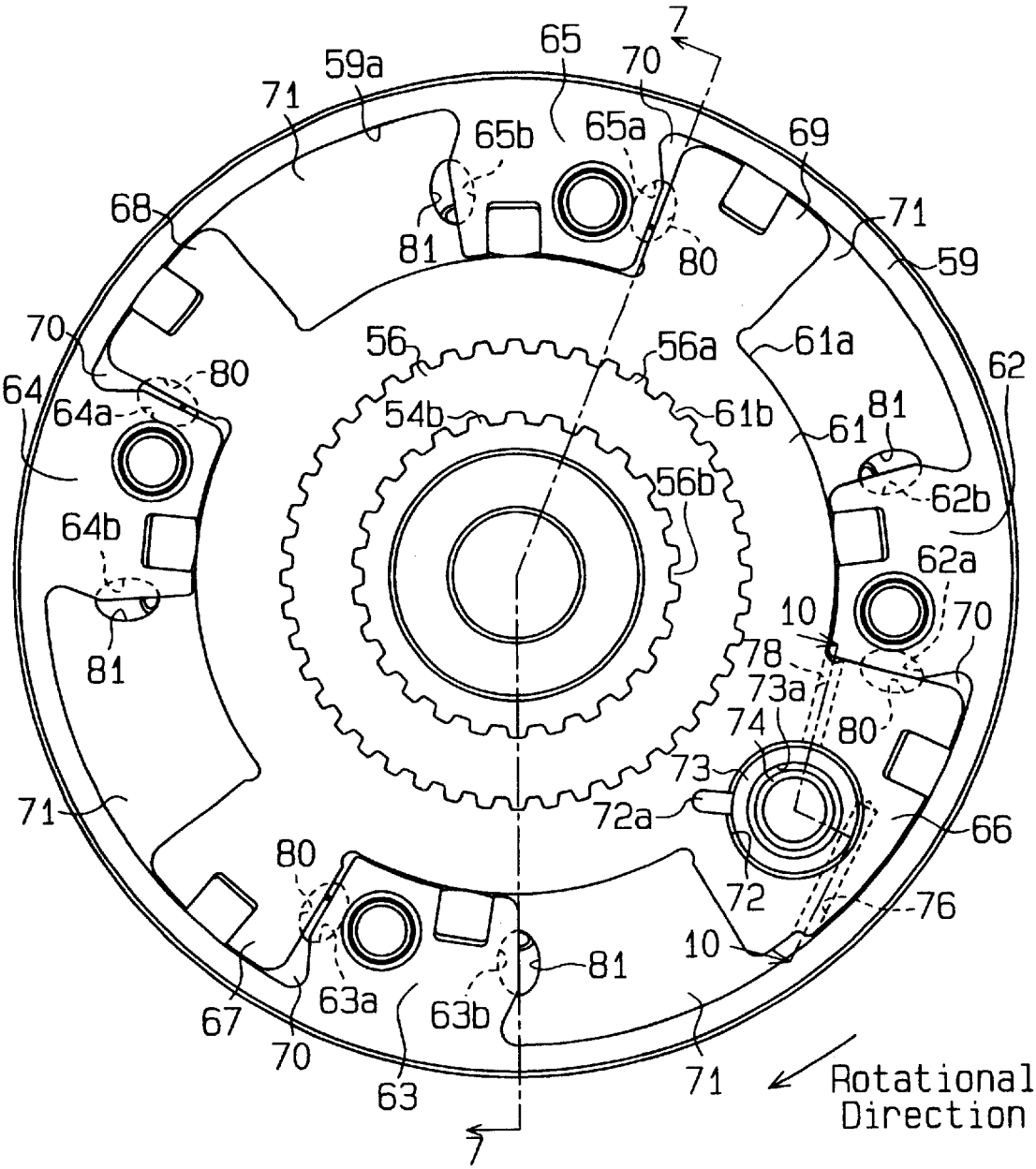
FIG. 9 is an internal structural diagram of the rotational phase changing actuator in FIG. 7.

FIG. 9 shows the interior of the housing 59 as seen from the left side in FIG. 7. In FIG. 9, the bolts 58, the cover 60 and the bolt 55 are removed. As shown in FIGS. 7 and 9, the housing 59 has four wall portions 62, 63, 64 and 65 which protrude toward the center from an inner surface 59*a*. A vane rotor 61 is retained rotatable in the housing 59. An outer surface 61*a* of the vane rotor 61 contacts the distal end faces of the wall portions 62, 63, 64 and 65.

A cylindrical hole 61*c* is formed in the center portion of the vane rotor 61. The space that is defined by the inner surface of the hole 61*c* is open to the outside via a hole 60*a* in the cover 60. A spiral helical spline portion 61*b* is formed on the inner surface of the hole 61*c*. The large-diameter gear portion 54*a* of the inner gear 54 and the outer teeth 56*a* of the sub gear 56 are engaged with the helical spline portion 61*b*.

The inner teeth 56*b* are engaged with the oblique teeth of the small-diameter gear portion 54*b* and the spring washer 57 urges the sub gear 56 away from the inner gear 54. Accordingly, rotational force acts on both gears 54 and 56 in the opposite directions. Therefore, an error caused by backlash between the helical spline portion 61*b* and the gears 54 and 56 is absorbed. FIG. 7 shows only a part of the helical spline portion 61*b* in order to make the diagram easy to see. Actually, the helical spline portion 61*b* is formed on the entire inner surface of the hole 61*c* of the vane rotor 61.

The vane rotor 61 has four vanes 66, 67, 68 and 69 extending outward in the radial direction from the outer surface 61*a*. The vanes 66–69 are placed in spaces between adjoining both wall portions 62–65 and their distal ends contact the inner surface 59*a* of the housing 59. The vanes 66–69 define the spaces between the adjoining both wall portions 62–65 into first pressure chambers 70 and second pressure chambers 71.

Figure 10:
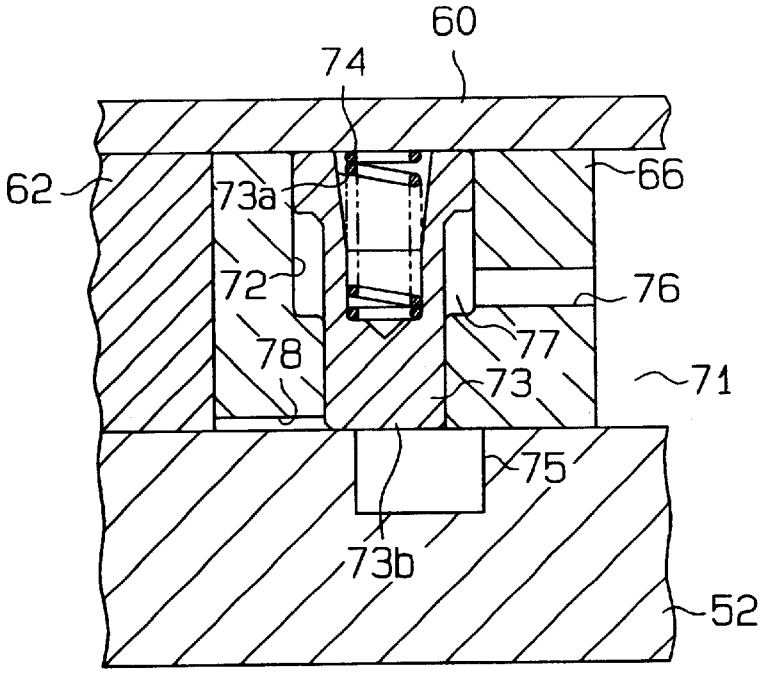
FIG. 10 is a cross-sectional view taken along the line 10—10 in FIG. 9.
Figure 11:
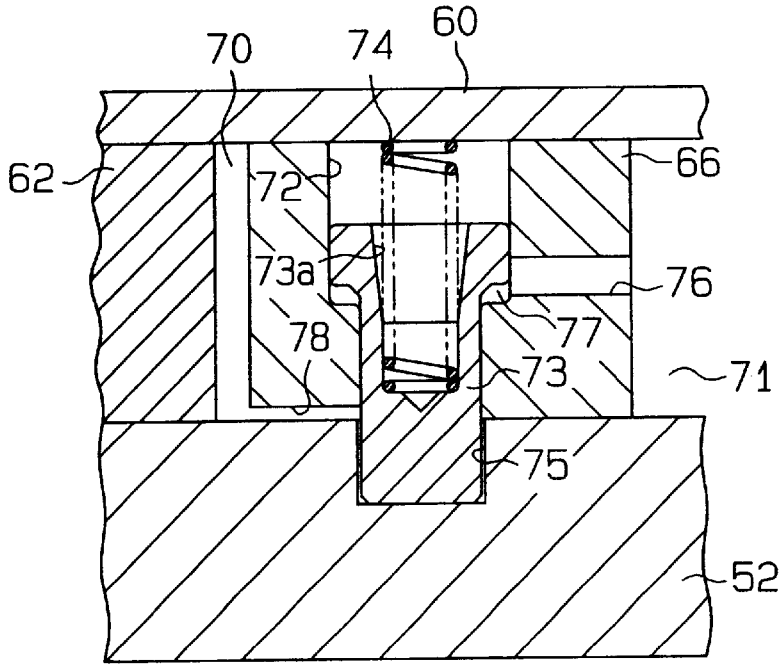
FIG. 11 is a cross-sectional view showing a state where a lock pin in FIG. 10 is in an engagement hole.

One vane 66 has a greater width in the rotational direction as compared with the other vanes 67, 68 and 69. As shown in FIGS. 9 to 11, the vane 66 has a through hole 72 extending in the axial direction of the intake camshaft 22. A lock pin 73 retained in the through hole 72 has a retaining hole 73*a*. A spring 74 disposed in the retaining hole 73*a* urges the lock pin 73 toward the disk portion 52.

On the face to the cover 60, the vane rotor 61 has an oil groove 72*a* which communicates with the through hole 72. The oil groove 72*a* allows an arcuate opening 72*b* (see FIG. 1) which penetrates the cover 60 to communicate with the through hole 72. The opening 72*b* and the oil groove 72*a* have a function of discharging air or oil present in the inner space of the through hole 72 between the lock pin 73 and the cover 60 outside.

When the lock pin 73 faces an engagement hole 75 provided in the disk portion 52, as shown in FIG. 11, the lock pin 73 enters the engagement hole 75 by the force of the spring 74 to secure the relative rotational position of the vane rotor 61 with respect to the disk portion 52. Therefore, the vane rotor 61 and the housing 59 can rotate together. FIGS. 9 and 10 show a state where the vane rotor 61 is at the maximum delayed angle with respect to the housing 59. In this state, the lock pin 73 is shifted from the engagement hole 75 so that a distal end portion 73*b* of the lock pin 73 is not inserted in the engagement hole 75.

At the time of starting the engine 11 or in case where hydraulic pressure control by an electronic control unit (ECU) 130 to be discussed later has not started yet, the hydraulic pressures in the first pressure chamber 70 and the second pressure chamber 71 are zero or not sufficient. In such a case, a counter torque is produced on the intake camshaft 22 in accordance with a cranking operation at the time of engine ignition, so that the vane rotor 61 rotates in the angle advancing direction with respect to the housing 59. Accordingly, the lock pin 73 moves from the state shown in FIG. 10 to the position facing the engagement hole 75 and is inserted into the engagement hole 75 as shown in FIG. 11.

An annular oil chamber 77 is formed in the inner space of the through hole 72 below the head of the lock pin 73. When the hydraulic pressure is supplied to the annular oil chamber 77 from the second pressure chamber 71 via an oil passage 76 formed in the vane 66 after the engine 11 has been started, the lock pin 73 is disengaged from the engagement hole 75 by the hydraulic pressure. As the hydraulic pressure is supplied to the engagement hole 75 from the first pressure chamber 70 via an oil passage 78 formed in the vane 66, the unlock state of the lock pin 73 is surely held.

Figure 12:
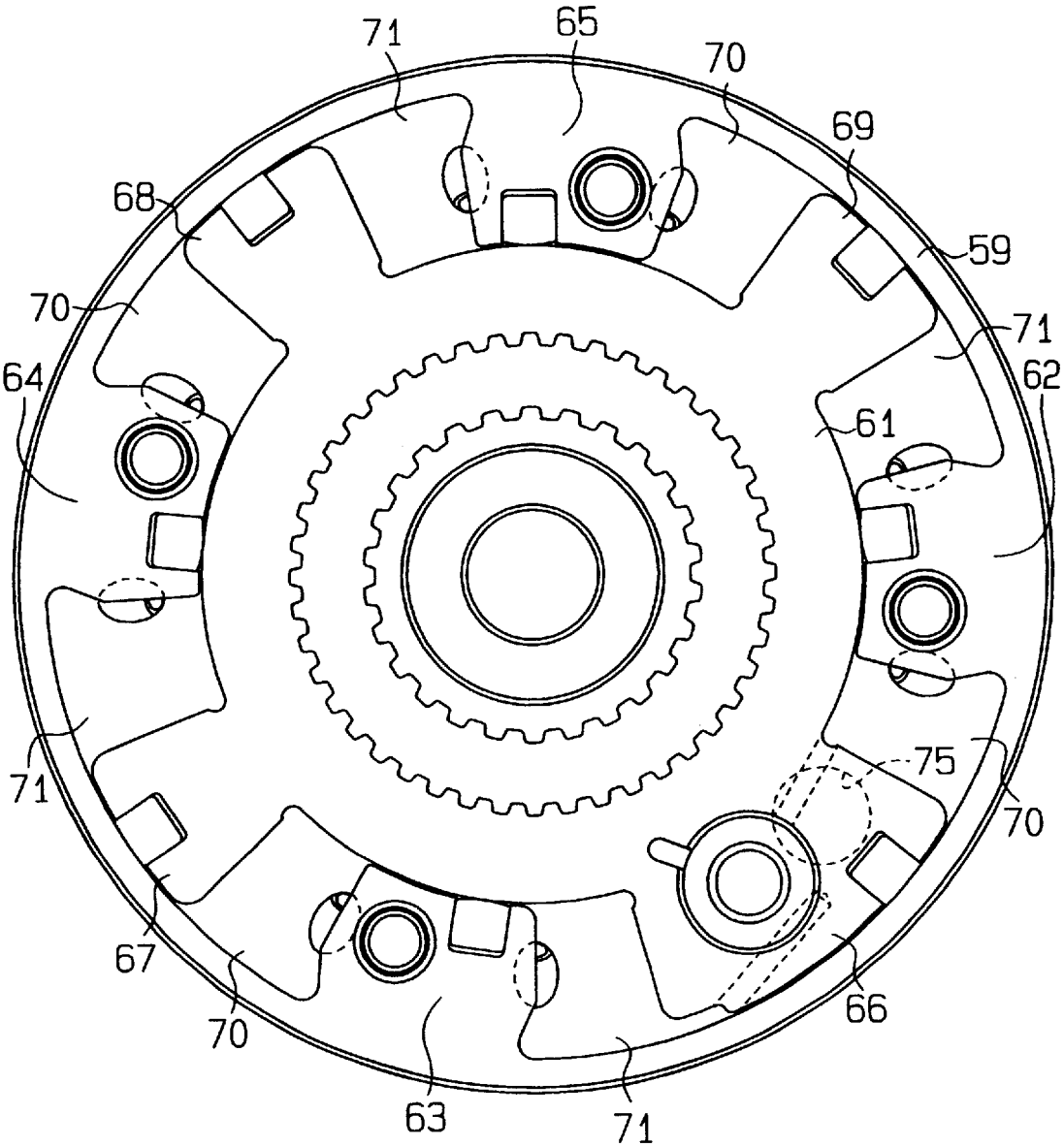
FIG. 12 is a diagram showing a state where a vane rotor in FIG. 9 has been turned in an angle advancing direction.

With the lock pin 73 disengaged from the engagement hole 75, the relative rotation of the housing 59 and the vane rotor 61 is permitted. Then, the relative rotational position of the vane rotor 61 with respect to the housing 59 is adjusted in accordance with the hydraulic pressures supplied to the first pressure chamber 70 and the second pressure chamber 71. FIG. 12 shows a state where the vane rotor 61 advances from what is shown in FIG. 9 with respect to the housing 59.

When the crankshaft 15 rotates, the rotation is transmitted to the timing sprocket 24*a* via the timing chain 15*b*. At this time, the intake camshaft 22 rotates together with the timing sprocket 24*a*. As the intake camshaft 22 rotates, the intake valves 20 are driven.

When the vane rotor 61 is rotated in the rotational direction of the timing sprocket 24*a* with respect to the housing 59 at the time the engine 11 is driven, the rotational phase of the intake camshaft 22 with respect to the crankshaft 15 is changed toward the angle advancing side. As a result, the opening and closing timings of the intake valves 20 are quickened.

When the vane rotor 61 is rotated in the opposite direction to the rotational direction of the timing sprocket 24*a* with respect to the housing 59, on the other hand, the rotational phase of the intake camshaft 22 with respect to the crankshaft 15 is changed toward the angle delaying side. As a result, the opening and closing timings of the intake valves 20 are delayed.

The engagement of the large-diameter gear portion 54*a* of the inner gear 54 with the helical spline portion 61*b* of the vane rotor 61 changes the rotational phase of the intake camshaft 22 with respect to the vane rotor 61 in accordance with the axial position of the intake camshaft 22. That is, when the intake camshaft 22 is moved in the forward direction F by the aforementioned axial movement actuator 22*a*, the intake camshaft 22 rotates with respect to the vane rotor 61 in such a way that the rotational phase of the intake camshaft 22 with respect to the crankshaft 15 is changed toward the angle advancing side. When the intake camshaft 22 is moved in the rearward direction R by the aforementioned axial movement actuator 22*a*, on the other hand, the intake camshaft 22 rotates with respect to the vane rotor 61 in such a way that the rotational phase of the intake camshaft 22 with respect to the crankshaft 15 is changed toward the angle delaying side.

A description will now be given of a mechanism for performing hydraulic pressure control on the rotational phase changing actuator 24. As shown in FIGS. 7 and 9, at positions corresponding to both sides of each of the wall portions 62–65, the disk portion 52 has a first opening 80 which opens to the first pressure chamber 70 and a second opening 81 which opens to the second pressure chamber 71. The wall portions 62–65 have recesses 62*a*–65*a* which communicate with the first openings 80 and recesses 62*b*–65*b* which communicate with the second openings 81.

Two outer grooves 51*a* and 51*b* are formed on the outer surface of the cylinder portion 51 of the timing sprocket 24*a*. The individual first openings 80 are connected to one outer groove 51*a* via angle-advancing oil passages 84, 86 and 88 formed in the timing sprocket 24*a*. The individual second openings 81 are connected to the other outer groove 51*b* via angle-delaying oil passages 85, 87 and 89 formed in the timing sprocket 24*a*.

A lubrication oil passage 90 extending from the angle-delaying oil passage 87 is connected to a wide inner groove 91 provided in an inner surface 51*c* of the cylinder portion 51. A hydraulic fluid which flows in the angle-delaying oil passage 87 is led between the inner surface 51*c* of the cylinder portion 51 and an outer surface 22*b* of the intake camshaft 22 through the lubrication oil passage 90 for lubrication.

A second oil control valve 94 is connected to one outer groove 51*a* via an angle-advancing oil passage 92 in the cylinder head 14. The other outer groove 51*b* is connected to the second oil control valve 94 via an angle-delaying oil passage 93 in the cylinder head 14.

As shown in FIG. 7, a feed passage 95 and an exhaust passage 96 are connected to the second oil control valve 94. The feed passage 95 is connected to the oil pan 13*a* via the oil pump Pm. The exhaust passage 96 serves to return the hydraulic fluid to the oil pan 13*a*. The oil pump Pm shown in FIG. 7 is the same as the oil pump Pm shown in FIG. 6. That is, one oil pump Pm feeds out the hydraulic fluid to two feed passages 37 and 95 from the oil pan 13*a*.

The second oil control valve 94 shown in FIG. 7 has the same structure as the first oil control valve 36 in FIG. 6. That is, a casing 102 of the second oil control valve 94 has a first feed and exhaust port 104, a second feed and exhaust port 106, a first exhaust port 108, a second exhaust port 110 and a feed port 112. The angle-advancing oil passage 92 is connected to the first feed and exhaust port 104, and the angle-delaying oil passage 93 is connected to the second feed and exhaust port 106. The feed passage 95 is connected to the feed port 112, and the exhaust passage 96 is connected to the first exhaust port 108 and second exhaust port 110. A spool 118 in the casing 102 has four valve portions 107. A coil spring 114 and an electromagnetic solenoid 116 urge the spool 118 in the opposite directions.

When the electromagnetic solenoid 116 is de-excited, the spool 118 is placed to the right of the position shown in FIG. 7 by the force of the coil spring 114. In this state, the first feed and exhaust port 104 communicates with the first exhaust port 108 and the second feed and exhaust port 106 communicates with the feed port 112. Therefore, a hydraulic fluid in the oil pan 13*a* is supplied to the second pressure chamber 71 through the feed passage 95, the second oil control valve 94, the angle-delaying oil passage 93, the outer groove 51*b*, the angle-delaying oil passages 89, 87 and 85, the second opening 81 and the recesses 62*b*–65*b*. Further, a hydraulic fluid in the first pressure chamber 70 is returned to the oil pan 13*a* through the recesses 62*a*–65*a*, the first opening 80, the angle-advancing oil passages 84, 86 and 88, the outer groove 51*a*, the angle-advancing oil passage 92, the second oil control valve 94 and the exhaust passage 96. As a result, the vane rotor 61 rotates in the angle delaying direction with respect to the housing 59 so that the rotational phase of the intake camshaft 22 with respect to the crankshaft 15 is delayed.

When the electromagnetic solenoid 116 is excited, the spool 118 is placed to the left of the position shown in FIG. 7 against the force of the coil spring 114. In this state, the second feed and exhaust port 106 communicates with the second exhaust port 110 and the first feed and exhaust port 104 communicates with the feed port 112. Therefore, the hydraulic fluid in the oil pan 13*a* is supplied to the first pressure chamber 70 through the feed passage 95, the second oil control valve 94, the angle-advancing oil passage 92, the outer groove 51*a*, the angle-advancing oil passages 88, 86 and 84, the first opening 80 and the recesses 62*a*–65*a*. Further, the hydraulic fluid in the second pressure chamber 71 is returned to the oil pan 13*a* through the recesses 62*b*–65*b*, the second opening 81, the angle-delaying oil passages 85, 87 and 89, the outer groove 51*b*, the angle-delaying oil passage 93, the second oil control valve 94 and the exhaust passage 96. As a result, the vane rotor 61 rotates in the angle advancing direction with respect to the housing 59 so that the rotational phase of the intake camshaft 22 with respect to the crankshaft 15 is advanced.

When the spool 118 is placed at an intermediate position shown in FIG. 7 by subjecting a current to be supplied to the electromagnetic solenoid 116 to duty ratio control, the first feed and exhaust port 104 and the second feed and exhaust port 106 are closed. In this state, the supply and discharge of the hydraulic fluid are not carried out with respect to the first pressure chamber 70 and the second pressure chamber 71, so that the hydraulic fluid is kept filled in the first pressure chamber 70 and the second pressure chamber 71. Therefore, the rotational position of the vane rotor 61 with respect to the housing 59 is fixed and the rotational phase of the intake camshaft 22 with respect to the crankshaft 15 is maintained.

The duty ratio control of the current to be supplied to the electromagnetic solenoid 116 can adjust the degree of opening of the first feed and exhaust port 104 or the second feed and exhaust port 106 to thereby control the speed of supplying the hydraulic fluid to the first pressure chamber 70 or the second pressure chamber 71.

Next, the profile of the intake cam 27 will be explained. The intake cam 27 is a three-dimensional cam and the profile of its cam face 27*a* continuously changes in the axial direction of the intake camshaft 22 (the direction in which the arrow S extends), as shown in FIG. 13. It should be noted that one of both end faces of the intake cam 27 which faces in the forward direction F is a front end face 27*b* and the other end face which faces in the rearward direction R is a rear end face 27*c*.

Figure 14:
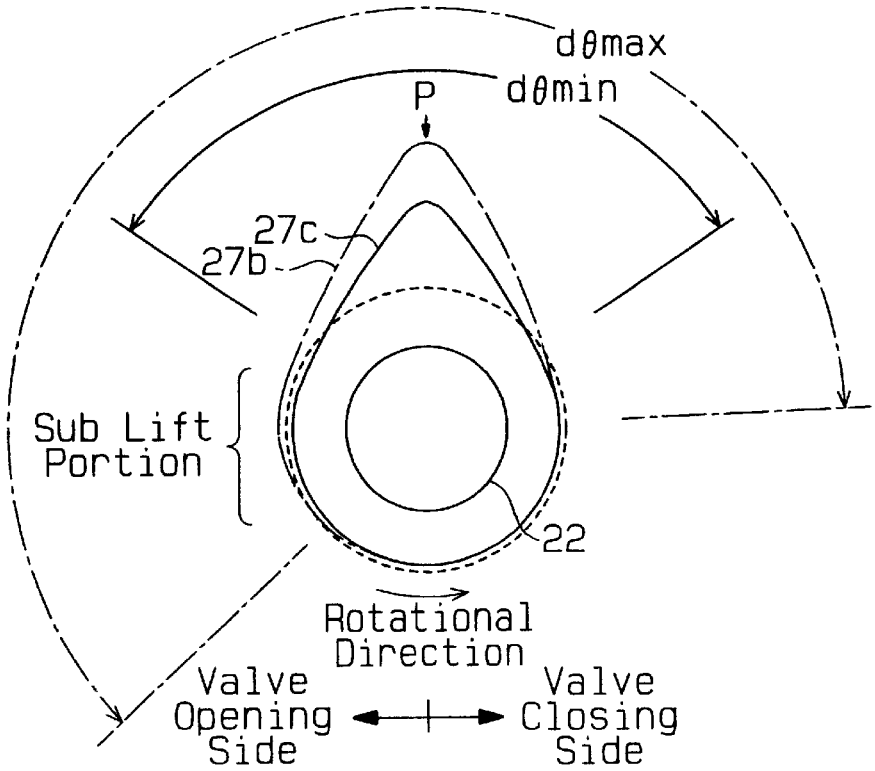
FIG. 14 is a diagram for explaining the profile of the intake cam in FIG. 13.
Figure 15:
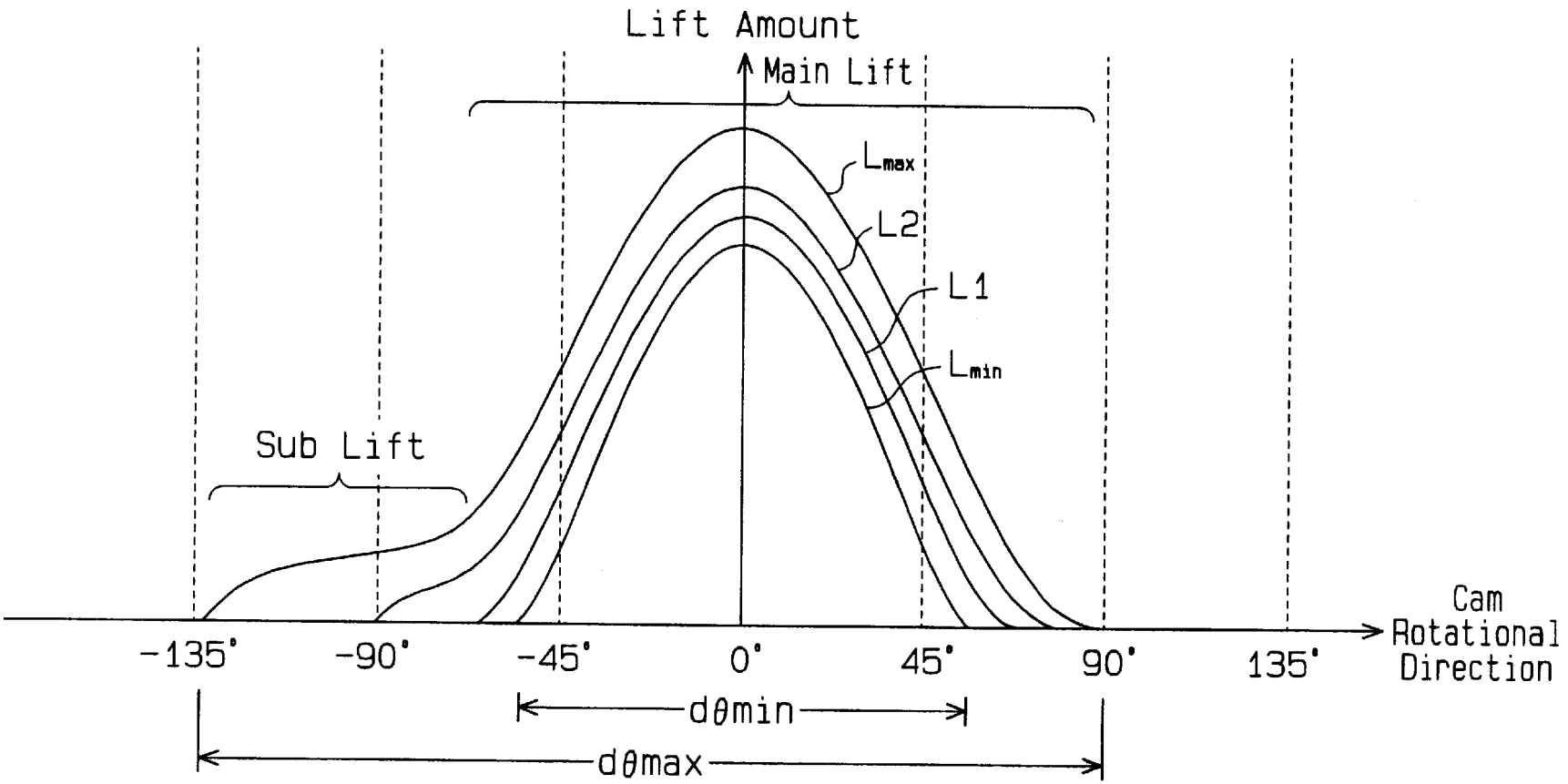
FIG. 15 is a graph showing a lift pattern of the intake cam in FIG. 13.

The height of a cam nose 27*d* becomes gradually greater in a direction toward the front end face 27*b* from the rear end face 27*c*. The angle of action of the intake cam 27 with respect to the intake valve 20 or the angle range of the cam face 27*a* where the intake valve 20 can be opened becomes gradually greater in a direction toward the front end face 27*b* from the rear end face 27*c*. FIGS. 14 and 15 show the angle of action at the cam face 27*a* which is closest to the rear end face 27*c* as a minimum angle of action $d\theta min$ and the angle of action at the cam face 27*a* which is closest to the front end face 27*b* as a maximum angle of action $d\theta max$. The greater the angle of action is, the longer the opening period of the intake valve 20 becomes.

FIG. 15 is a graph showing some lift patterns (cam lift patterns) that are realized by the intake cam 27 in FIG. 13. The horizontal scale shows the rotational angle of the intake cam 27, and the vertical scale shows the lift amount (cam face height) of the intake cam 27. Given that a position on a circle indicated by the broken line in FIG. 14 is taken as a reference position, the lift amount of the intake cam 27 is represented by the radial distance from the reference position to the cam face 27*a*. The intake cam 27 can move the intake valve 20 by the cam face 27*a* located radially outward of the reference position. The rotational angle of the intake cam 27 is 0° when a peak P of the cam nose 27*d* abuts on the valve lifter 20*a*.

The cam lift pattern directly reflects the lift pattern of the intake valve 20 (valve lift pattern). Given that the vertical scale is the lift amount of the intake valve 20, therefore, FIG. 15 is a graph showing the valve lift pattern. This is applied to any graph which will be discussed hereinafter.

Lmin indicates the lift pattern (first lift pattern) of the cam face 27*a* which is closest to the rear end face 27*c*. Lmax indicates the lift pattern (second lift pattern) of the cam face 27*a* which is closest to the front end face 27*b*. The cam lift pattern continuously changes from Lmin to Lmax in a direction toward the front end face 27*b* from the rear end face 27*c*. L1 and L2 are cam lift patterns which are obtained between both lift patterns Lmin and Lmax.

As shown in FIGS. 14 and 15, the cam face 27*a* has a sub lift portion for realizing a sub lift pattern in addition to a main lift portion for realizing an ordinary lift pattern (main lift pattern). The main lift portion causes the intake valve 20 to perform a basic lift operation and the sub lift portion assists the action of the main lift portion.

The sub lift portion of the cam face 27*a* which is closer to the front end face 27*b* realizes a prominent sub lift pattern. The cam face 27*a* which is close to the rear end face 27*c* does not have a sub lift portion, so that a sub lift pattern does not appear in the lift pattern Lmin. The sub lift portion is provided at that portion of the cam face 27*a* which moves the intake valve 20 in the opening direction (valve opening side). A sub lift portion does not exist at that portion of the cam face 27*a* which permits the movement of the intake valve 20 in the closing direction (valve closing side). Therefore, the angle of action of the intake cam 27 changes more greatly on the valve opening side of the cam face 27*a* than on the valve closing side of the cam face 27*a*.

As described above, the intake cam 27 has the cam face 27*a* having the main lift portion and sub lift portion which continuously change in the axial direction. In other words, the intake cam 27 realizes various cam lift patterns which are a combination of the main lift pattern and the sub lift pattern that continuously change in the axial direction. Therefore, the intake valve 20 is provided with various valve lift patterns that reflect such cam lift patterns.

The further in the rearward direction R the intake camshaft 22 moves, the closer to the front end face 27*b* the axial position of the cam face 27*a* which abuts on the valve lifter 20*a* (FIG. 1) comes, so that the angle of action of the intake cam 27 with respect to the intake valve 20 becomes greater. The further in the forward direction F the intake camshaft 22 moves, on the other hand, the closer to the rear end face 27*c* the axial position of the cam face 27*a* which abuts on the valve lifter 20*a* comes, so that the angle of action of the intake cam 27 with respect to the intake valve 20 becomes smaller. As the axial position of the cam face 27*a* which abuts on the valve lifter 20*a* comes closer to the front end face 27*b*, the opening timing of the intake valve 20 is rapidly advanced by the action of the sub lift portion.

Figure 16:
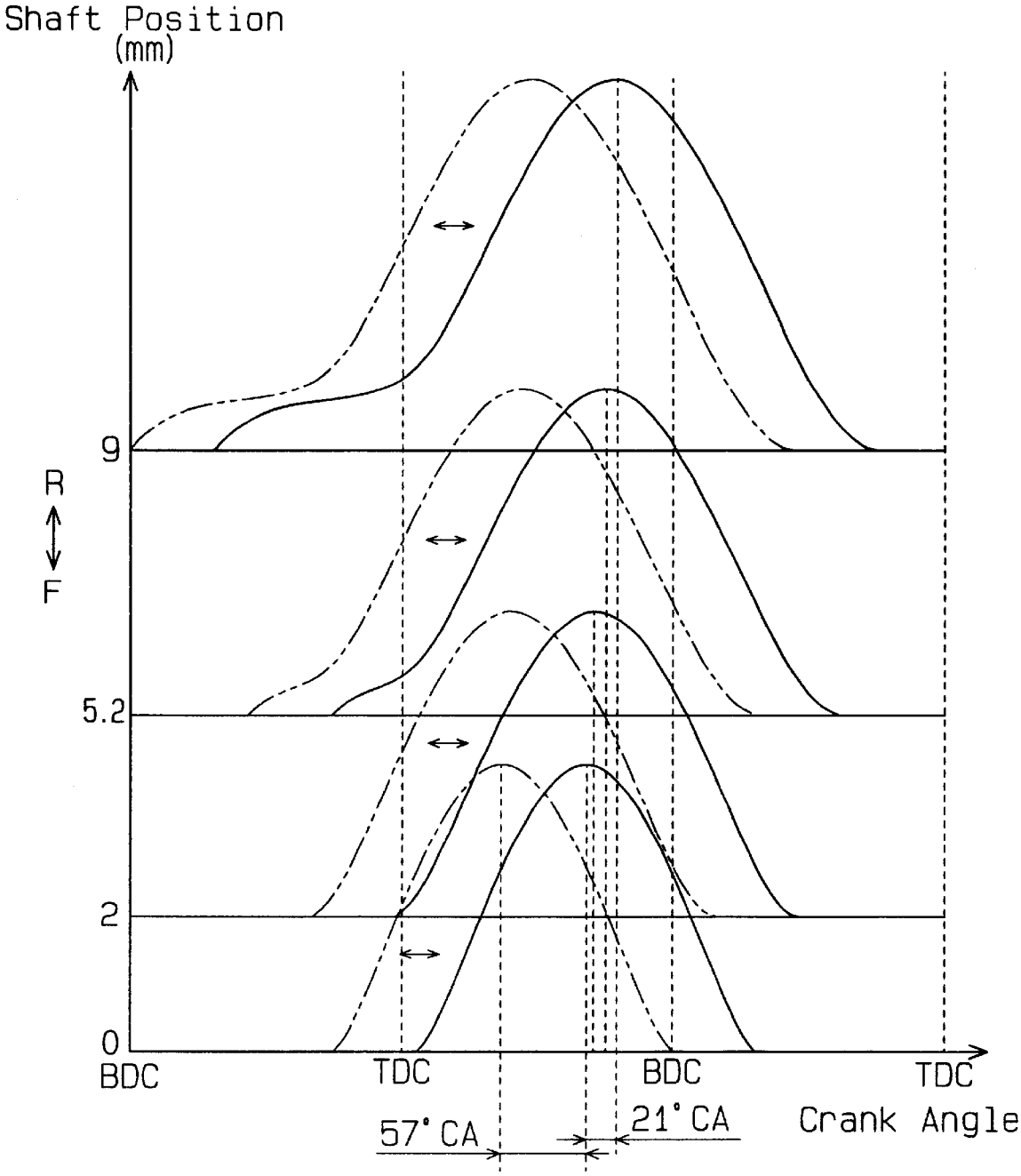
FIG. 16 is a graph showing a state of a change in an intake valve characteristic which is realized by the intake cam in FIG. 13.

FIG. 16 is a graph showing a state of a change in the valve characteristic of the intake valve 20 according to changes in the axial position and rotational phase of the intake camshaft 22. The horizontal scale indicates the angle of the crankshaft 15 (crank angle CA) and the vertical scale indicates the axial position of the intake camshaft 22. In the horizontal scale, BDC indicates the bottom dead center of the piston 12 and TDC indicates the top dead center of the piston 12. The axial position of the intake camshaft 22 is shown provided that the state where the intake camshaft 22 is placed at the moving end in the forward direction F is zero of the reference position.

As shown in FIG. 16, the axial movement actuator 22*a* moves the intake camshaft 22 in the axial direction by 9 mm at a maximum. FIG. 16 shows valve lift patterns when the intake camshaft 22 is moved by 0 mm, 2 mm, 5.2 mm and 9 mm in the rearward direction R from the reference position. As described above, as the intake camshaft 22 moves in the rear direction R, the rotational phase of the intake camshaft 22 with respect to the crankshaft 15 is delayed. In the present embodiment, as shown in FIG. 16, the rotational phase of the intake cam 27 differs by 21° CA between when the cam face 27*a* which is closest to the front end face 27*b* abuts on the valve lifter 20*a* and when the cam face 27*a* which is closest to the rear end face 27*c* abuts on the valve lifter 20*a*. In other words, the axial movement of the intake camshaft 22 changes the rotational phase of the intake cam 27 by 21° CA at a maximum.

The rotational phase changing actuator 24 advances the intake camshaft 22 by a maximum of 57° CA from the maximum delayed angle position. The lift patterns that are indicated by solid lines in FIG. 16 show lift patterns when the intake camshaft 22 is at the maximum delayed angle position, and the lift patterns that are indicated by two-dot chain lines show lift patterns when the intake camshaft 22 is advanced by 57° CA.

As shown in FIG. 16, as the axial position and rotational phase of the intake cam 27 are changed by both actuators 22*a* and 24, the valve characteristic of the intake valve 20 is adjusted over a wide range.

FIG. 17 illustrates an engine control system. An ECU 130 is comprised of a digital computer and includes a CPU 130*a*, RAM 130*b*, ROM 130*c*, an input port 130*d*, an output port 130*e* and a bidirectional bus 130*f* which mutually connects them.

A throttle angle sensor 146*a* sends out a voltage proportional to the degree of opening of a throttle valve 146 (throttle angle TA) to the input port 130*d* via an AD converter 173. A fuel pressure sensor 150*a* provided in a fuel distribution pipe 150 sends out a voltage proportional to the fuel pressure in the fuel distribution pipe 150 to the input port 130*d* via the AD converter 173. A pedal sensor 176 sends out a voltage proportional to the depression amount of an acceleration pedal 174 to the input port 130*d* via the AD converter 173. A crank angle sensor 182 generates a pulse signal every time the crankshaft 15 rotates 30 degrees and outputs the pulse signal to the input port 130*d*. The CPU 130*a* computes an engine speed NE based on the pulse signal from the crank angle sensor 182.

A cam angle sensor 183*a* generates a pulse signal in accordance with the rotation of the intake camshaft 22 and sends out the pulse signal to the input port 130*d*. The CPU 130*a* determines a cam angle and the position of the piston in each cylinder based on the pulse signal from the cam angle sensor 183*a*, and computes a current crank angle based on this cylinder identification data and the pulse signal from the crank angle sensor 182. The CPU 130*a* also acquires the rotational phase of the intake camshaft 22 with respect to the crankshaft 15 based on the crank angle and the cam angle. A shaft position sensor 183*b* sends out a voltage proportional to the axial position of the intake camshaft 22 to the input port 130*d* via the AD converter 173.

An intake pressure sensor 184 provided in the surge tank 18*c* sends out a voltage corresponding to the pressure of air in the surge tank 18*c* (intake pressure PM: absolute pressure) to the input port 130*d* via the AD converter 173. A coolant temperature sensor 186 provided in the cylinder block 13 detects a temperature THW of a coolant flowing in the cylinder block 13 and sends out a voltage according to the coolant temperature THW to the input port 130*d* via the AD converter 173. An air-fuel ratio sensor 188 provided in an exhaust manifold 148 sends out a voltage according to the air-fuel ratio of the mixture of air and fuel to the input port 130*d* via the AD converter 173. The CPU 130*a* acquires an oxygen concentration Vox based on a signal from the air-fuel ratio sensor 188.

The output port 130*e* is connected to the fuel injection valves 17*b*, the actuator 18*f* for the air-flow control valve 18*d*, the first oil control valve 36, the second oil control valve 94, a drive motor 144 for the throttle valve 146, an auxiliary fuel injection valve 152, an electromagnetic spill valve 154*a* of a high-pressure fuel pump 154 and an igniter 192 via associated drive circuits 190.

Figure 18:
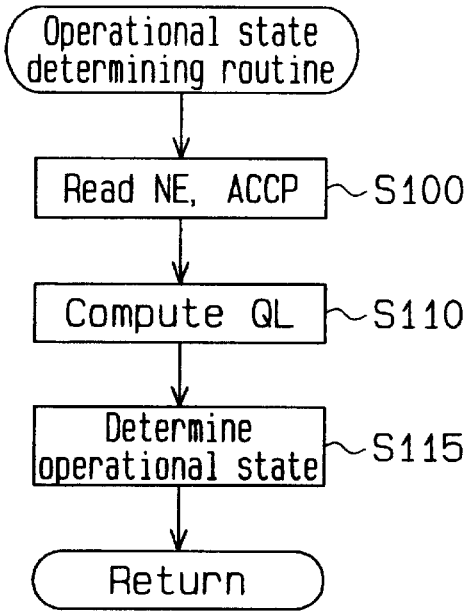
FIG. 18 is a flowchart illustrating an engine operational state determining routine.

A description will now be given of fuel injection control and a process associated therewith. FIG. 18 is a flowchart illustrating a routine for determining the operational state of the engine 11. This determining routine is periodically executed by the ECU 130 every preset crank angle after the engine has been warmed up.

In step S100, the ECU 130 reads the engine speed NE and the depression amount of the acceleration pedal 174 (pedal depression amount) ACCP into a working area in the RAM 130*b*.

Figure 19:
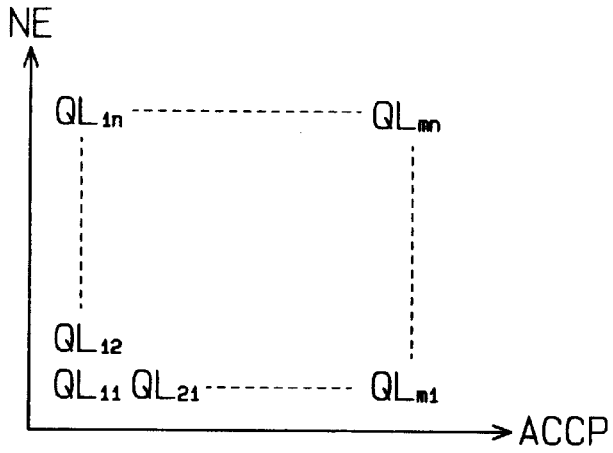
FIG. 19 is a graph showing a map to be used in computing a lean fuel injection amount QL.

Next, the ECU 130 computes a lean fuel injection amount QL based on the engine speed NE and the pedal depression amount ACCP in step S110. The lean fuel injection amount QL indicates the optimal fuel injection amount to achieve a demanded torque at the time of executing stratified charge combustion. The lean fuel injection amount QL is acquired in accordance with a map as shown in FIG. 19 which uses the pedal depression amount ACCP and engine speed NE as parameters. This map is previously stored in the ROM 130*c*.

Figure 20:
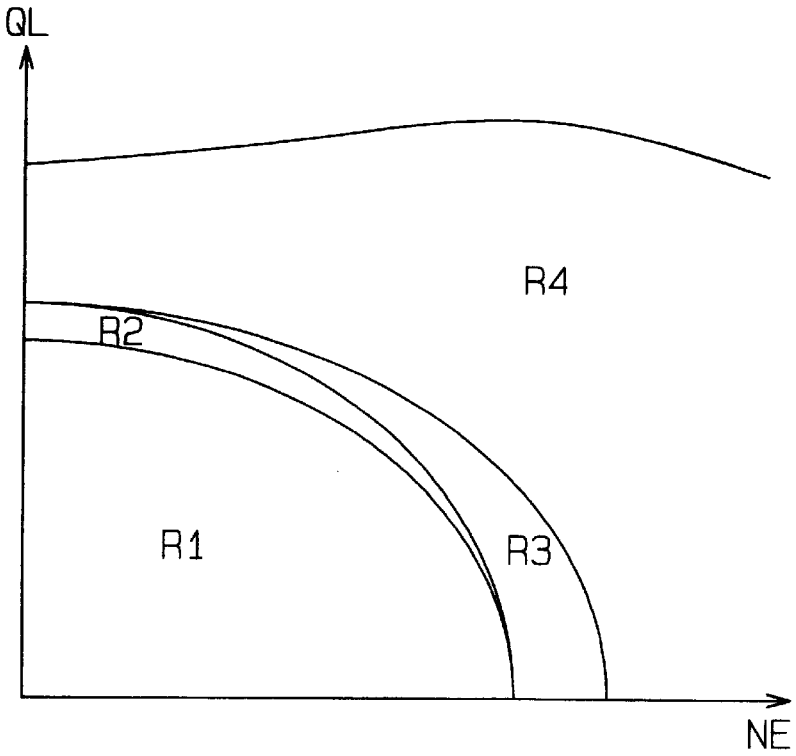
FIG. 20 is a graph showing a map to be used in determining an engine operational state.

Next, in step S115, the ECU 130 determines to which one of four areas R1, R2, R3 and R4 present in the map shown in FIG. 20 the current engine operational state belongs based on the lean fuel injection amount QL and the engine speed NE. Thereafter, the ECU 130 temporarily terminates the process. The ECU 130 executes fuel injection control to be discussed later in accordance with the determined engine operational state.

Figure 21:
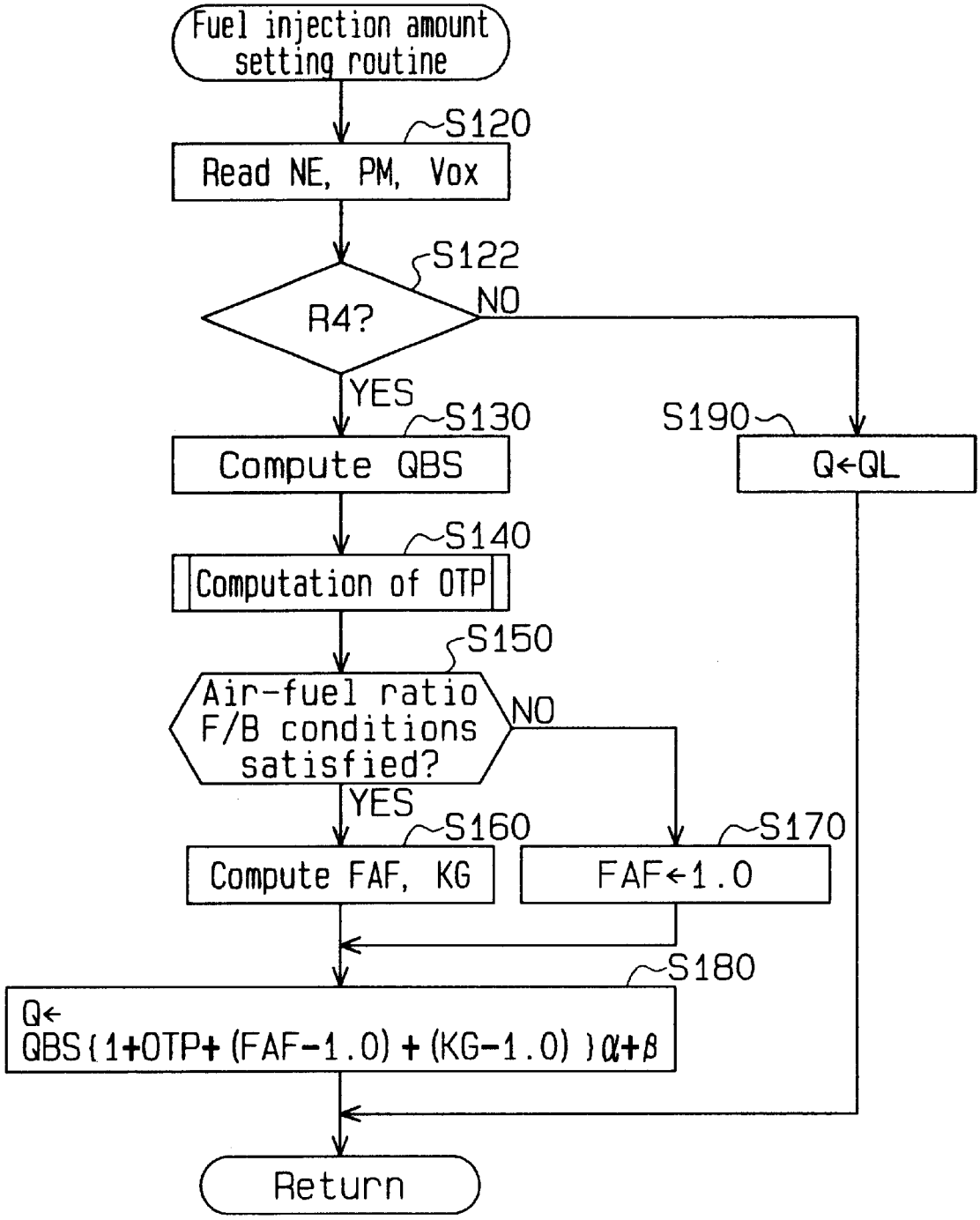
FIG. 21 is a flowchart illustrating a fuel injection amount setting routine.
Figure 22:
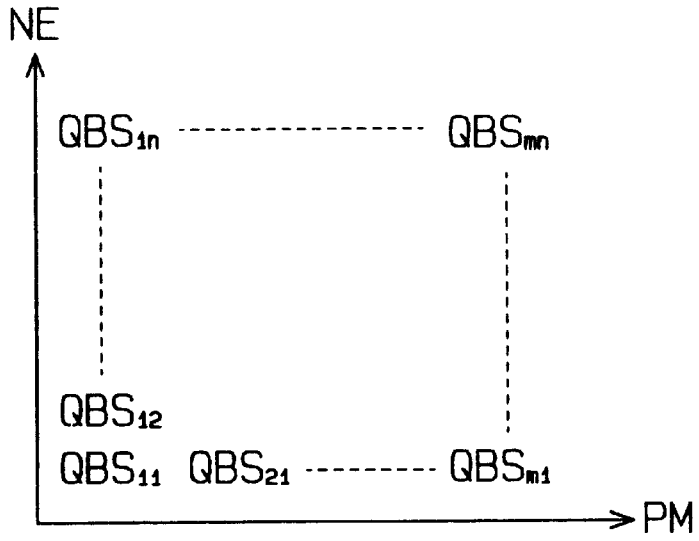
FIG. 22 is a graph showing a map to be used in computing a basic fuel injection amount QBS.
Figure 23:
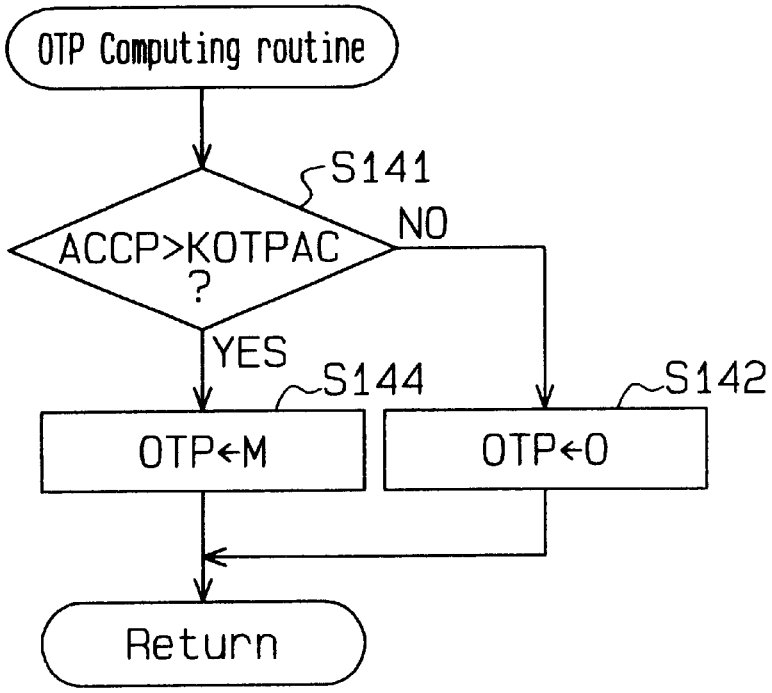
FIG. 23 is a flowchart illustrating a fuel increase value computing routine.

FIG. 21 is a flowchart illustrating a fuel injection amount setting routine. This setting routine is periodically executed by the ECU 130 every preset crank angle after the engine has been warmed up. In case where the engine 11 is started, the engine 11 is in an idling state before warm-up is completed or the like, the fuel injection amount is set by a setting routine separate from the routine in FIG. 21.

The ECU 130 first reads the engine speed NE, the intake pressure PM and the oxygen concentration Vox into a working area in the RAM 130*b* in step S120.

Next, the ECU 130 determines whether or not the current engine operational state belongs to the area R4 in step S122. When the current engine operational state belongs to the area R4, the ECU 130 moves to step S130 and computes a basic fuel injection amount QBS based on the intake pressure PM and the engine speed NE using a map shown in FIG. 22 which is previously set in the ROM 130*c*.

Then, the ECU 130 performs a process of computing a fuel increase value OTP in step 140. This computation process is illustrated in detail in a flowchart in FIG. 23. That is, the ECU 130 first determines whether or not the pedal depression amount ACCP exceeds a predetermined decision value KOTPAC in step S141. When ACCP≦KOTPAC, the ECU 130 goes to step S142 and sets the fuel increase value OTP to zero. That is, fuel increase correction is not carried out when the engine 11 is not running under a high load. When ACCP>KOTPAC, the ECU 130 goes to step S144 and sets the fuel increase value OTP to a predetermined value M (e.g., 1>M>0). That is, when the engine 11 is running under a high load, fuel increase correction is carried out to prevent overheating of a catalytic converter 149 (see FIG. 17).

Thereafter, the ECU 130 moves to step S150 in the routine in FIG. 21 and determines whether or not an air-fuel ratio feedback conditions are met. The air-fuel ratio feedback conditions include, for example, that the engine 11 is not cranking up, that the fuel injection is not stopped, that the warm-up of the engine 11 has been completed (e.g., the coolant temperature THW is equal to or higher than 40°), that the air-fuel ratio sensor 188 is enabled and that the fuel increase value OTP is zero. In step S150, it is determined whether or not all of the conditions are satisfied.

When the air-fuel ratio feedback conditions are met, the ECU 130 goes to step S160 and computes an air-fuel ratio feedback coefficient FAF and a learned value KG thereof. The air-fuel ratio feedback coefficient FAF is computed based on the signal from the air-fuel ratio sensor 188. The learned value KG is a value to be updated based on a deviation between the air-fuel ratio feedback coefficient FAF and 1.0 which is a reference value of the coefficient FAF. The air-fuel ratio control technique using the air-fuel ratio feedback coefficient FAF and the learned value KG is disclosed in, for example, Japanese Laid-Open Patent Publication No. Hei 6-10736.

When the air-fuel ratio feedback conditions are not met, the ECU 130 goes to step S170 and sets the air-fuel ratio feedback coefficient FAF to 1.0.

In step S180 next to step S160 or S170, the ECU 130 acquires a fuel injection amount Q according to the following equation 1 and temporarily terminates the process thereafter.

$$Q \leftarrow QBS\{1+OTP+(FAF-1.0)+(KG-1.0)\}\alpha+\beta \qquad \text{Eq. 1}$$

where α and β are coefficients that are properly set in accordance with the type of the engine 11 and the contents of control.

When the current engine operational state belongs to an area other than the area R4 or belongs to one of the areas R1, R2 and R3 in the step S122, the ECU 130 moves to step S190. In step S190, the ECU 130 sets the lean fuel injection amount QL as the fuel injection amount Q and temporarily terminates the process.

Figure 24:
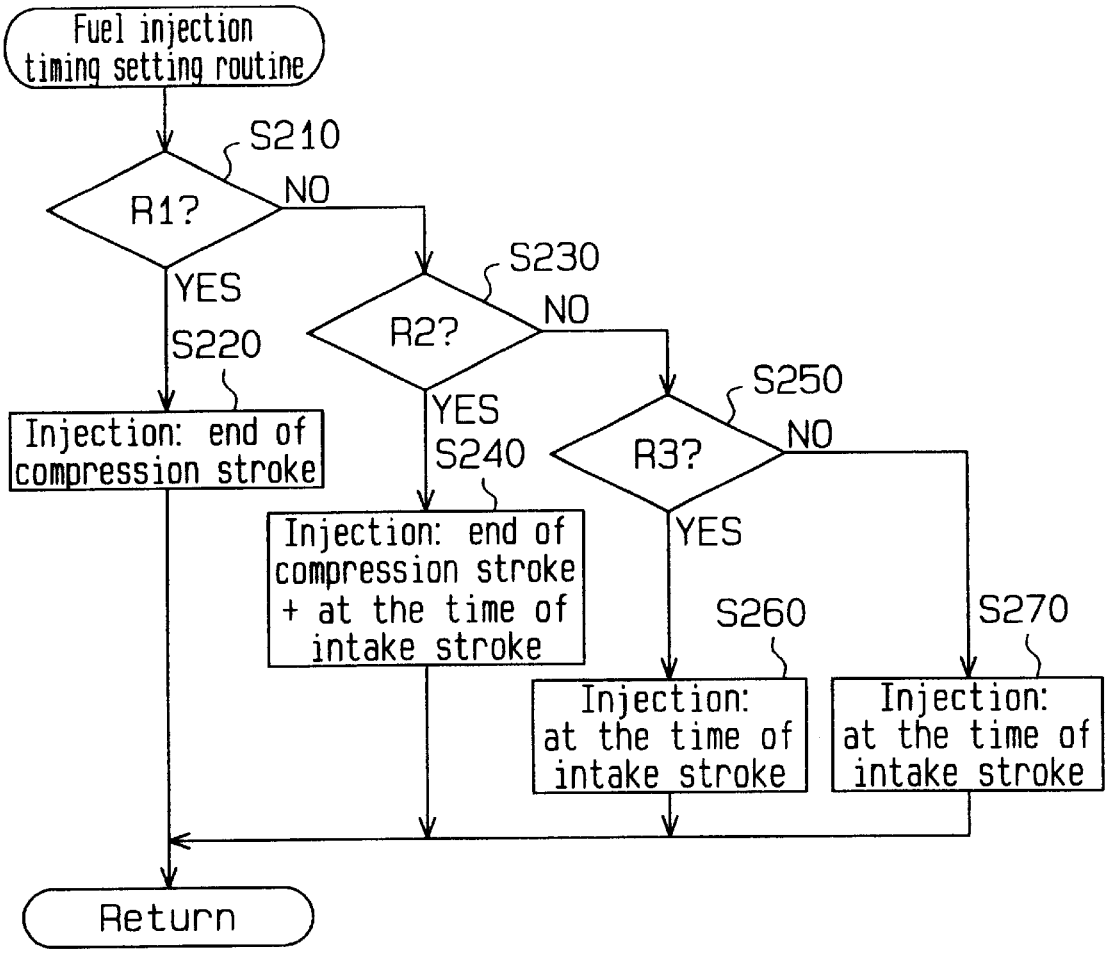
FIG. 24 is a flowchart illustrating a fuel injection timing setting routine.

FIG. 24 is a flowchart illustrating a fuel injection timing setting routine. This setting routine is executed in the same cycle as the setting routine in FIG. 21 after engine warm-up. In case where the engine 11 is started, the engine 11 is in an idling state before warm-up is completed or the like, the fuel injection timing is set by a setting routine separate from the routine in FIG. 24.

The ECU 130 first determines whether or not the current engine operational state belongs to the area R1 in step S210, and when it belongs to the area R1, the ECU 130 moves to step S220 and sets the fuel injection timing to the end of the compression stroke of the piston 12. Therefore, fuel whose amount corresponds to the lean fuel injection amount QL is injected into the combustion chamber 17 at the end of the compression stroke of the piston 12. The injected fuel hits against a wall surface 12*b* of the recess 12*a* of the piston 12, thus forming an inflammable mixture layer in the vicinity of the ignition plug 17*a* (see FIG. 3 and FIG. 4). As the inflammable mixture layer is ignited by the ignition plug 17*a*, stratified charge combustion is executed.

When the engine operational state does not belong to the area R1 in step S210, the ECU 130 moves to step S230 and determines whether or not the engine operational state belongs to the area R2. When the engine operational state belongs to the area R2, the ECU 130 goes to step S240 and sets the fuel injection timing to two timings, the time of the intake stroke and the end of the compression stroke of the piston 12. Therefore, fuel whose amount corresponds to the lean fuel injection amount QL is injected into the combustion chamber 17 in two times, at the time of the intake stroke and the end of the compression stroke. The fuel injected at the time of the intake stroke, together with the intake air, forms a homogeneous lean mixture in the entire combustion chamber 17. The fuel subsequently injected at the end of the compression stroke forms an inflammable mixture layer in the vicinity of the ignition plug 17*a* as in the aforementioned case of stratified charge combustion. The inflammable mixture layer is ignited by the ignition plug 17*a*, and the lean mixture occupying the entire combustion chamber 17 is burned by the ignited flame. That is, when the engine operational state belongs to the area R2, a weak stratified charge combustion which has a lower degree of stratified charge than the aforementioned stratified charge combustion is executed.

When the engine operational state does not belong to the area R2 in step S230, the ECU 130 moves to step S250 and determines whether or not the engine operational state belongs to the area R3. When the engine operational state belongs to the area R3, the ECU 130 goes to step S260 and sets the fuel injection timing to the time of the intake stroke of the piston 12. Therefore, fuel whose amount corresponds to the lean fuel injection amount QL is injected into the combustion chamber 17 at the time of the intake stroke. The injected fuel, together with the intake air, forms a homogeneous mixture in the entire combustion chamber 17. While this mixture is relatively lean, it has an air-fuel ratio of such a level as to be ignitable by the ignition plug 17*a*. As a result, lean homogeneous charge combustion is executed.

When the engine operational state does not belong to the area R3 in step S250, i.e., when it belongs to the area R4, the ECU 130 moves to step S270 and sets the fuel injection timing to the time of the intake stroke of the piston 12. Therefore, fuel whose amount corresponds to the fuel injection amount Q obtained in step S180 in FIG. 21 is injected into the combustion chamber 17 at the time of the intake stroke. The injected fuel, together with the intake air, forms a homogeneous mixture in the entire combustion chamber 17. The air-fuel ratio of this mixture is the stoichiometric air-fuel ratio or richer. As a result, homogeneous charge combustion with the mixture having the stoichiometric air-fuel ratio or richer ratio is executed.

In case where the engine 11 is started or the engine 11 is in an idling state before completion of warm-up, homogeneous charge combustion is executed by injecting the necessary amount of fuel at the time of the intake stroke.

Figure 25:
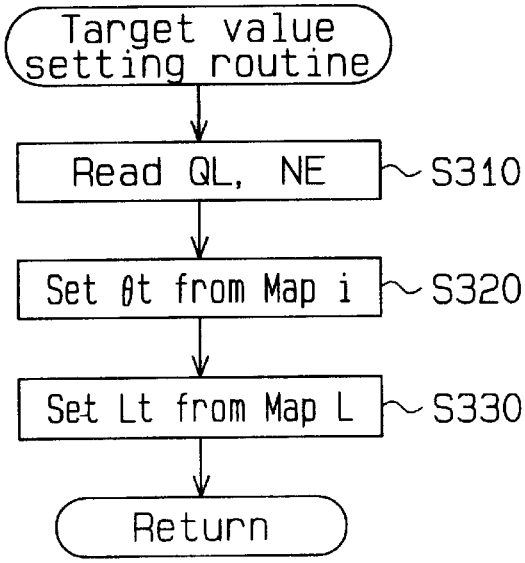
FIG. 25 is a flowchart illustrating a routine for setting target values needed for valve characteristic control.

A description will now be given of procedures of controlling the valve characteristic of the intake valve 20. FIG. 25 is a flowchart illustrating a routine for setting target values needed for valve characteristic control. This setting routine is cyclically executed every predetermined period.

Although not illustrated in the flowchart in FIG. 25, the ECU 130 performs feedback control on the axial movement actuator 22*a* based on the signal from the shaft position sensor 183*b* in such a way that the actual axial position of the intake camshaft 22 coincides with a target axial position Lt to be discussed later. Further, the ECU 130 performs feedback control on the rotational phase changing actuator 24 based on the signals from the crank angle sensor 182 and the cam angle sensor 183*a* in such a way that the rotational phase angle (advancing angle value) of the intake camshaft 22 with respect to the crankshaft 15 coincides with a target advancing angle value θt to be discussed later.

As shown in FIG. 25, in step S310, the ECU 130 first reads parameters representing the engine operational state, such as the lean fuel injection amount QL, which reflects the engine load, and the engine speed NE. As a value which reflects the engine load, the pedal depression amount ACCP, for example, may be used in place of the lean fuel injection amount QL.

Figure 26A:
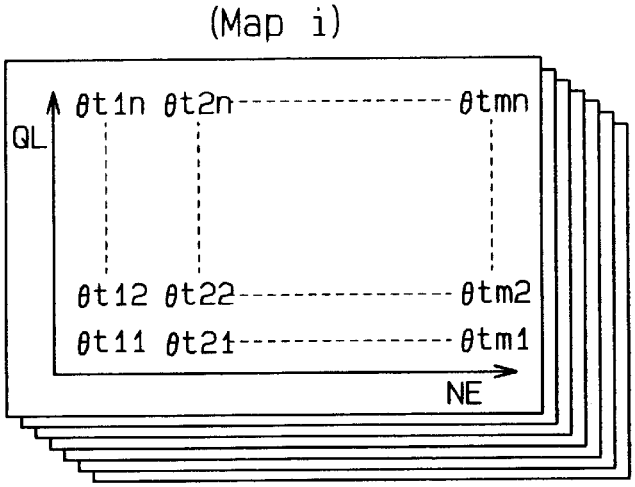
FIG. 26(A) is a graph showing a map to be used in setting a target advancing angle value θt.

Then, the ECU 130 sets the target advancing angle value θt based on maps i shown in FIG. 26(A) in step S320. As shown in FIG. 26(A), the maps i are for setting the target advancing angle value θt with the lean fuel injection amount QL and the engine speed NE as parameters. The maps i are prepared for various engine operational states, such as the individual areas R1–R4, the time of starting the engine and an idling state before completion of warm-up of the engine 11 or the like. Therefore, a map i corresponding to the current engine operational state is selected first and the target advancing angle value θt is set based on the lean fuel injection amount QL and the engine speed NE in accordance with the selected map i.

Figure 26B:
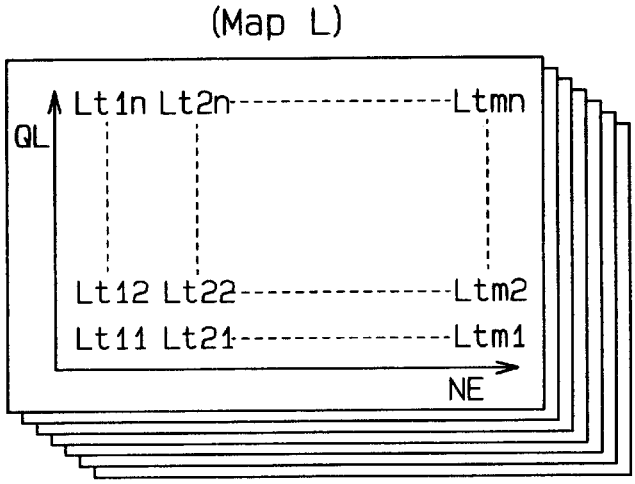
FIG. 26(B) is a graph showing a map to be used in setting a target axial position Lt.

Next, the ECU 130 sets the target axial position Lt based on maps L shown in FIG. 26(B) in step S330, then temporarily terminates the process. As shown in FIG. 26(B), the maps L are for setting the target axial position Lt with the lean fuel injection amount QL and the engine speed NE as parameters. The maps L are prepared for various engine operational states, such as the individual areas R1–R4, the time of starting the engine and an idling state before completion of warm-up of the engine 11 or the like. Therefore, a map L corresponding to the current engine operational state is selected first and the target axial position Lt is set based on the lean fuel injection amount QL and the engine speed NE in accordance with the selected map L.

Figure 27:
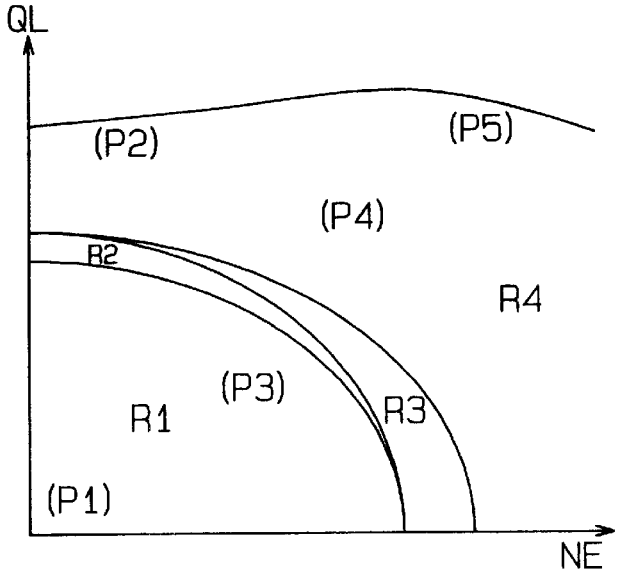
FIG. 27 corresponding to the map in FIG. 20 is a graph exemplifying various engine operational states P1–P5.

Specific examples of the valve characteristic control will now be discussed. FIG. 27, like the maps in FIG. 20, show four areas R1, R2, R3 and R4 of engine operational states. FIG. 27 shows five types of engine operational states which belong to one of the areas R1–R4, as P1 to P5. Those engine operational states P1–P5 will be discussed below.

Operational state P1: idling state before completion of warm-up

Operational state P2: low-speed and high-load operational state, excluding the idling state, after completion of warm-up Operational state P3: low-speed and low-load operational state, excluding the idling state, after completion of warm-up Operational state P4: middle-speed and middle-load operational state, excluding the idling state, after completion of warm-up Operational state P5: high-speed and high-load operational state, excluding the idling state, after completion of warm-up As the operational state P1 is an idling state before completion of warm-up, the fuel injection timing is set at the time of the intake stroke in the operational state P1. In the operational states P2–P5, the fuel injection timing is set in accordance with the routine in FIG. 24. Specifically, the fuel injection timing is set at the time of the intake stroke in the operational states P2, P4 and P5 and is set at the end of the compression stroke in the operational state P3.

A vertical column (A) and a vertical column (B) in FIG. 28 correspond to the operational states P1–P5 and show the target axial position Lt (mm) and the target advancing angle value θt (° CA) obtained in accordance with the routine in FIG. 25. The axial position of the intake camshaft 22 is expressed by a moving distance in the rearward direction R from the reference position provided that the state where the intake camshaft 22 is placed at the moving end in the forward direction F is the reference position of zero. As mentioned above, as the intake camshaft 22 moves in the rearward direction R, the rotational phase of the intake camshaft 22 is delayed. The value indicated in parentheses below the target axial position Lt is a delayed angle value (° CA) of the intake camshaft 22 corresponding to the target axial position Lt. The advancing angle value θt of the intake camshaft 22 is expressed by a crank angle CA in the angle advancing direction from a reference angle provided that the state where the vane rotor 61 is at the maximum delayed angle position with respect to the housing 59 is the reference angle of zero.

When the rotational phase changing actuator 24 and the axial movement actuator 22*a* are driven based on the target axial position Lt and the target advancing angle value θt, the rotational phase angle (advancing angle value) of the intake cam 27 with respect to the crankshaft 15 becomes as shown in a vertical column (C) in FIG. 28. The advancing angle value of the intake cam 27 is expressed by a crank angle CA in the angle advancing direction from a reference angle provided that the state where the intake camshaft 22 is positioned at the moving end in the forward direction F and the vane rotor 61 is at the maximum delayed angle position with respect to the housing 59 is the reference angle of zero.

When the advancing angle value of the intake cam 27 becomes as shown in the vertical column (C) in FIG. 28, an opening timing BTDC and a closing timing ABDC of the intake valve 20 respectively become as shown in a vertical column (D) and vertical column (E) in FIG. 28. The opening timing BTDC of the intake valve 20 is expressed by a crank angle CA in the angle advancing direction from a reference timing provided that the point at which the piston 12 is placed at the top dead center in the intake stroke is the reference timing of zero. The closing timing ABDC of the intake valve 20 is expressed by a crank angle CA in the angle advancing direction from a reference timing provided that the point at which the piston 12 is placed at the bottom dead center in the intake stroke is the reference timing of zero. A vertical column (F) in FIG. 28 shows the angle of action of the intake cam 27 with respect to the intake valve 20.

Figure 29:
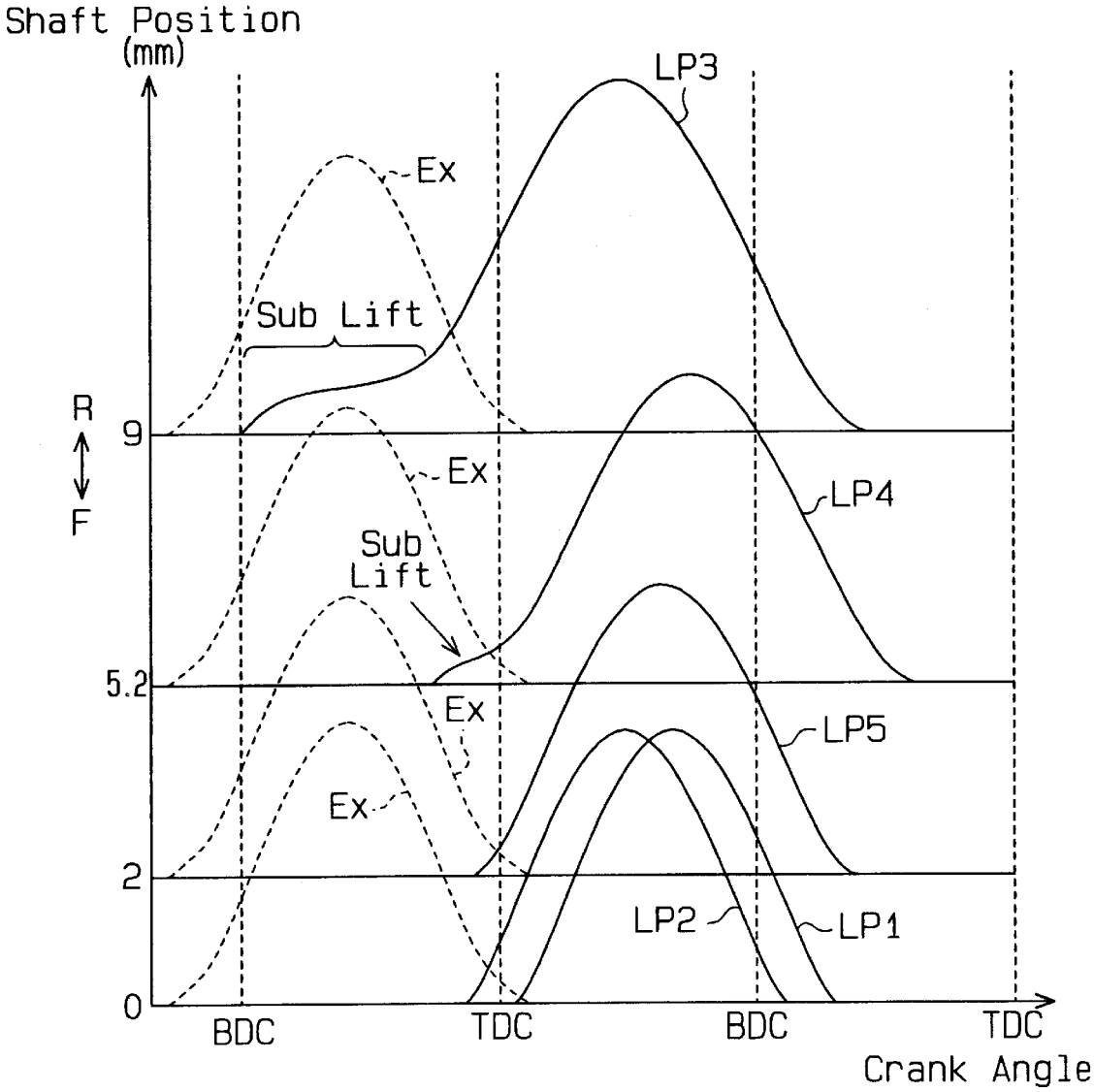
FIG. 29 is a graph showing valve characteristic patterns LP1–LP5 which are respectively set in association with the engine operational states P1–P5.

FIG. 29 shows valve characteristic patterns LP1–LP5 which are respectively set in association with the five types of engine operational states P1–P5. A valve characteristic pattern Ex indicated by the broken line is the characteristic pattern of the exhaust valve 21.

In the operational state P1 which is an idling state before completion of warm-up, homogeneous charge combustion is executed. In the operational state P1, to stabilize the rotation of the engine 11, the target axial position Lt is set at 0 mm and the target advancing angle value θt is set at 0° CA so that the advancing angle value of the intake cam 27 is set at 0° CA, as shown in FIG. 28. As a result, the valve characteristic pattern LP1 shown in FIG. 29 is realized. In the valve characteristic pattern LP1, the angle of action of the intake cam 27 becomes small; in other words, the opening period of the intake valve 20 becomes short. This raises the pressure in the combustion chamber 17 without delaying the closing timing of the intake valve 20. In the valve characteristic pattern LP1, a period in which the exhaust valve 21 and the intake valve 20 are both opened, i.e., a valve overlapping amount becomes small (or zero). As a result, the rotation of the engine 11 is stabilized.

In the operational state P2 which is a low-speed and high-load operational state, homogeneous charge combustion is executed. In the operational state P2, to allow the engine 11 to generate sufficient torque, the target axial position Lt is set at 0 mm and the target advancing angle value θt is set at 34° CA so that the advancing angle value of the intake cam 27 is set at 34° CA, as shown in FIG. 28. As a result, the valve characteristic pattern LP2 shown in FIG. 29 is realized. In the valve characteristic pattern LP2, the opening period of the intake valve 20 becomes short and the closing timing is quickened. As a result, it becomes possible to increase the volumetric efficiency of the engine 11 by using pulsation of the intake air in the operational state P2 so that the engine 11 generates a sufficient output torque.

In the operational state P3 which is a low-speed and low-load operational state, stratified charge combustion is executed. In the operational state P3, to execute good stratified charge combustion, the target axial position Lt is set to 9 mm and the target advancing angle value θt is set to 57° CA so that the advancing angle value of the intake cam 27 is set to 36° CA, as shown in FIG. 28. As a result, the valve characteristic pattern LP3 shown in FIG. 29 is realized. In the valve characteristic pattern LP3, the opening period of the intake valve 20 becomes maximum and the opening timing becomes maximum. That is, as the axial position of the cam face 27*a* which abuts on the valve lifter 20*a* comes closest to the front end face 27*b*, a sub lift pattern appears most prominently in the valve characteristic pattern LP3 by the action of the sub lift portion of the cam face 27*a*. As a result, the valve overlapping amount becomes extremely large.

As the valve overlapping amount becomes large, the exhaust gas in the combustion chamber 17 enters the intake port 18 in the exhaust stroke of the piston 12 and the exhaust gas is returned to the combustion chamber 17 together with air at the time of the intake stroke. Therefore, the amount of the exhaust gas to be supplied into the combustion chamber 17 becomes sufficiently large. This can ensure good and stable stratified charge combustion. At the time of the stratified charge combustion, the degree of opening of the throttle valve 146 is made relatively large, so that the pumping loss of the engine 11 is reduced.

The sub lift portion of the cam face 27*a* can permit the valve overlapping amount to be increased while keeping the lift amount of the intake valve 20 relatively small. This makes it possible to reliably prevent the opened intake valve 20 from interfering with the piston 12 positioned at the top dead center in the intake stroke.

In the operational state P4 which is a middle-speed and middle-load operational state, homogeneous charge combustion is executed. In the operational state P4, to improve the fuel consumption, the target axial position Lt is set at 5.2 mm and the target advancing angle value θt is set at 0° CA so that the advancing angle value of the intake cam 27 is set at −12° CA, as shown in FIG. 28. As a result, the valve characteristic pattern LP4 shown in FIG. 29 is realized. In the valve characteristic pattern LP4, the opening period of the intake valve 20 becomes long and the closing timing becomes sufficiently slow. As a result, a part of air temporarily taken into the combustion chamber 17 is returned to the intake port 18 via the opened intake valve 20. This can allow the degree of opening of the throttle valve 146 to be increased at the time of the homogeneous charge combustion, thus contributing to reduction of the pumping loss and improvement of the fuel consumption. In the valve characteristic pattern LP4 too, the action of the sub lift portion of the cam face 27*a* reliably prevents the opened intake valve 20 from interfering with the piston 12 positioned at the top dead center in the intake stroke.

In the operational state P5 which is a high-speed and high-load operational state, homogeneous charge combustion is executed. In the operational state P5, to allow the engine 11 to generate sufficient torque, the target axial position Lt is set at 2 mm and the target advancing angle value θt is set at 14° CA so that the advancing angle value of the intake cam 27 is set at 9° CA, as shown in FIG. 28. As a result, the valve characteristic pattern LP5 shown in FIG. 29 is realized. In the valve characteristic pattern LP5, the opening period of the intake valve 20 becomes an intermediate level and the closing timing is delayed slightly. As a result, it becomes possible to increase the volumetric efficiency of the engine 11 by using pulsation of the intake air in the operational state P5 so that the engine 11 generates a sufficient output torque.

Note that suitable valve characteristics can be realized in accordance with the maps i and L shown in FIG. FIG. 26(A) and FIG. 26(B) even with respect to other engine operational states than the above-described operational states P1–PS, e.g., engine operational states that belong to the areas R2 and R3.

The embodiment described above provides the following advantages.

The intake cam 27 has the cam face 27*a* having a main lift portion and a sub lift portion which continuously change in the axial direction. As the intake cam 27 is moved in the axial direction, the intake valve 20 is provided with various valve lift characteristics which are a combination of the main lift pattern and the sub lift pattern and the opening timing, closing timing, opening period and lift amount of the intake valve 20 are adjusted steplessly over a wide range. The main lift portion and the sub lift portion that change in the axial direction cooperate to ensure a variety of adjustments of the valve characteristic. It is therefore possible to make the valve characteristic fully match with diverse engine performances demanded in accordance with the operational states of the engine 11.

The cam face 27*a* which is near the rear end face 27*c* of he intake cam 27 does not have a sub lift portion, and, what is more, the height of the cam nose 27*d* is lower than that of the cam face 27*a* near the front end face 27*b*. And, the profile of the cam face 27*a* continuously changes in the axial direction between the front end face 27*b* and the rear end face 27*c*. In accordance with the axial movement of the intake cam 27, therefore, the valve lift pattern continuously changes between a state where it does not have a sub lift pattern and has a low main lift pattern and a state where it has a sub lift pattern and has a high main lift pattern. Therefore, complicated intake valve characteristics can be realized.

The rotational phase changing actuator 24 is provided which continuously changes the rotational phase of the intake cam 27 with respect to the crankshaft 15. Further, the axial movement actuator 22*a* cooperates with the rotational phase changing actuator 24 to change the rotational phase of the intake cam 27 with respect to the crankshaft 15 in accordance with the axial movement of the intake cam 27. It is therefore possible to shift each of various valve lift patterns realized by the axial movement of the intake cam 27 either in the angle advancing direction or the angle delaying direction, so that a greater variety of valve characteristics can be achieved.

The sub lift portion of the cam face 27*a* can permit the valve overlapping amount to be increased while keeping the lift amount of the intake valve 20 relatively small. This makes it possible to reliably prevent the opened intake valve 20 from interfering with the piston 12 positioned at the top dead center in the intake stroke. To realize good stratified charge combustion, the top of the piston 12 of the engine 11 which executes stratified charge combustion is formed into a unique shape (see FIGS. 3 to 5). Even with the unique shape of the piston 12, the sub lift portion of the cam face 27*a* in the present embodiment sufficiently secures the valve overlapping amount while preventing the interference of the intake valve 20 with the piston 12. Therefore, the freedom of design of the piston 12 is increased, so that an effective stratified charge combustion can be achieved by using the piston 12 whose shape is most suitable for stratified charge combustion.

Second Embodiment

A second embodiment of the present invention will now be described in accordance with FIGS. 30 to 33, centering on the differences from the first embodiment in FIGS. 1 to 29. Same symbols are given to components equivalent to those of the embodiment in FIGS. 1 to 29 to omit a detailed description.

Figure 30:
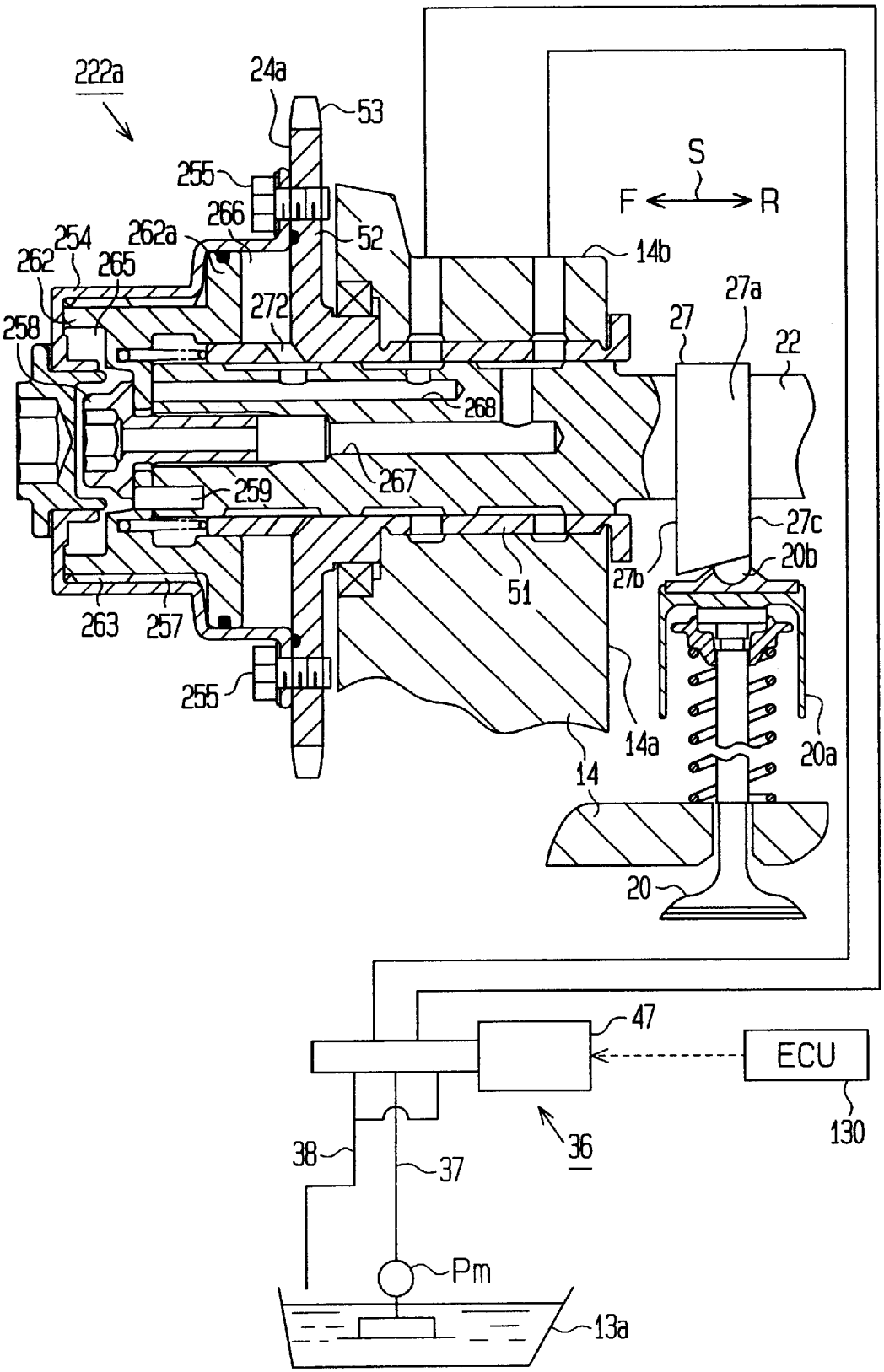
FIG. 30 is a structural diagram of an axial movement actuator according to a second embodiment of the present invention.

In the present embodiment, a valve-characteristic changing actuator 222*a* shown in FIG. 30 is provided only at one end of the intake camshaft 22 in place of the axial movement actuator 22*a* in FIG. 6 and the rotational phase changing actuator 24 in FIG. 7. The valve-characteristic changing actuator 222*a* moves the intake camshaft 22 in the axial direction and changes the rotational phase of the intake camshaft 22 with respect to the crankshaft 15 in interlocking with the axial movement. That is, according to the present embodiment, the rotational phase of the intake camshaft 22 is not changed independently of the axial position of the shaft 22. A valve-characteristic changing mechanism or the valve-characteristic changing actuator 222*a* is a mechanism for changing the lift amount of the intake valve 20 and the valve timing at the same time. The valve-characteristic changing actuator 222*a* serves as both an axial movement mechanism and a rotational phase changing mechanism.

As shown in FIG. 30, like the rotational phase changing actuator 24 in FIG. 7, the valve-characteristic changing actuator 222*a* has a timing sprocket 24*a*. A cover 254 which covers the end portion of the intake camshaft 22 is fixed to the timing sprocket 24*a* by a plurality of bolts 255. The cover 254 has a small-diameter portion and a large-diameter portion. A plurality of inner teeth 257 extending helically in a right-hand screw direction are provided on the inner surface of the small-diameter portion of the cover 254.

A cylindrical ring gear 262 is secured to the end portion of the intake camshaft 22 by a hollow bolt 258 and a pin 259. Oblique teeth 263 in a right-hand screw direction which engage with the inner teeth 257 of the cover 254 are formed on the outer surface of the ring gear 262. The engagement of the inner teeth 257 with the oblique teeth 263 causes the rotation of the timing sprocket 24*a* and the cover 254 to be transferred to the ring gear 262 and the intake camshaft 22. Further, the engagement of the inner teeth 257 with the oblique teeth 263 causes the ring gear 262 and the intake camshaft 22 to move in the axial direction while rotating with respect to the cover 254 and the timing sprocket 24*a*.

As the ring gear 262 and the intake camshaft 22 move axially in the rearward direction R with respect to the cover 254 and the timing sprocket 24*a*, the abutting position of the cam face 27*a* with respect to a cam follower 20*b* provided on the valve lifter 20*a* changes in such a way as to approach the front end face 27*b* of the intake cam 27. In interlocking with the movement of the intake camshaft 22 in the rearward direction R, the intake camshaft 22 rotates together with the intake cam 27 in such a way as to advance the angle with respect to the crankshaft 15.

As the ring gear 262 and the intake camshaft 22 move axially in the forward direction F with respect to the cover 254 and the timing sprocket 24*a*, the abutting position of the cam face 27*a* with respect to the cam follower 20*b* changes in such a way as to approach the rear end face 27*c* of the intake cam 27. In interlocking with the movement of the intake camshaft 22 in the forward direction F, the intake camshaft 22 rotates together with the intake cam 27 in such a way as to delay the angle with respect to the crankshaft 15.

A description will now be given of a hydraulic drive mechanism for the valve-characteristic changing actuator 222*a*. As shown in FIG. 30, the ring gear 262 has a disk portion 262*a* which defines the internal space of the cover 254 into a first hydraulic pressure chamber 266 and a second hydraulic pressure chamber 265. The intake camshaft 22 has a first oil passage 268 which communicates with the first hydraulic pressure chamber 266 and a second oil passage 267 which communicates with the second hydraulic pressure chamber 265.

The second oil passage 267 is connected to the second hydraulic pressure chamber 265 via the interior of the hollow bolt 258 and connected to an oil control valve 36 via the bearing cap 14*b* and a passage formed in the cylinder head 14. The first oil passage 268 is connected to the first hydraulic pressure chamber 266 via an oil passage 272 formed in the timing sprocket 24*a* and connected to the oil control valve 36 via the bearing cap 14*b* and a passage formed in the cylinder head 14.

The oil control valve 36 has a structure similar to that of the first oil control valve 36 shown in FIG. 6, and is connected to the oil pan 13*a* via the feed passage 37 and the pump Pm and connected to the oil pan 13*a* via the exhaust passage 38.

When the electromagnetic solenoid 47 of the oil control valve 36 is de-excited, a hydraulic fluid in the oil pan 13*a* is supplied to the first hydraulic pressure chamber 266 via the feed passage 37, the oil control valve 36 and the first oil passage 268. At this time, a hydraulic fluid in the second hydraulic pressure chamber 265 is returned to the oil pan 13*a* via the second oil passage 267, the oil control valve 36 and the exhaust passage 38. As a result, the ring gear 262 and the intake camshaft 22 are moved in the forward direction F as shown in FIG. 30. In accordance with this movement, the intake cam 27 is rotated in such a way as to delay the angle with respect to the crankshaft 15.

When the electromagnetic solenoid 47 is excited, a hydraulic fluid in the oil pan 13*a* is supplied to the second hydraulic pressure chamber 265 via the feed passage 37, the oil control valve 36 and the second oil passage 267. At this time, the hydraulic fluid in the first hydraulic pressure chamber 266 is returned to the oil pan 13*a* via the first oil passage 268, the oil control valve 36 and the exhaust passage 38. As a result, the ring gear 262 and the intake camshaft 22 are moved in the rearward direction R. In accordance with this movement, the intake cam 27 is rotated in such a way as to advance the angle with respect to the crankshaft 15.

When the flow of the hydraulic fluid through the oil control valve 36 is blocked by performing duty ratio control subjecting on a current to be supplied to the electromagnetic solenoid 47, the supply and discharge of the hydraulic fluid with respect to the first hydraulic pressure chamber 266 and the second hydraulic pressure chamber 265 are not carried out. Therefore, the hydraulic fluid is kept filled in both hydraulic pressure chambers 266 and 265, so that the axial positions of the ring gear 262 and the intake camshaft 22 are fixed.

The intake cam 27 is quite the same as the one shown in FIG. 13 and FIG. 14. It is to be noted however that while the intake cam 27 delays the angle with respect to the crankshaft 15 in accordance with the movement of the intake camshaft 22 in the rearward direction R in the embodiment in FIGS. 1 to 29, the intake cam 27 advances the angle with respect to the crankshaft 15 in accordance with the movement of the intake camshaft 22 in the rearward direction R in the present embodiment.

Figure 31:
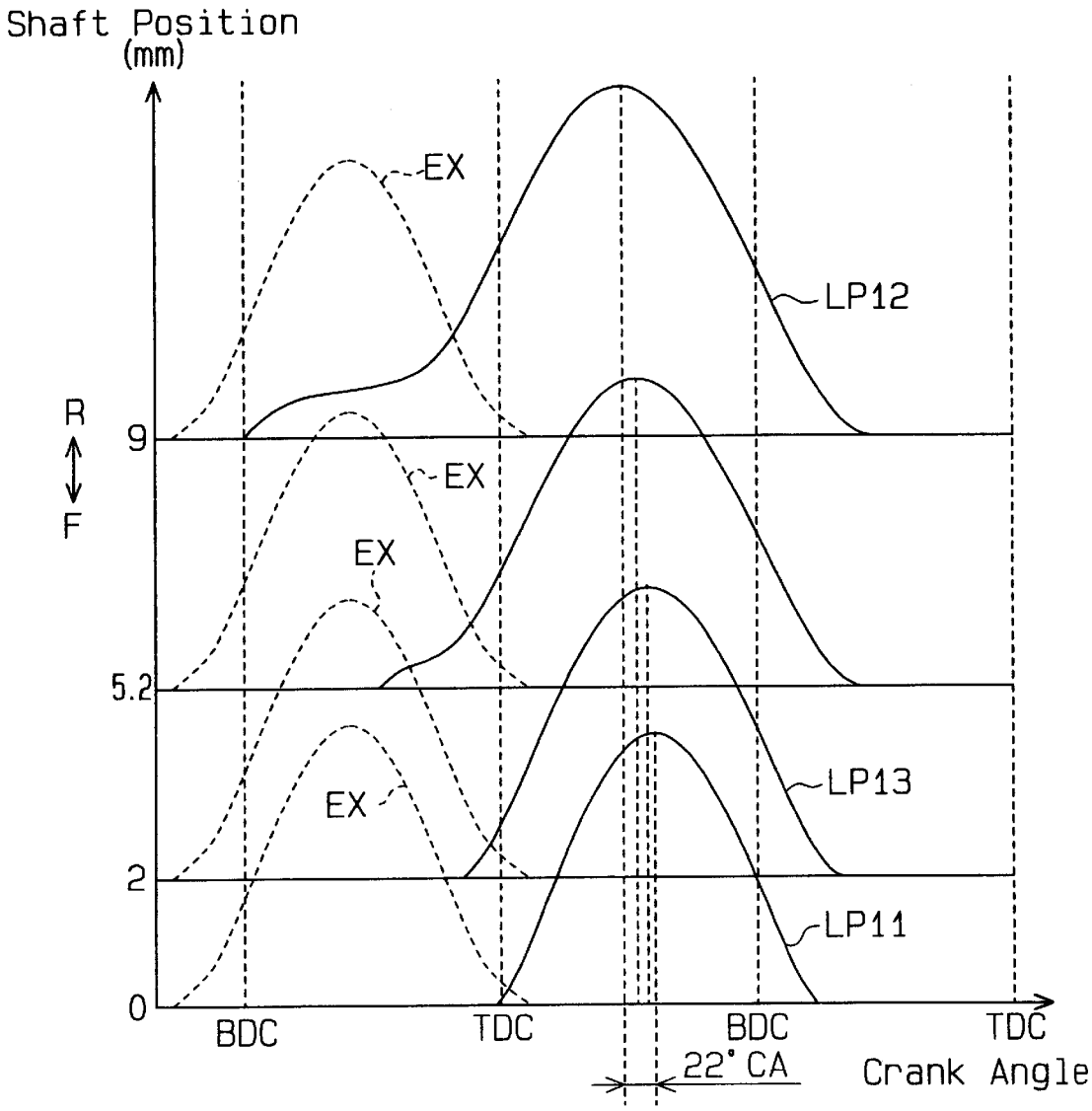
FIG. 31 is a graph showing a state of a change in an intake valve characteristic according to the second embodiment.

FIG. 31 is a graph corresponding to FIG. 29. As shown in FIG. 31, as the intake camshaft 22 moves in the rearward direction R, in other words, as the abutting position of the cam face 27*a* with respect to the cam follower 20*b* approaches the front end face 27*b* of the intake cam 27, the lift amount and the opening period of the intake valve 20 increase and the entire valve lift pattern advances the angle with respect to the crankshaft 15.

The valve-characteristic changing actuator 222*a* moves the intake camshaft 22 by a maximum of 9 mm in the axial direction. In the present embodiment, as shown in FIG. 31, the rotational phase of the intake cam 27 differs by 22° CA between when the cam face 27*a* which is closest to the front end face 27*b* abuts on the cam follower 20*b* (when the axial position is 9 mm) and when the cam face 27*a* which is closest to the rear end face 27*c* abuts on the cam follower 20*b* (when the axial position is 0 mm). In other words, the axial movement of the intake camshaft 22 changes the rotational phase of the intake cam 27 by 22° CA.

Figures 32, 33:
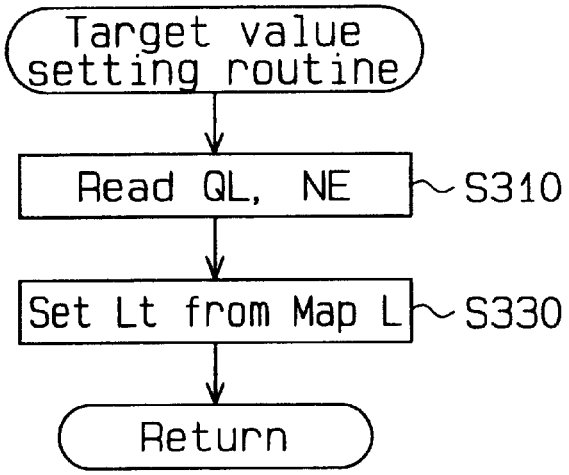
FIG. 32 is a flowchart illustrating a routine for setting target values needed for valve characteristic control.
FIG. 33 is a table showing various control values which are respectively set in association with the engine operational states P11–P13.

FIG. 32 is a flowchart illustrating a routine for setting target values needed for valve characteristic control. This setting routine is equivalent to the setting routine in FIG. 25 from which the process of step S320 is omitted, and the processes of steps S310 and S330 are what have already been explained with reference to FIG. 25. The ECU 130 performs feedback control on the valve-characteristic changing actuator 222*a* based on the signal from the shaft position sensor 183*b* (see FIG. 1) in such a way that the real axial position of the intake camshaft 22 coincides with the target axial position Lt set in the setting routine in FIG. 32.

Specific examples of the valve characteristic control will now be discussed. FIG. 33 corresponds to FIG. 28 and exemplifies three types of engine operational states P11, P12 and P13. Those engine operational states P11–P13 will be discussed below.

Operational state P11: idling state before completion of warm-up (almost the same as the operational state P1 in FIG. 27)

Operational state P12: low-speed and low-load operational state, excluding the idling state, after completion of warm-up (almost the same as the operational state P3 in FIG. 27)

Operational state P13: high-speed and high-load operational state, excluding the idling state, after completion of warm-up (almost the same as the operational state P5 in FIG. 27)

In the operational state P11, like the operational state P1 in FIG. 27, the fuel injection timing is set at the time of the intake stroke. In the operational states P12 and P13, the fuel injection timing is set in accordance with the routine in FIG. 24. Specifically, the fuel injection timing is set at the end of the compression stroke in the operational state P12 and is set at the time of the intake stroke in the operational state P13.

A vertical column (A) in FIG. 33 corresponds to the operational states P11–P13 and shows the target axial position Lt (mm) obtained in accordance with the routine in FIG. 32. When the valve-characteristic changing actuator 222*a* is driven based on the target axial position Lt, the rotational phase angle (advancing angle value) of the intake cam 27 with respect to the crankshaft 15 becomes as shown in the parentheses below the target axial position Lt. The advancing angle value of the intake cam 27 is expressed by a crank angle CA in the angle advancing direction from a reference angle provided that the state where the intake camshaft 22 is positioned at the moving end in the forward direction F is the reference angle of zero.

In accordance with the advancing angle value of the intake cam 27, the opening timing BTDC and closing timing ABDC of the intake valve 20 respectively become as shown in a vertical column (B) and vertical column (C) in FIG. 33. A vertical column (D) in FIG. 33 shows the angle of action of the intake cam 27 with respect to the intake valve 20.

FIG. 31 shows valve characteristic patterns LP11–LP13 which are respectively set in association with the three types of engine operational states P11–P13. A valve characteristic pattern Ex indicated by the broken line is the characteristic pattern of the exhaust valve 21.

In the operational state P11, to stabilize the rotation of the engine 11, the target axial position Lt is set at 0 mm so that the advancing angle value of the intake cam 27 is set at 0° CA, as shown in FIG. 33. As a result, the valve characteristic pattern LP11 shown in FIG. 31 is realized. In the valve characteristic pattern LP11, like the valve characteristic pattern LP1 in FIG. 29, the opening period of the intake valve 20 becomes short and the valve overlapping amount becomes small (or zero). As a result, the rotation of the engine 11 is stabilized.

In the operational state P12, to execute good stratified charge combustion, the target axial position Lt is set at 9 mm so that the advancing angle value of the intake cam 27 is set at 22° CA, as shown in FIG. 33. As a result, the valve characteristic pattern LP12 shown in FIG. 31 is realized. In the valve characteristic pattern LP12, like the valve characteristic pattern LP3 in FIG. 29, the opening period of the intake valve 20 becomes maximum and the opening timing becomes quickened at maximum. That is, as the axial position of the cam face 27*a* which abuts on the cam follower 20*b* comes closest to the front end face 27*b*, a sub lift pattern appears most prominently in the valve characteristic pattern LP12 by the action of the sub lift portion of the cam face 27*a*. As a result, the valve overlapping amount becomes extremely large, so that the amount of the exhaust gas that can be fed into the combustion chamber 17 can be made sufficiently large. This can ensure good and stable combustion in stratified charge combustion.

In the operational state P13, to allow the engine 11 to generate sufficient torque, the target axial position Lt is set at 2 mm so that the advancing angle value of the intake cam 27 is set at 5° CA, as shown in FIG. 33. As a result, the valve characteristic pattern LP13 shown in FIG. 31 is realized. In the valve characteristic pattern LP13, like the valve characteristic pattern LP5 in FIG. 29, the opening period of the intake valve 20 becomes an intermediate level and the closing timing is delayed slightly. As a result, it becomes possible to increase the volumetric efficiency of the engine 11 by using pulsation of the intake air in the operational state P13 so that the engine 11 generates a sufficient output torque.

In the above-described embodiment, the valve-characteristic changing actuator 222*a* changes the rotational phase of the intake cam 27 with respect to the crankshaft 15 in interlocking with the axial movement of the intake cam 27. In accordance with the axial movement of the intake cam 27, therefore, the valve lift pattern itself changes and various valve characteristics can be realized as the valve lift pattern is shifted in the angle advancing direction or the angle delaying direction.

Third Embodiment

A third embodiment of the present invention will now be described in accordance with FIGS. 34 to 48, centering on the differences from the first embodiment in FIGS. 1 to 29. Same symbols are given to components equivalent to those of the embodiment in FIGS. 1 to 29 to omit a detailed description.

Figure 34:
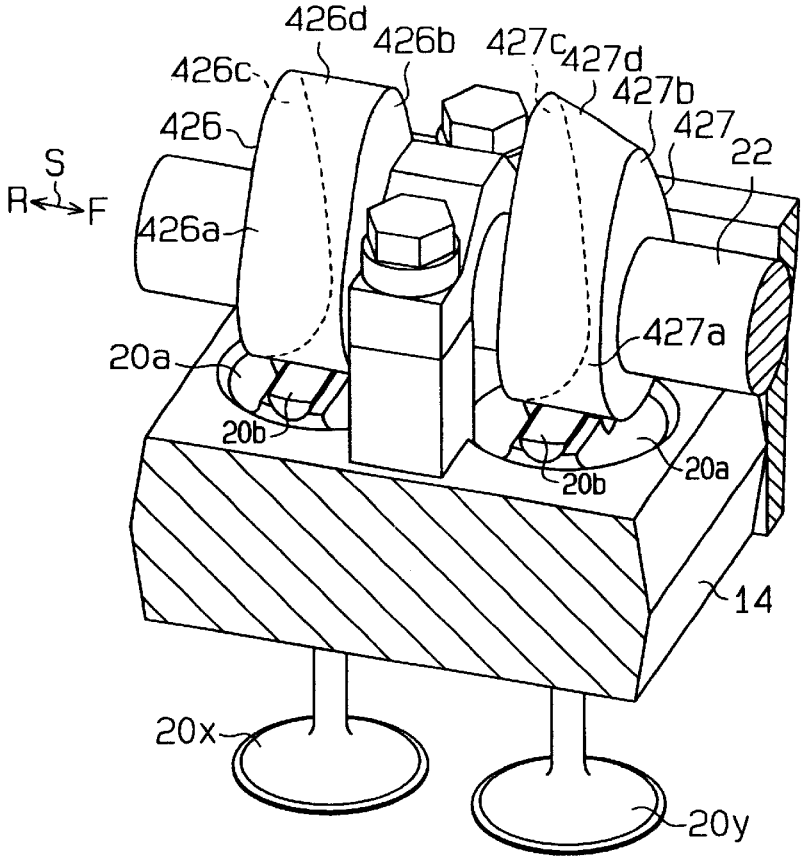
FIG. 34 is a perspective view illustrating a drive system for one cylinder of an engine according to a third embodiment of the present invention.

In the present embodiment, as shown in FIG. 34, a pair of intake cams 426 and 427 corresponding to each cylinder have different shapes. One intake cam 426 is a first intake cam 426 and the other intake cam is a second intake cam 427. An intake valve corresponding to the first intake cam 426 is a first intake valve 20*x* and an intake valve corresponding to the second intake cam 427 is a second intake valve 20*y*.

A cam face 426*a* of the first intake cam 426 has a profile which changes in the axial direction of the intake camshaft 22. Specifically, the cam face 426*a* has a sub lift portion which continuously changes in the axial direction. Note that the height of a cam nose 426*d* does not change in the axial direction. In other words, the main lift portion of the cam face 426*a* does not change between a rear end face 426*c* and a front end face 426*b*.

Figure 35:
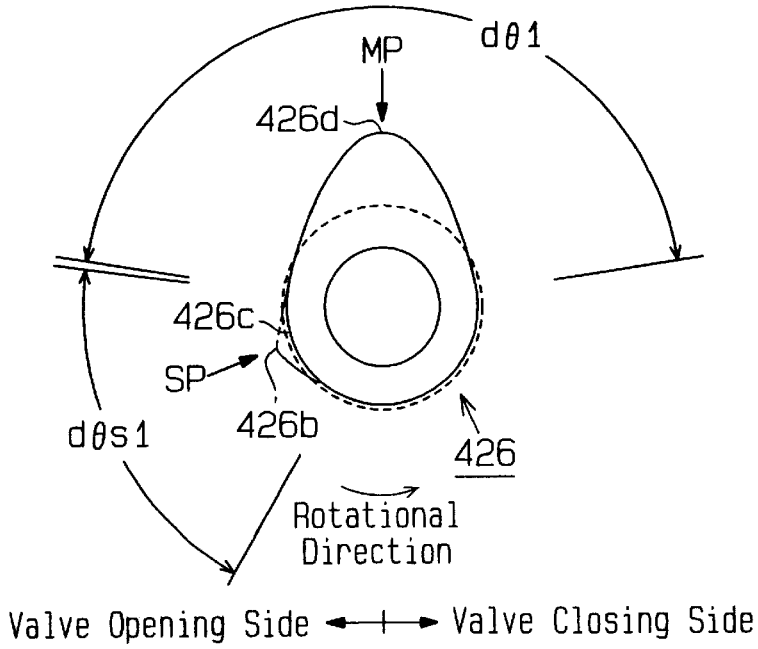
FIG. 35 is a diagram for explaining the profile of a first intake cam in FIG. 34.

As indicated by a one-dot chain line in FIG. 35, the closer to the front end face 426*b* the cam face 426*a* is, the more prominently the sub lift portion appears. As indicated by a solid line in FIG. 35, the cam face 426*a* which is closer to the rear end face 426*c* does not have a sub lift portion. Note that the sub lift portion is provided at that portion (valve opening side) of the cam face 426*a* which moves the first intake valve 20*x* in the opening direction.

Figure 36:
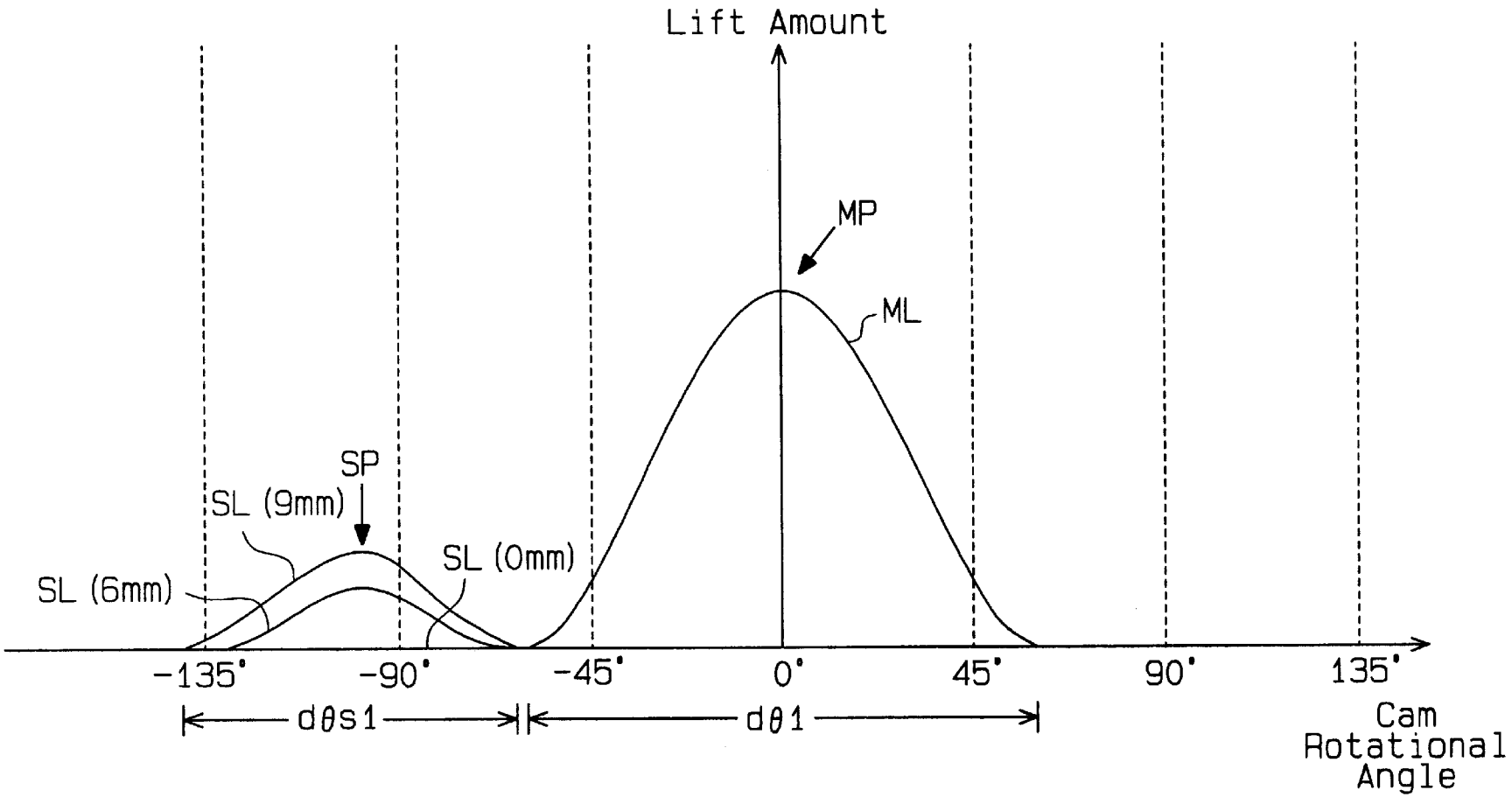
FIG. 36 is a graph showing a lift pattern of the first intake cam in FIG. 35.

FIG. 36 is a graph showing some lift patterns (cam lift patterns) that are realized by the first intake cam 426 in FIG. 35. The horizontal scale shows the rotational angle of the first intake cam 426, and the vertical scale shows the lift amount of the first intake cam 426. FIG. 36 shows cam lift patterns obtained when the intake camshaft 22 is moved by 0 mm, 6 mm and 9 mm in the rearward direction R from the reference position. Those cam lift patterns directly reflect the lift patterns (valve lift patterns) of the first intake valve 20*x*.

Wherever the axial position of the intake camshaft 22 is, in other words, at whichever axial position the cam face 426*a* abuts on the cam follower 20*b*, a same main lift pattern ML having a main peak MP of the same height appears in the cam lift patterns.

However, when the axial position of the intake camshaft 22 is 9 mm, in other words, when the cam face 426*a* which is closest to the front end face 426*b* abuts on the cam follower 20*b*, a notable sub lift pattern SL having a largest sub peak SP appears in the cam lift pattern. When the axial position of the intake camshaft 22 is 0 mm, in other words, when the cam face 426*a* which is closest to the rear end face

426*c* abuts on the cam follower 20*b*, the sub lift pattern SL does not appear in the cam lift pattern. When the axial position of the intake camshaft 22 is 6 mm, in other words, when an approximately middle portion of the cam face 426*a* in the axial direction abuts on the cam follower 20*b*, a sub lift pattern SL having an intermediate sub peak SP appears in the cam lift pattern.

As apparent from the above, the cam lift pattern whose sub lift pattern SL alone continuously varies is acquired by the axial movement of the first intake cam 426. In accordance with the axial movement of the first intake cam 426, the sub peak SP continuously changes with the main peak MP kept constant.

As shown in FIGS. 35 and 36, an angle of action dθ1 of the main lift portion with respect to the first intake valve 20*x* does not vary between the rear end face 426*c* and the front end face 426*b*. However, an angle of action dθs1 of the sub lift portion with respect to the first intake valve 20*x* gradually increases from zero to a maximum value in a direction toward the front end face 426*b* from the rear end face 426*c*. As the intake camshaft 22 moves in the rearward direction R, therefore, the overall angle of action of the first intake cam 426 is increased by the sub lift portion and the opening period of the first intake valve 20*x* becomes longer.

Figure 37:
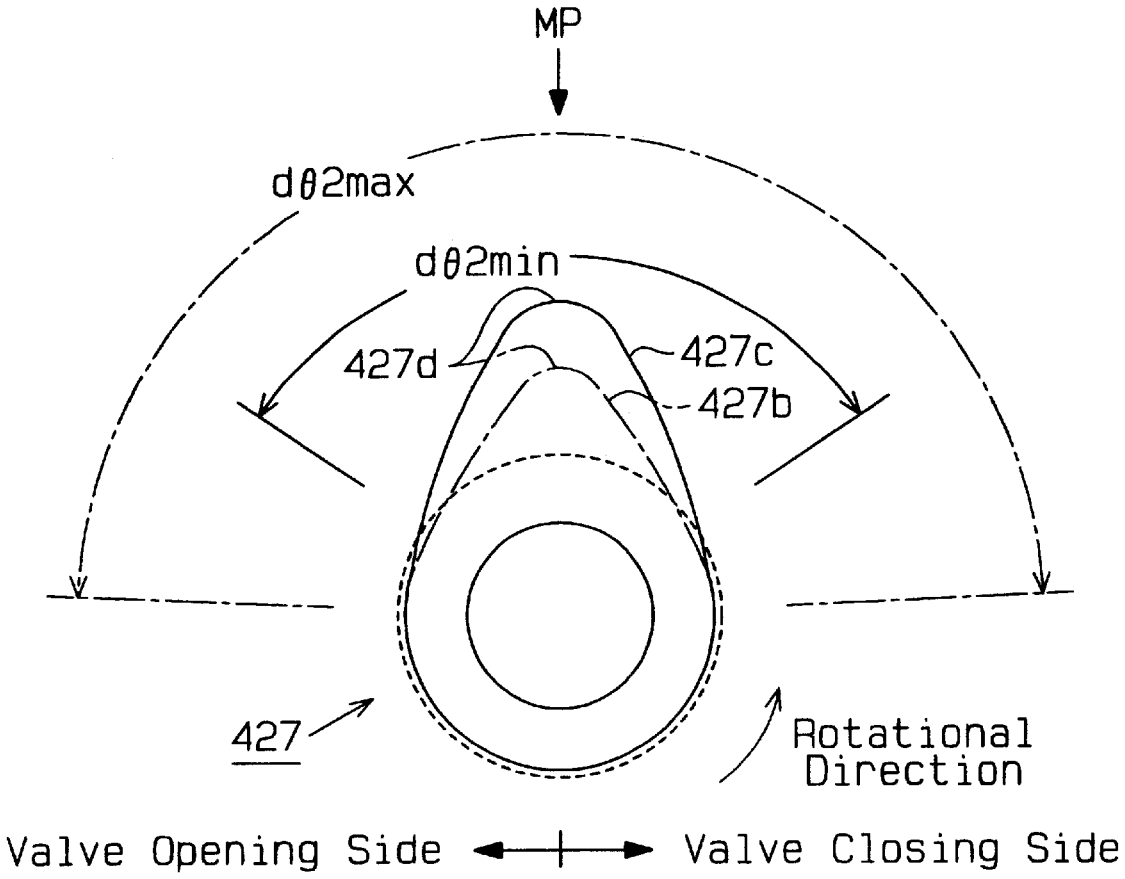
FIG. 37 is a diagram for explaining the profile of a second intake cam in FIG. 34.

As shown in FIGS. 34 and 37, a cam face 427*a* of the second intake cam 427 has a profile which changes in the axial direction of the intake camshaft 22. Specifically, the height of a cam nose 427*d* of the second intake cam 427 continuously changes in the axial direction. In other words, the cam face 427*a* has a main lift portion which continuously changes in the axial direction. The height of the cam nose 427*d* gradually increases in a direction toward a rear end face 427*c* from a front end face 427*b*. It is to be noted however that the second intake cam 427 does not have a sub lift portion.

Figure 38:
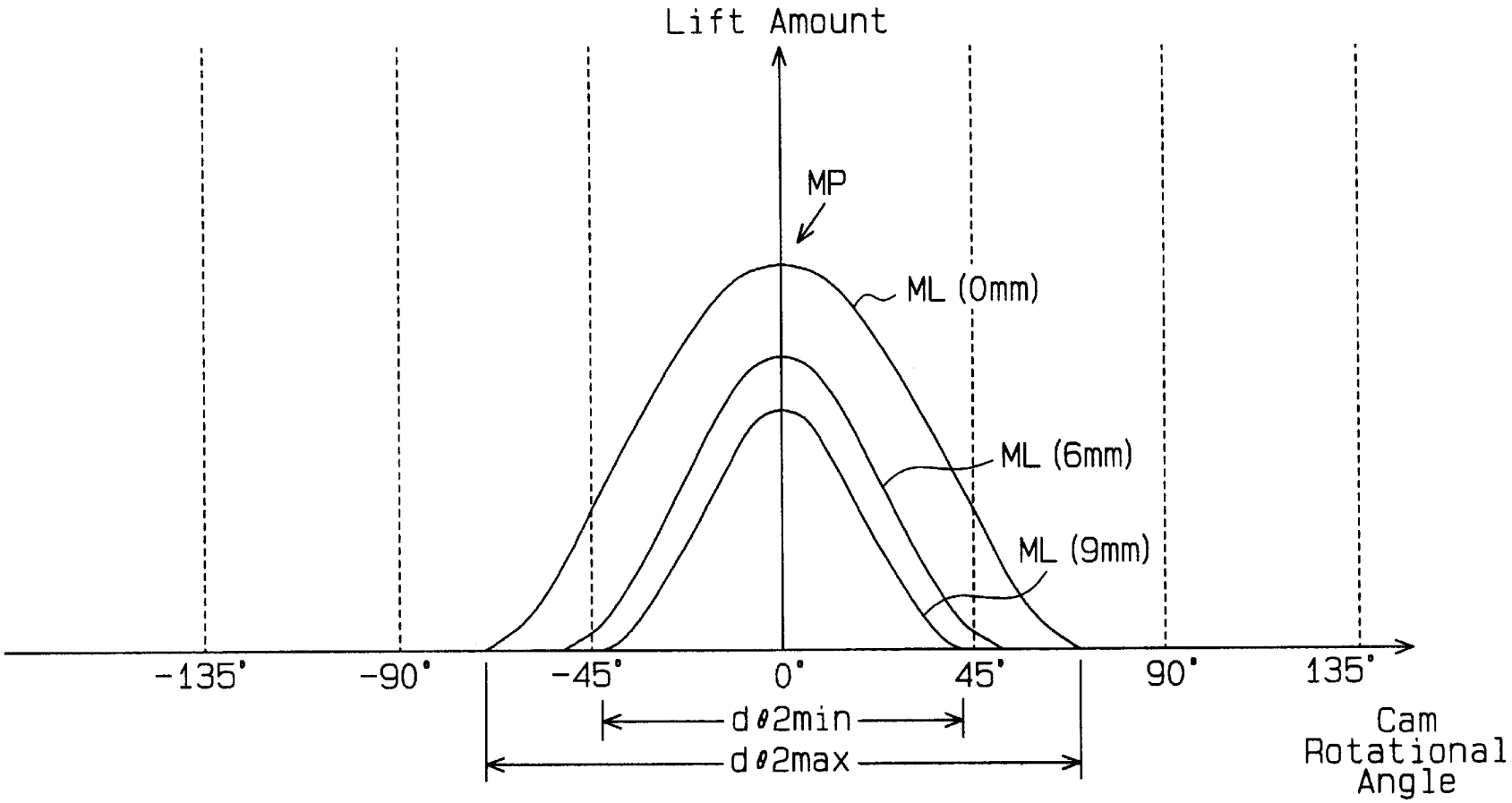
FIG. 38 is a graph showing a lift pattern of the second intake cam in FIG. 37.

FIG. 38 which corresponds to FIG. 36 is a graph showing some lift patterns (cam lift patterns) that are realized by the second intake cam 427 in FIG. 37. The horizontal scale shows the rotational angle of the second intake cam 427, and the vertical scale shows the lift amount of the second intake cam 427. FIG. 38 shows cam lift patterns obtained when the intake camshaft 22 is moved by 0 mm, 6 mm and 9 mm in the rearward direction R from the reference position. Those cam lift patterns directly reflect the lift patterns (valve lift patterns) of the second intake valve 20*y*.

Only a main lift pattern ML which is symmetrical with a peak MP as the boundary appears in any cam lift pattern, but a sub lift pattern does not. As the intake camshaft 22 moves in the rearward direction R from the reference position, in other words, as the abutting position of the cam face 427*a* with respect to the cam follower 20*b* approaches the front end face 427*b*, the height of the peak MP becomes gradually smaller and the angle of action of the second intake cam 427 with respect to the second intake valve 20*y* becomes gradually smaller. The angle of action changes by about the same amount between the valve opening side and the valve closing side of the second intake cam 427. FIGS. 37 and 38 show the angle of action at the cam face 427*a* which is closest to the rear end face 427*c* as a maximum angle of action dθ2 max and the angle of action at the cam face 427*a* which is closest to the front end face 427*b* as a minimum angle of action dθ2 min. The greater the angle of action is, the longer the opening period of the second intake valve 20*y* becomes.

In the present embodiment, the structure of the rotational phase changing actuator 24 in FIG. 7 is slightly modified, and the vane rotor 61 and the inner gear 54 are engaged with each other by a straight spline extending in the axial direction. When the intake camshaft 22 is moved in the axial direction by the axial movement actuator 22*a* in FIG. 6, therefore, the rotational phase of the intake camshaft 22 does not change with respect to the crankshaft 15. The shift of the lift patterns exemplified in FIGS. 36 and 38 in the angle advancing direction or the angle delaying direction is accomplished by the rotation of the vane rotor 61 of the rotational phase changing actuator 24. In the present embodiment, the rotational phase changing actuator 24 changes the rotational phase of the intake camshaft 22 in a range of 40° CA. The rotational phase changing actuator 24 can of course take the same structure as that in FIG. 7.

The target advancing angle value θt and target axial position Lt of the intake camshaft 22 are set in accordance with the routine in FIG. 25 by using the maps i shown in FIG. 26(A) and the maps L shown in FIG. 26(B).

As shown in FIG. 2 and FIGS. 39(A)–39(C), of a pair of intake passages 18*a* and 18*b* corresponding to each cylinder, the intake passage 18*a* that corresponds to the second intake valve 20*y* has the air-flow control valve 18*d* and the intake passage 18*b* that corresponds to the first intake valve 20*x* does not have an air-flow control valve. That is, both intake passages 18*a* and 18*b* have different functions. The difference between the profile of the first intake cam 426 and the profile of the second intake cam 427 is based on the difference between the functions of both intake passages 18*a* and 18*b*.

Figure 40:
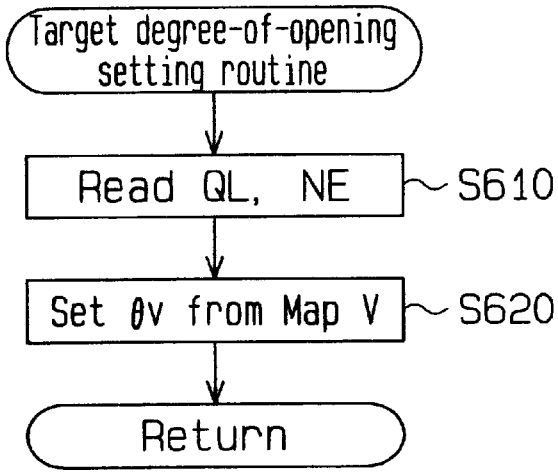
FIG. 40 is a flow chart showing a routine for setting a target degree of opening θv of the air-flow control valve.

FIG. 40 is a flowchart illustrating a routine for setting the target degree of opening θv of the air-flow control valve 18*d*. This setting routine is repeatedly executed in a predetermined control period. The ECU 130 adjusts the degree of opening of the air-flow control valve 18*d* by controlling the actuator 18*f* based on a target degree of opening θv set in the routine.

In step S610, the ECU 130 first reads parameters representing the engine operational state, such as the lean fuel injection amount QL, which reflects the engine load, and the engine speed NE. As a value which reflects the engine load, the pedal depression amount ACCP, for example, may be used in place of the lean fuel injection amount QL.

Figure 41:
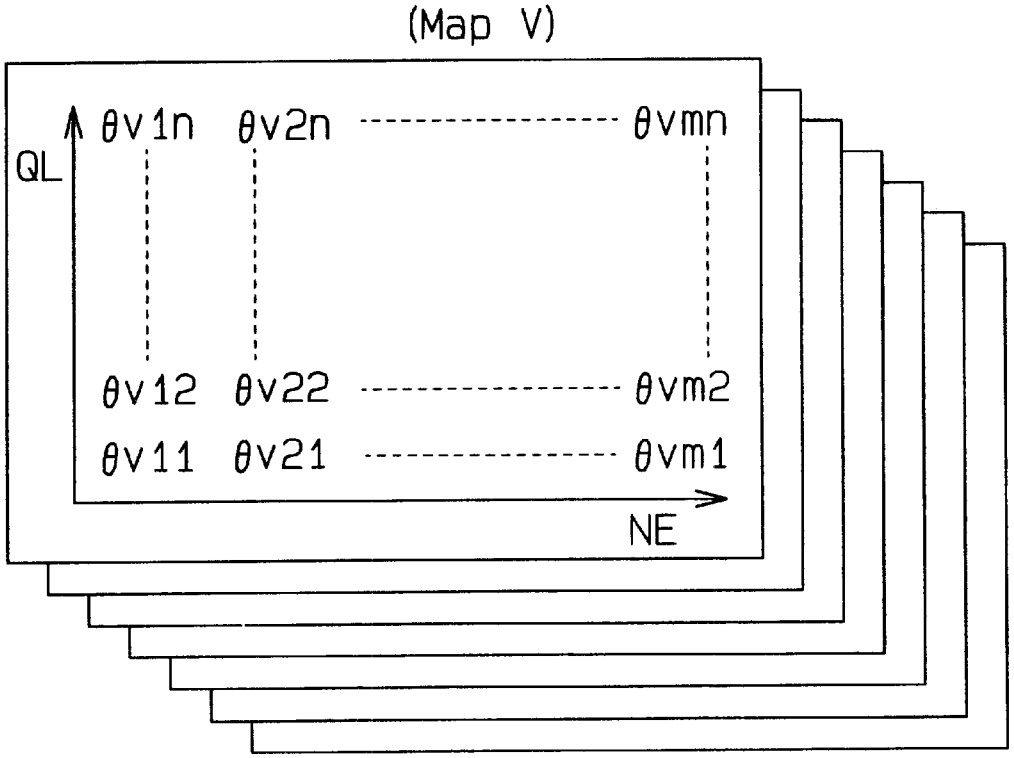
FIG. 41 is a graph showing a map to be used in setting the target degree of opening θv.

Then, the ECU 130 sets the target degree of opening θv of the air-flow control valve 18*d* based on maps V shown in FIG. 41 in step S620. As shown in FIG. 41, the maps V are for setting the target degree of opening θv with the lean fuel injection amount QL and the engine speed NE as parameters. The maps V are prepared for various engine operational states, such as the individual areas R1–R4 (see FIG. 20), the time of starting the engine and an idling state before completion of warm-up of the engine 11 or the like. Therefore, a map V corresponding to the current engine operational state is selected first and the target degree of opening θv is set based on the lean fuel injection amount QL and the engine speed NE in accordance with the selected map V.

Figure 39A:
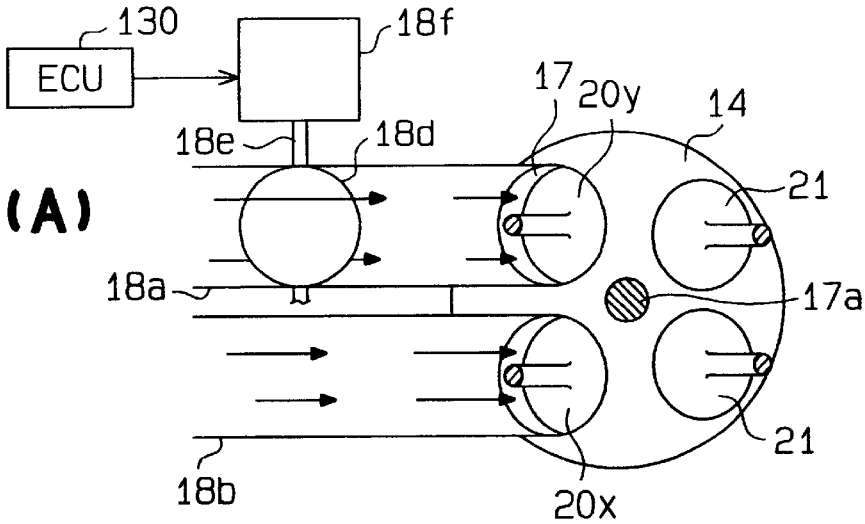
FIG. 39(A) is a schematic structural diagram showing an air-flow control valve fully opened.
Figure 39B:
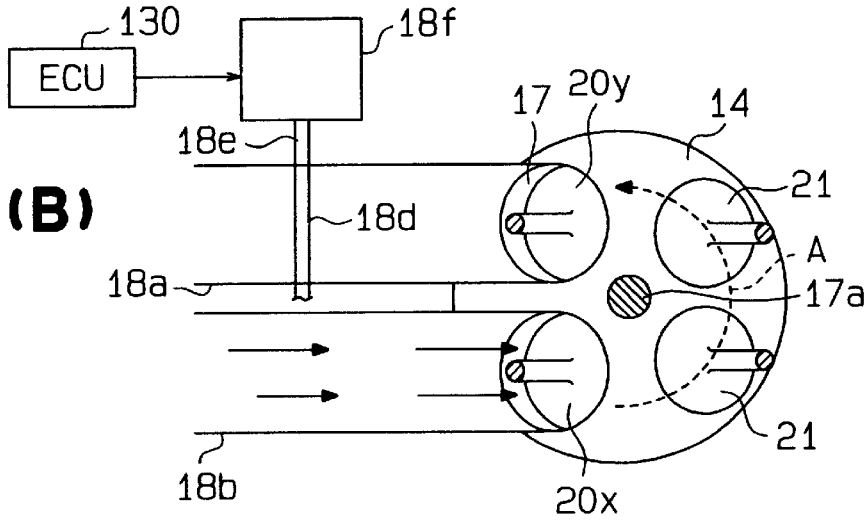
FIG. 39(B) is a schematic structural diagram showing the air-flow control valve fully closed.
Figure 39C:
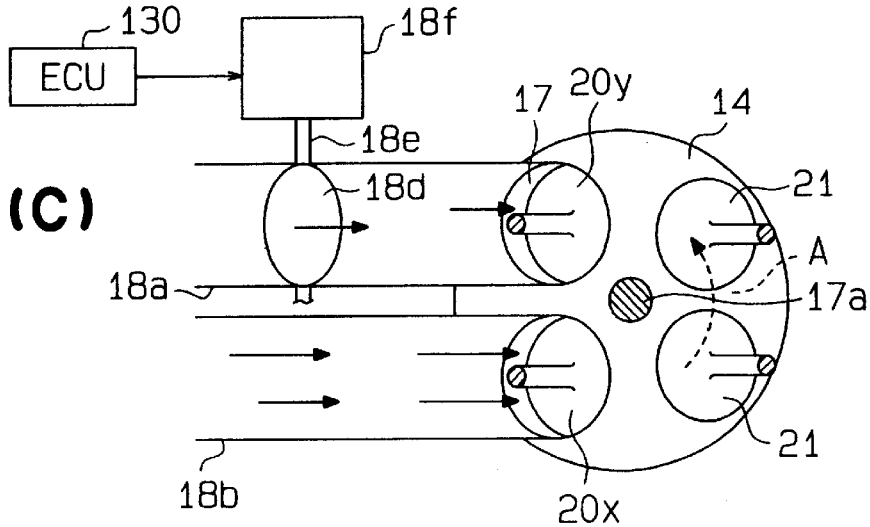
FIG. 39(C) is a schematic structural diagram showing the air-flow control valve half opened.

FIGS. 39(A) to 39(C) respectively exemplify states where the air-flow control valve 18*d* are fully opened, fully closed and half opened based on the set target degree of opening θv. When the air-flow control valve 18*d* is fully opened, as shown in FIG. 39(A), a swirl current A is hardly produced inside the combustion chamber 17. When the air-flow control valve 18*d* is fully closed, as shown in FIG. 39(B), a strong swirl current A is produced inside the combustion chamber 17. When the air-flow control valve 18*d* is half opened, as shown in FIG. 39(C), a swirl current A of an intermediate level is produced.

Specific examples of the valve characteristic control will now be discussed with reference to FIGS. 42 to 48. The specific examples are those with six types of engine operational states P21 to P26 to be described below.

Operational state P21: idling state during warm-up (at the time of homogeneous charge combustion)

Operational state P22: idling state after warm-up (at the time of stratified charge combustion)

Operational state P23: operational state other than the idling state after warm-up (at the time of stratified charge combustion)

Operational state P24: operational state other than the idling state after warm-up (at the time of lean homogeneous charge combustion)

Operational state P25: operational state other than the idling state after warm-up (at the time of homogeneous charge combustion with the stoichiometric air-fuel ratio and engine speed NE of 4000 rpm or greater)

Operational state P26: operational state other than the idling state after warm-up (when the throttle valve 146 is fully open and at the time of homogeneous charge combustion)

A vertical column (A) in FIG. 48 indicates the target axial positions Lt of the intake camshaft 22 set in association with the operational states P21–P26. A vertical column (B) in FIG. 48 indicates the target advancing angle values θt of the intake camshaft 22 set in association with the operational states P21–P26. A vertical column (C) in FIG. 48 indicates the target degrees of opening θv of the air-flow control valve 18*d* set in association with the operational states P21–P26.

FIGS. 42 to 47 show valve characteristic patterns Lx and Ly of both intake valves 20*x* and 20*y* that are set in association with the six types of operational states P21–P26. The valve characteristic pattern Ex of the exhaust valve 21 is indicated by a broken line.

Figure 42:
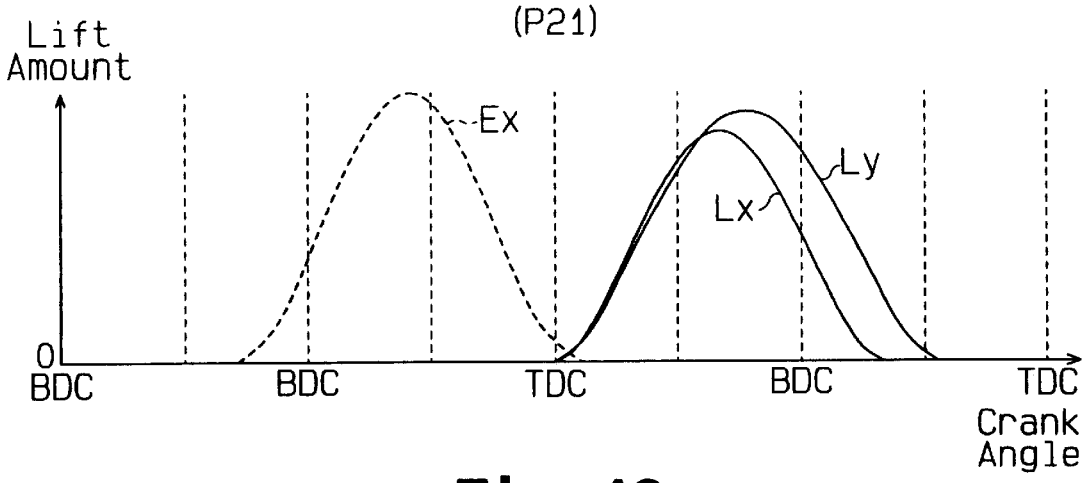
FIG. 42 is a graph showing valve characteristic patterns Lx, Ly which are set in association with an engine operational state P21.

In the operational state P21, the engine 11 is not fully warmed up, so that it is necessary to stabilize the combustion state and reduce hydrocarbon in the exhaust gas. As shown in FIG. 48, therefore, the target axial position Lt is set at 0 mm, the target advancing angle value θt is set at 0° CA, and the air-flow control valve 18*d* is closed fully. As a result, the valve characteristic patterns Lx and Ly shown in FIG. 42 are realized and a strong swirl current A is produced in the combustion chamber 17. In the valve characteristic pattern Lx in FIG. 42, the opening period of the first intake valve 20*x* is short and the valve overlapping amount hardly remains. Therefore, the amount of the exhaust gas present in the combustion chamber 17 is reduced and what is more, the strong swirl current A accelerates the blending of air and fuel. As a result, the combustion state is stabilized and hydrocarbon in the exhaust gas is reduced.

Figure 43:
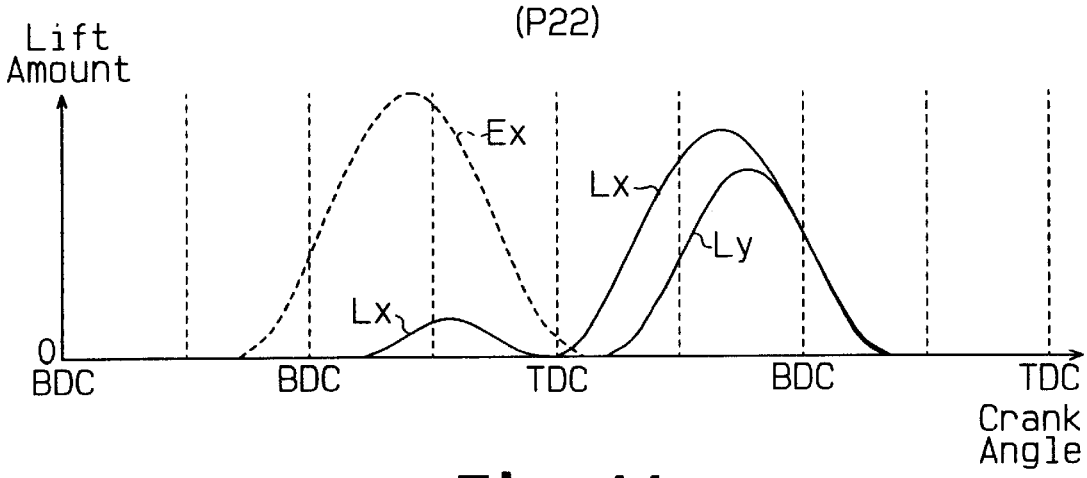
FIG. 43 is a graph showing the valve characteristic patterns Lx, Ly which are set in association with an engine operational state P22.

In the operational state P22, to execute good stratified charge combustion, the target axial position Lt is set at 3 to 6 mm, the target advancing angle value θt is set to 0 at 20° CA, and the air-flow control valve 18*d* is opened fully, as shown in FIG. 48. As a result, the valve characteristic patterns Lx and Ly shown in FIG. 43 are realized and a swirl current is not produced in the combustion chamber 17. In the valve characteristic pattern Lx in FIG. 43, the opening period of the first intake valve 20*x* becomes an intermediate level. That is, a sub lift pattern appears in the valve characteristic pattern Lx due to the action of the sub lift portion of the first intake cam 426, quickening the opening timing of the first intake valve 20*x*. As a result, the valve overlapping amount becomes large and the amount of the exhaust gas that can be taken into the combustion chamber 17 becomes sufficiently large. This can ensure good and stable stratified charge combustion. Because a swirl current is not produced-in the combustion chamber 17, the mixture is well stratified so that stratified charge combustion is executed more stably. Moreover, as the air-flow control valve 18*d* is fully opened, the flow resistance of the intake air becomes smaller, thus reducing the pumping loss and improving the fuel consumption.

In the valve characteristic pattern Lx in FIG. 43, the lift amount of the first intake valve 20*x* becomes zero between the main lift pattern and the sub lift pattern. The timing at which the lift amount of the first intake valve 20*x* becomes zero is close to the timing at which the piston 12 is positioned at the top dead center in the intake stroke. Therefore, the first intake valve 20*x* is surely prevented from interfering with the piston 12.

Further, the closing timings of the first intake valve 20*x* and the second intake valve 20*y* are adequately adjusted to make the stratified charge combustion more stable.

Figure 44:
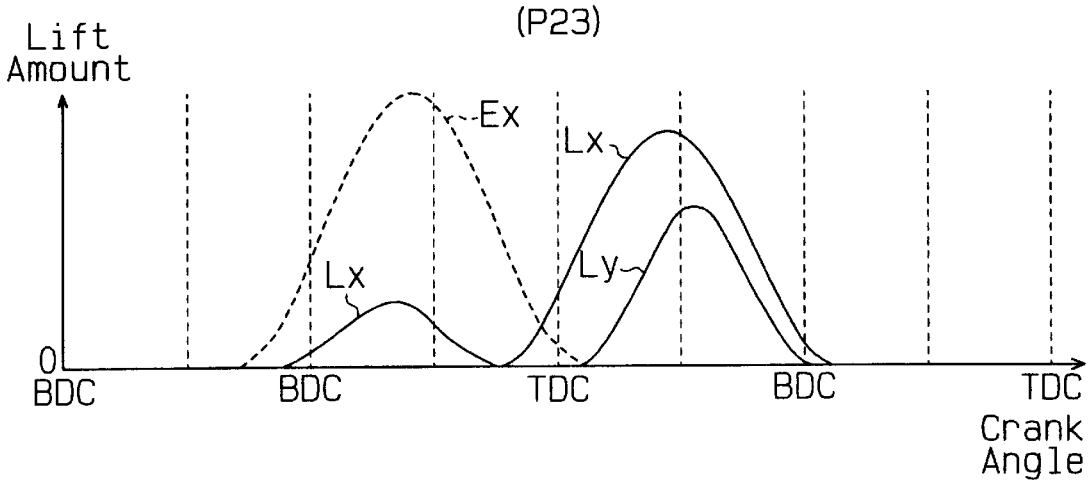
FIG. 44 is a graph showing the valve characteristic patterns Lx, Ly which are set in association with an engine operational state P23.

In the operational state P23, to execute good stratified charge combustion, the target axial position Lt is set at 7 to 9 mm, the target advancing angle value θt is set at 20 to 40° CA, and the air-flow control valve 18*d* is opened fully, as shown in FIG. 48. As a result, the valve characteristic patterns Lx and Ly shown in FIG. 44 are realized and a swirl current is not produced in the combustion chamber 17. In the valve characteristic pattern Lx in FIG. 44, the opening period of the first intake valve 20*x* becomes significantly large. That is, a prominent sub lift pattern appears in the valve characteristic pattern Lx due to the action of the sub lift portion of the first intake cam 426, so that the opening timing of the first intake valve 20*x* becomes very fast. As a result, the valve overlapping amount becomes larger than in the operational state P22 and the amount of the exhaust gas that can be taken into the combustion chamber 17 becomes sufficiently large. This can ensure good and stable stratified charge combustion and achieve an improvement on the fuel consumption and a reduction in hydrocarbon.

The advantages that are provided by the first intake valve 20*x* not interfering with the piston 12 and no swirl current produced in the combustion chamber 17 are the same as those in the operational state P22.

Figure 45:
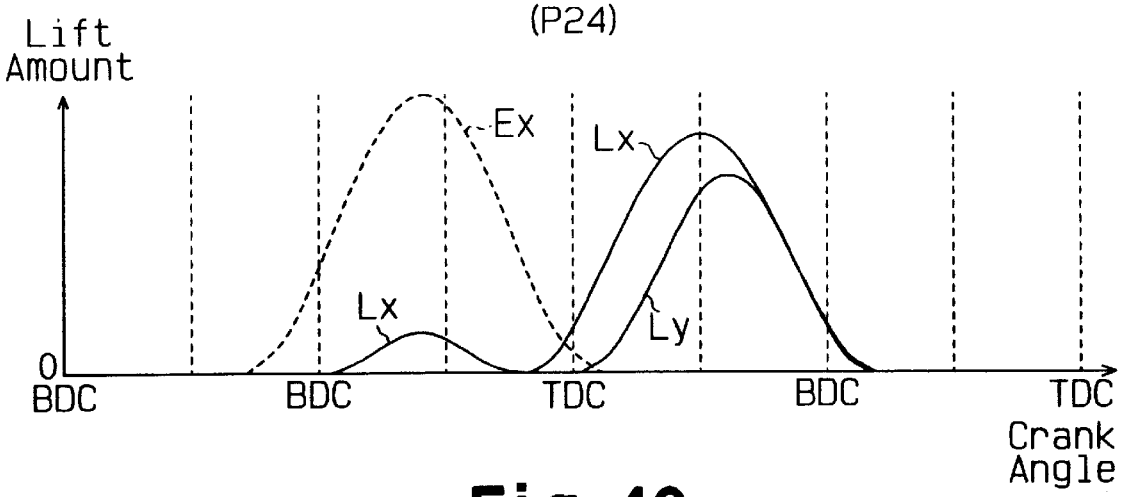
FIG. 45 is a graph showing the valve characteristic patterns Lx, Ly which are set in association with an engine operational state P24.

In the operational state P24, to improve the fuel consumption, the target axial position Lt is set at 3 to 6 mm, the target advancing angle value θt is set at 30° CA, and the air-flow control valve 18*d* is set half opened to fully closed, as shown in FIG. 48. As a result, the valve characteristic patterns Lx and Ly shown in FIG. 45 are realized and an intermediate to strong swirl current A is produced in the combustion chamber 17. In the valve characteristic pattern Lx in FIG. 45, the opening period of the first intake valve 20*x* becomes an intermediate level. As a result, the valve overlapping amount becomes large and the amount of the exhaust gas that can be taken into the combustion chamber 17 becomes sufficiently large. This can ensure stable lean homogeneous charge combustion with low fuel-consumption. Further, the swirl current A produced in the combustion chamber 17 contributes to achieving good lean homogeneous charge combustion. The first intake valve 20*x* does not interfere with the piston 12 as in the cases of the operational states P22 and P23.

The closing timings of both intake valves 20*x* and 20*y* in the valve characteristic patterns Lx and Ly in FIG. 45 can allow a part of air temporarily sucked into the combustion chamber 17 to return to the intake port 18 via at least the first intake valve 20*x* opened. This can allow the degree of opening of the throttle valve 146 to be increased at the time of the homogeneous charge combustion, thus contributing to reduction of the pumping loss and improvement of the fuel consumption.

Because the air-flow control valve 18*d* is fully closed and the opening period of the first intake valve 20*x* is relatively long or the air-flow control valve 18*d* is half opened and the opening period of the first intake valve 20*x* is greater than the opening period of the second intake valve 20*y*, a sufficient swirl current A is produced in the combustion chamber 17, thus stabilizing combustion.

Figure 46:
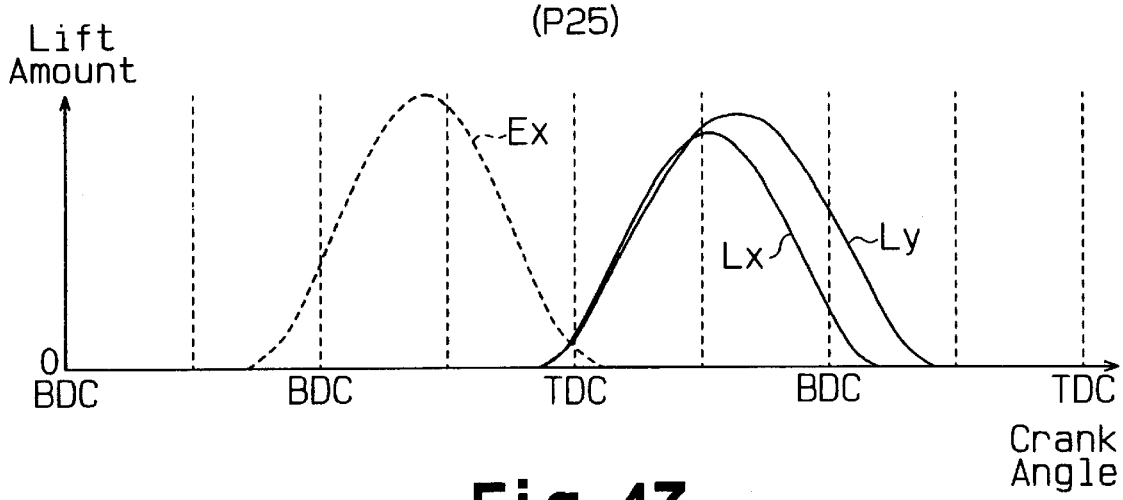
FIG. 46 is a graph showing the valve characteristic patterns Lx, Ly which are set in association with an engine operational state P25.

In the operational state P25, to stabilize homogeneous charge combustion and reduce the flow resistance of the intake air, the target axial position Lt is set at 0 mm, the target advancing angle value θt is set at 10 to 25° CA, and the air-flow control valve 18*d* is half opened, as shown in FIG. 48. As a result, the valve characteristic patterns Lx and Ly shown in FIG. 46 are realized and a swirl current A of an intermediate level is produced in the combustion chamber 17. In the valve characteristic pattern Lx in FIG. 46, the opening period of the first intake valve 20*x* is minimized. Further, as the angles of the valve characteristic patterns Lx and Ly are advanced by 10 to 25° CA, a volumetric efficiency which matches with the operational state P25 is acquired.

The swirl current A stabilizes homogeneous charge combustion. Because the air-flow control valve 18*d* is half opened, the flow resistance of the intake air becomes lower as compared with the case where the air-flow control valve 18*d* is fully closed. Therefore, the pumping loss is reduced and the fuel consumption is improved.

The closing timing of the second intake valve 20*y* is later than the closing timing of the first intake valve 20*x*. Therefore, the swirl current A is disturbed by the air that is supplied into the combustion chamber 17 from the second intake valve 20*y* at the end of the intake stroke. This stabilizes homogeneous charge combustion more.

Figure 47:
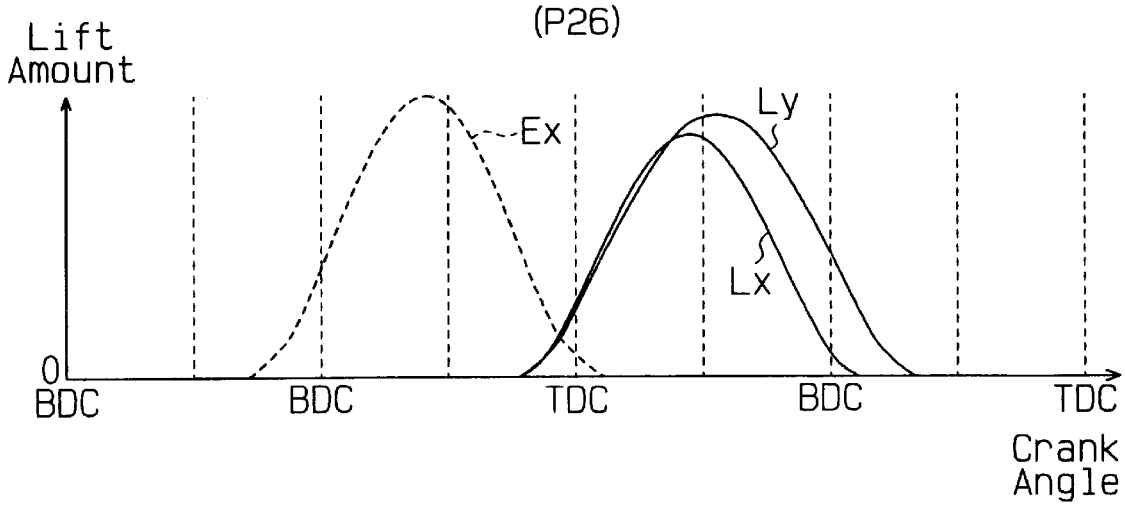
FIG. 47 is a graph showing the valve characteristic patterns Lx, Ly which are set in association with an engine operational state P26.

In the operational state P26, to stabilize homogeneous charge combustion and increase the volumetric efficiency, the target axial position Lt is set at 0 mm, the target advancing angle value θt is set at 10 to 40° CA, and the air-flow control valve 18*d* is fully opened, as shown in FIG. 48. As a result, the valve characteristic patterns Lx and Ly shown in FIG. 47 are realized and a swirl current is not produced in the combustion chamber 17. In the valve characteristic pattern Lx in FIG. 47, the opening period of the first intake valve 20*x* is minimized.

Because the air-flow control valve 18*d* is fully opened, a lot of air is supplied into the combustion chamber 17 via both intake valves 20*x* and 20*y* and the flow resistance of the intake air becomes lower. Therefore, the pumping loss is reduced and the fuel consumption is improved. Further, as the angles of the valve characteristic patterns Lx and Ly are advanced by 10 to 40° CA, a volumetric efficiency which matches with the operational state P26 is acquired.

The closing timing of the second intake valve 20*y* is later than the closing timing of the first intake valve 20*x*. Therefore, a swirl current or turbulent flow is produced in the combustion chamber 17 by the air that is supplied into the combustion chamber 17 from the second intake valve 20*y* at the end of the intake stroke. It is thus possible to stabilize homogeneous charge combustion without closing the air-flow control valve 18*d*.

In the above-described embodiment, the lift patterns of both intake cams 426 and 427 differ in accordance with the difference between the functions of both intake passages 18*a* and 18*b*. Therefore, the valve characteristic of the second intake valve 20*y* corresponding to the intake passage 18*a* provided with the air-flow control valve 18*d* differs from the valve characteristic of the first intake valve 20*x* corresponding to the intake passage 18*b* which is not provided with an air-flow control valve. The combustion control of the engine 11 can therefore be carried out delicately by the opening/closing state of the air-flow control valve 18*d* and the combination of different valve characteristics of both intake valves 20*x* and 20*y*. It is thus possible to sufficiently match with various engine performances that are demanded in accordance with the operational states of the engine 11.

The first intake cam 426 which drives the first intake valve 20*x* that is not associated with the air-flow control valve 18*d* is a composite lift tree-dimensional cam which has a main lift portion and a sub lift portion. The second intake cam 427 which drives the second intake valve 20*y* associated with the air-flow control valve 18*d* is a simple lift tree-dimensional cam which has only a main lift portion. Complicated intake valve characteristics can be realized by the combination of those two cams 426 and 427.

The first intake cam 426 has a sub lift portion at the cam face 426*a* near the front end face 426*b*. The sub lift portion decreases on the cam face 426*a* as it approaches the rear end face 426*c*. In accordance with the axial movement of the first intake cam 426, the valve lift pattern continuously varies between a state where the valve lift pattern has only a main lift pattern and a state where it has a main lift pattern and a sub lift pattern. It is therefore possible to realize complex intake valve characteristics.

The rotational phase changing actuator 24 is provided which continuously changes the rotational phases of both intake cams 426 and 427 with respect to the crankshaft 15. Accordingly, each of various valve lift patterns that are realized by the axial movement of both intake cams 426 and 427 can be shifted in the angle advancing direction or the angle delaying direction, so that a greater variety of valve characteristics can be realized.

In the cam lift pattern of the first intake cam 426, the cam lift amount becomes nearly zero between the main lift pattern ML and the sub lift pattern SL (see FIG. 36). This is advantageous in sufficiently securing the valve overlapping amount while avoiding the interference of the first intake valve 20*x* with the piston 12.

The sub lift pattern SL need not have a sub peak SP as shown in FIG. 36, and may be a plateau-like gentle pattern as shown in FIG. 15. On the other hand, the sub lift pattern in FIG. 15 may have a sub peak SP as shown in FIG. 36.

Fourth Embodiment

A fourth embodiment of the present invention will now be described in accordance with FIGS. 49 to 53, centering on the differences from the second embodiment in FIGS. 30 to 33. Same symbols are given to components equivalent to those of the embodiment in FIGS. 30 to 33 to omit a detailed description.

In the present embodiment, like the embodiment in FIGS. 30 to 33, the valve-characteristic changing actuator 222*a* shown in FIG. 30 is provided only at one end of the intake camshaft 22. The difference from the embodiment in FIGS. 30 to 33 lies only in the shape of the intake cam 27.

Figure 49:
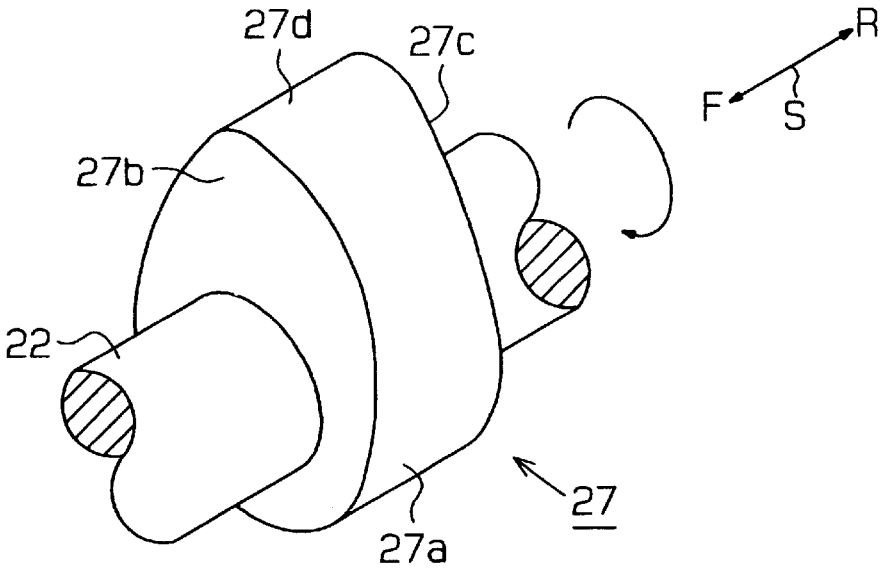
FIG. 49 is a perspective view of an intake cam according to a fourth embodiment of the present invention.
Figure 50A:
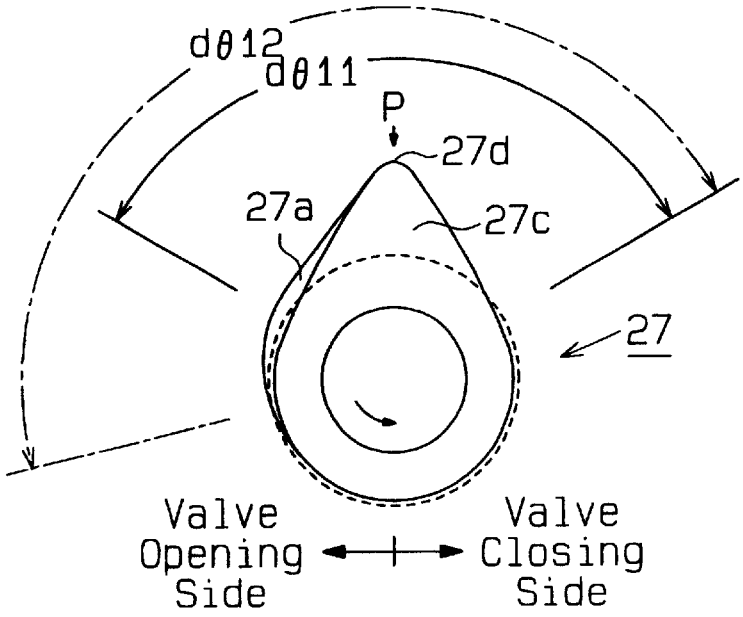
FIG. 50(A) is a rear view of the intake cam in FIG. 49.
Figure 50B:
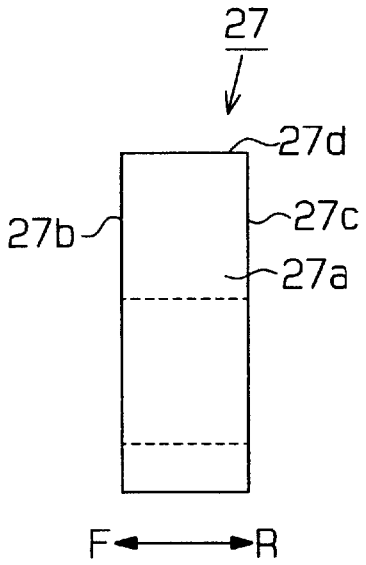
FIG. 50(B) is a side view of the intake cam in FIG. 49.
Figure 52:
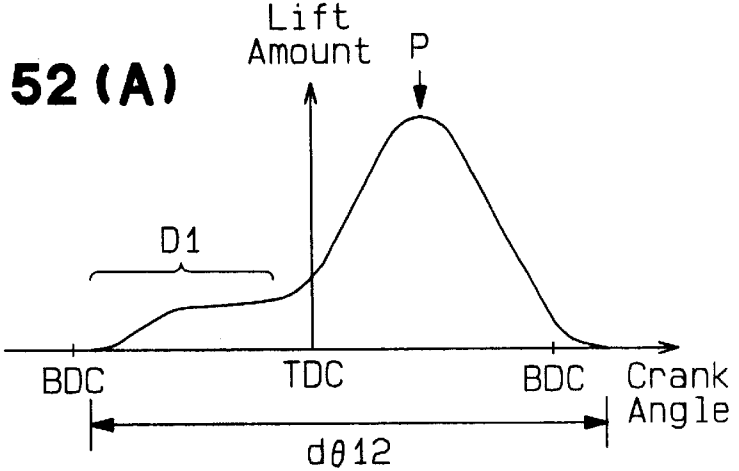
FIG. 52(A) and FIG. 52(B) are graphs showing lift patterns of an intake valve which are realized by the intake cam in FIG. 49.
Figure 52:
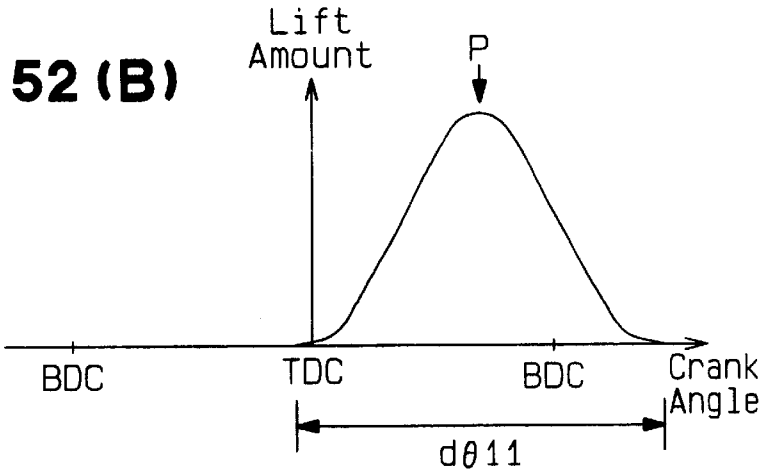
Figure 51:
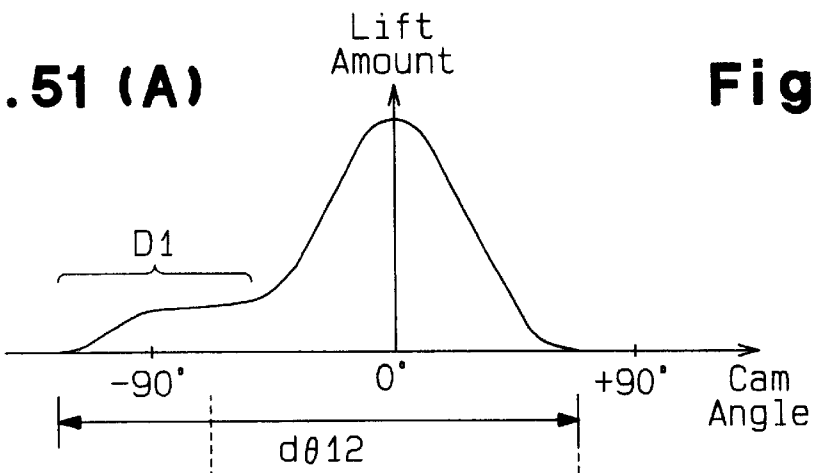
FIG. 51(A) and FIG. 51(B) are graphs showing lift patterns of the intake cam in FIG. 49.
Figure 51:
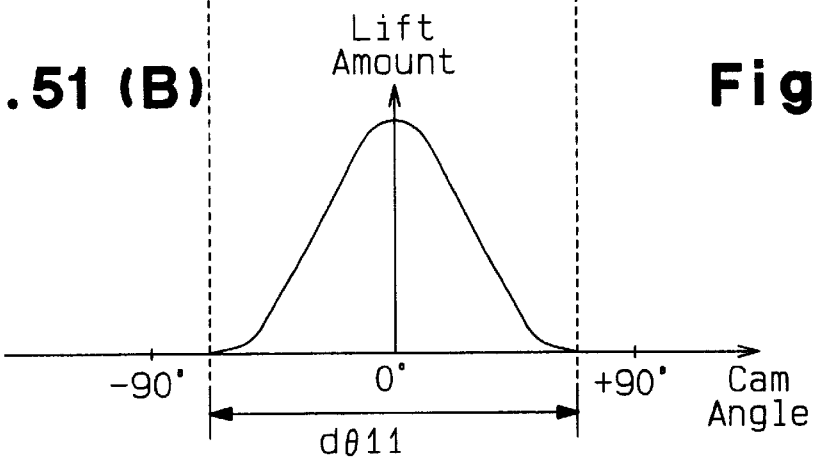

FIG. 49 and FIGS. 50(A) and 50(B) show the intake cam 27 of the present embodiment. The cam face 27*a* of the intake cam 27 has, on its valve opening side, a sub lift portion which continuously changes in the axial direction.

Note however that the height of the cam nose 27*d* does not vary in the axial direction. In other words, the main lift portion of the cam face 27*a* does not change between the rear end face 27*c* and the front end face 27*b*.

The closer to the front end face 27*b* the cam face 27*a* is, the more prominently the sub lift portion appears. FIG. 51(A) shows the cam lift pattern of the cam face 27*a* which is closest to the front end face 27*b*. A sub lift pattern D1 corresponding to the sub lift portion remarkably appears in this cam lift pattern. The sub lift portion and its corresponding sub lift pattern D1 have relatively gentle plateau shapes. FIGS. 50(A) and 51(A) show the angle of action at the cam face 27*a* which is closest to the front end face 27*b* as a maximum angle of action dθ12.

The cam face 27*a* close to the rear end face 27*c* does not have a sub lift portion. FIG. 51(B) shows the cam lift pattern of the cam face 27*a* which is closest to the rear end face 27*c*. A sub lift pattern does not exist in this cam lift pattern, and only a main lift pattern corresponding to the main lift portion appears. The main lift portion and its corresponding main lift pattern become almost symmetrical on the valve opening side and the valve closing side of the cam face 27*a*. FIGS. 50(A) and 51(B) show the angle of action at the cam face 27*a* which is closest to the rear end face 27*c* as a minimum angle of action dθ11.

FIG. 52(A) and FIG. 52(B) are graphs showing the valve characteristics of the intake valve 20 which are realized by the intake cam 27. The horizontal scale shows the crank angle CA and the vertical scale shows the lift amount of the intake valve 20. FIG. 52(A) shows a valve lift pattern when the cam face 27*a* which is closest to the front end face 27*b* abuts on the cam follower 20*b*, and FIG. 52(B) shows a valve lift pattern when the cam face 27*a* which is closest to the rear end face 27*c* abuts on the cam follower 20*b*. In the present embodiment, as the intake camshaft 22 moves in the rearward direction R, in other words, as the abutting position of the cam face 27*a* with respect to the cam follower 20*b* approaches the front end face 27*b* of the intake cam 27, the intake cam 27 advances its angle with respect to the crankshaft 15. Therefore, the valve lift pattern shown in FIG. 52(A) is shifted further in the angle advancing direction than the valve lift pattern shown in FIG. 52(B).

Figure 53A:
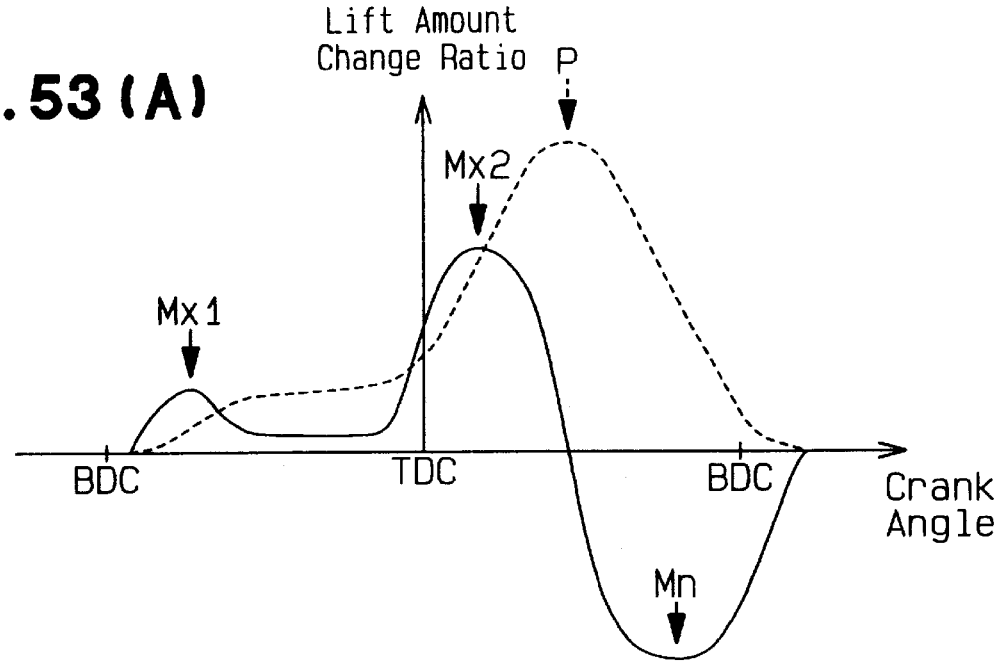
FIG. 53(A) and FIG. 53(B) are graphs showing change ratio patterns of a valve lift amount respectively in association with the valve lift patterns in FIG. 52(A) and FIG. 52(B).
Figure 53B:
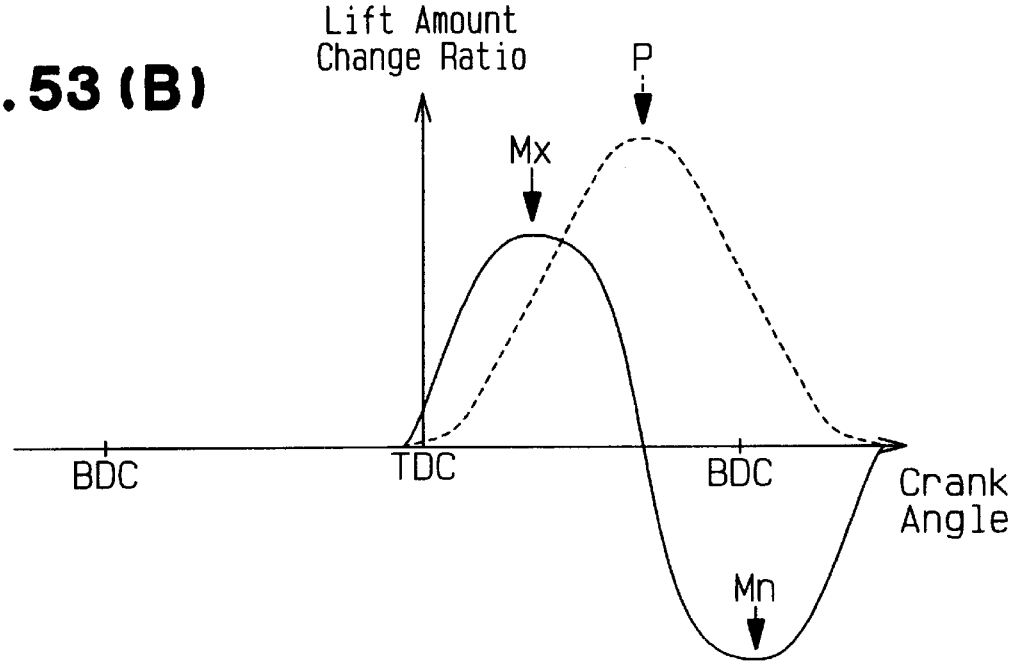

FIG. 53(A) and FIG. 53(B) are graphs showing change ratio patterns of a valve lift amount corresponding to the crank angle CA. The change ratio pattern in FIG. 53(A) corresponds to the valve lift pattern in FIG. 52(A) and the change ratio pattern in FIG. 53(B) corresponds to the valve lift pattern in FIG. 52(B). The corresponding valve lift patterns are indicated by broken lines.

The change ratio pattern shown in FIG. 53(A) has two maximum portions Mx1 and Mx2 on the valve opening side (angle advancing side) to the peak P of the valve lift pattern and a single minimum portion Mn on the valve closing side (angle delaying side) to the peak P of the valve lift pattern. The change ratio pattern shown in FIG. 53(B) has a single maximum portion Mx on the valve opening side to the peak P of the valve lift pattern and a single minimum portion Mn on the valve closing side to the peak P of the valve lift pattern.

In the valve lift pattern shown in FIG. 52(A), there is no minimum portion (valley portion) in the plateau-shaped sub lift pattern D1. In other words, with regard to the portion of the sub lift pattern D1, there is no minimum portion in the change pattern of the lift amount with respect to the rotational angle of the intake cam 27.

The cam face 27*a* continuously changes in the axial direction between the front end face 27*b* and the rear end face 27*c*. This can allow the valve-characteristic changing actuator 222*a* to steplessly adjust the valve lift pattern between the pattern in FIG. 52(A) and the pattern in FIG. 52(B).

According to the present embodiment, as described above, the cam face 27*a* which is closest to the front end face 27*b* is formed in such a way that the change ratio pattern of the valve lift amount with respect to the rotational angle of the intake cam 27 has two maximum portions Mx1 and Mx2 on the valve opening side and the change ratio pattern of the valve lift amount with respect to the rotational angle of the intake cam 27 does not have a minimum portion on the valve opening side.

In other words, according to the present embodiment, the cam face 27*a* which is closest to the front end face 27*b* has a sub lift portion on the valve opening side. The sub lift portion and the sub lift pattern D1 of the intake valve 20 which is realized by the sub lift portion have relatively gentle plateau shapes and do not have hill portions or valley portions. What is more, the sub lift portion and the main lift portion are gently linked together and there is no valley portion between both lift portions.

Therefore, the sub lift portion advances the opening timing of the intake valve 20 with the lift amount of the intake valve 20 kept almost constant. Moreover, the valve lift amount does not fall abruptly between the sub lift portion and the main lift portion.

When the cam face 27*a* which is closest to the front end face 27*b* abuts on the cam follower 20*b*, the amount of the exhaust gas to be taken into the combustion chamber can be made sufficiently large by increasing the valve overlapping amount, as explained in the individual embodiments in FIGS. 1 to 48. At this time, the plateau-like or highland-like sub lift portion increases the amount of the exhaust gas to be taken without requiring the provision of a high hill portion locally in the sub lift portion.

At the time of the stratified charge combustion or weak stratified charge combustion, the degree of opening of the throttle valve 146 (see FIG. 17) can be made relatively large, so that the intake pressure in the intake port 18 becomes relatively high. It therefore becomes difficult for the exhaust gas in the combustion chamber 17 to enter the intake port 18 at the time of the exhaust stroke of the piston 12. According to the present embodiment, however, the highland-like sub lift portion keeps the lift amount (or the degree of opening) of the intake valve 20 relatively large, so that the exhaust gas in the combustion chamber 17 becomes easy to enter the intake port 18. The intake cam 27 of the embodiment can therefore be used suitable for an engine which executes the stratified charge combustion or weak stratified charge combustion.

The sub lift portion has a relatively gentle plateau shape and a hill portion or valley portion does not exist on the valve opening side of the cam face 27*a*. Therefore, the cam follower 20*b* can stably contact the entire surface of the cam face 27*a*. This can ensure stable movement of the intake valve 20 and surely realize the desired valve characteristic. What is more, the cam face 27*a* is prevented from being greatly inclined to the axis of the intake cam 27 at a portion corresponding to the sub lift portion.

That is, when there is a hill portion in the sub lift portion, it is necessary to rapidly change the height of the sub lift portion in the axial direction of the intake cam 27. This produces a large component force which acts in the axial direction of the intake cam 27, between the cam face 27*a* and the cam follower 20*b*. To suppress such a component force, the intake cam 27 should be increased in the axial direction, thus leading to the enlargement of the entire valve drive mechanism. According to the present embodiment, by way of contrast, as the height of the sub lift portion changes relatively gently in the axial direction of the intake cam 27, it is possible to avoid the enlargement of the intake cam 27 and the valve drive mechanism.

The intake cam 27 of the present embodiment may be used as the first intake cam 426 in FIG. 35.

Fifth Embodiment

A fifth embodiment of the present invention will now be described in accordance with FIGS. 54 to 58(B), centering on the differences from the fourth embodiment in FIGS. 49 to 53(B). Same symbols are given to components equivalent to those of the embodiment in FIGS. 49 to 53(B) to omit a detailed description.

Figure 54:
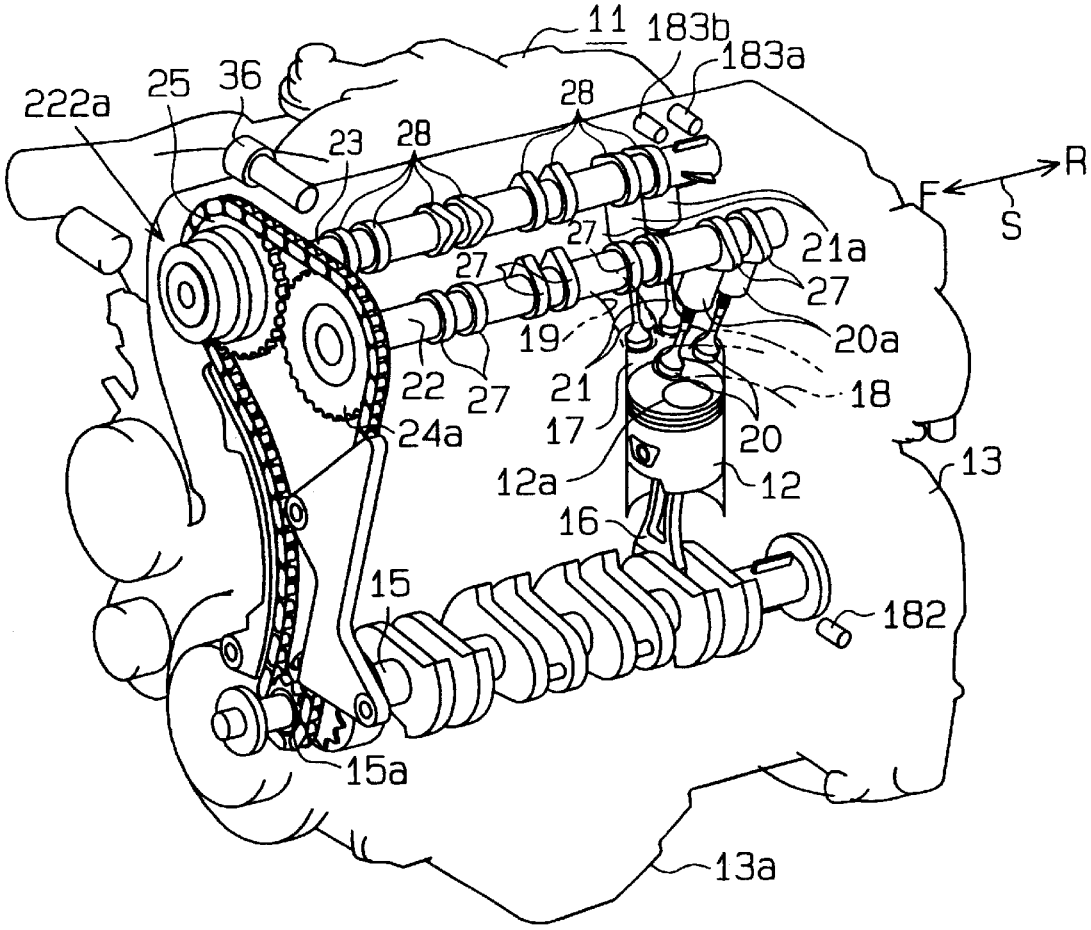
FIG. 54 is a schematic structural diagram illustrating an engine according to a fifth embodiment of the present invention.

In the present embodiment, as shown in FIG. 54, the valve-characteristic changing actuator 222*a* is provided at one end of the exhaust camshaft 23, not the intake camshaft 22. Although the intake camshaft 22 is not movable in the axial direction, therefore, the exhaust camshaft 23 is movable in the axial direction. While the profile of the intake cam 27 does not change in the axial direction, the profile of the exhaust cam 28 changes in the axial direction. The timing sprocket 24*a* is secured to the intake camshaft 22. The timing sprocket 25 is modified to a structure similar to that of the timing sprocket 24*a*. The cam angle sensor 183*a* and the shaft position sensor 183*b* are provided in such a way as to be associated with the exhaust camshaft 23.

In the present embodiment, the structure of the valve-characteristic changing actuator 222*a* in FIG. 30 is slightly changed, and the cover 254 and the ring gear 262 are engaged with each other by a straight spline extending in the axial direction. When the ring gear 262 together with the exhaust camshaft 23 moves in the axial direction, therefore, the rotational phase of the exhaust camshaft 23 does not change with respect to the crankshaft 15.

Figure 55A:
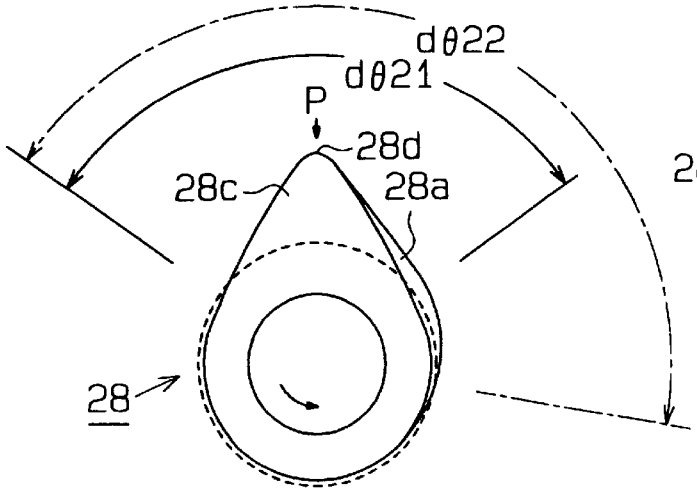
FIG. 55(A) is a rear view of an exhaust cam provided in the engine in FIG. 54.
Figure 55A:
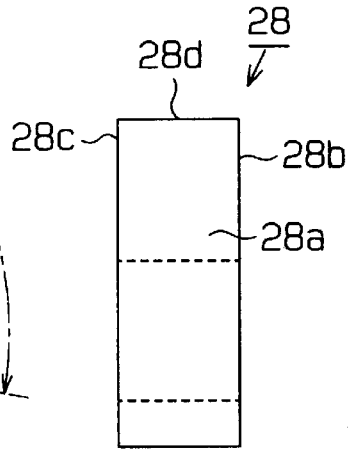
Figures 56, 57:
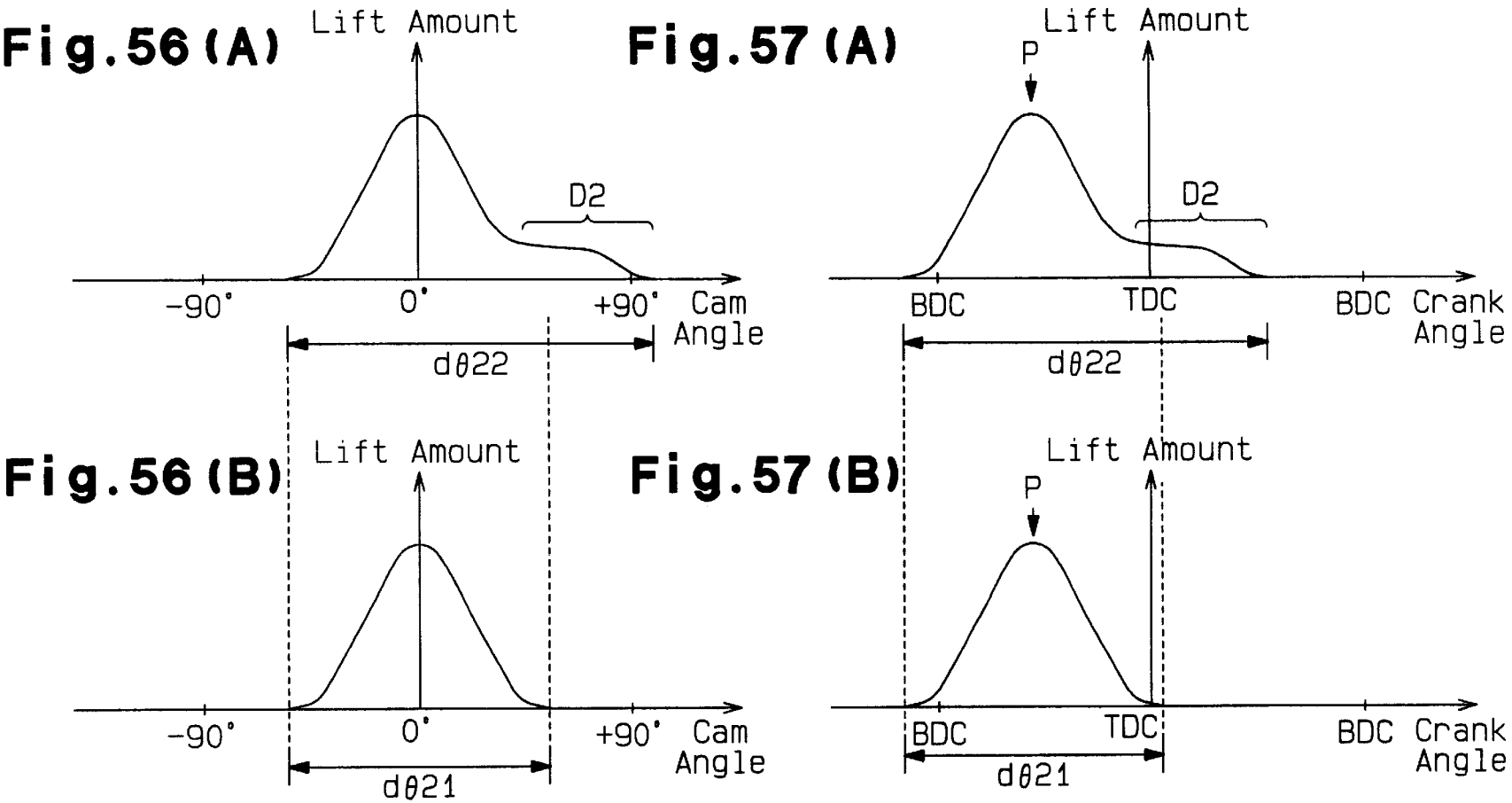
FIG. 56(A) and FIG. 56(B) are graphs showing lift patterns of the exhaust cam in FIG. 55(A).
FIG. 57(A) and FIG. 57(B) are graphs showing lift patterns of an exhaust valve which are realized by the exhaust cam in FIG. 55(A).

FIGS. 55(A) and 55(B) show the exhaust cam 28 of the present embodiment. The cam face 28*a* of the exhaust cam 28 has, on its valve closing side, a sub lift portion which continuously changes in the axial direction. Note however that the height of the cam nose 28*d* does not vary in the axial direction. In other words, the main lift portion of the cam face 28*a* does not change between the rear end face 28*c* and the front end face 28*b*.

The closer to the front end face 28*b* the cam face 28*a* is, the more prominently the sub lift portion appears. FIG. 56(A) shows the cam lift pattern of the cam face 28*a* which is closest to the front end face 28*b*. A sub lift pattern D2 corresponding to the sub lift portion remarkably appears in this cam lift pattern. The sub lift portion and its corresponding sub lift pattern D2 have relatively gentle plateau shapes. FIGS. 55(A) and 56(A) show the angle of action at the cam face 28*a* which is closest to the front end face 28*b* as a maximum angle of action dθ22.

The cam face 28*a* close to the rear end face 28*c* does not have a sub lift portion. FIG. 56(B) shows the cam lift pattern of the cam face 28*a* which is closest to the rear end face 28*c*. A sub lift pattern does not exist in this cam lift pattern, and only a main lift pattern corresponding to the main lift portion appears. The main lift portion and its corresponding main lift pattern become almost symmetrical on the valve opening side and the valve closing side of the cam face 28*a*. FIGS. 55(A) and 56(B) show the angle of action at the cam face 28*a* which is closest to the rear end face 28*c* as a minimum angle of action dθ21.

FIG. 57(A) and FIG. 57(B) are graphs showing the valve characteristics of the exhaust valve 21 which are realized by the exhaust cam 28. The horizontal scale shows the crank angle CA and the vertical scale shows the lift amount of the exhaust valve 21. FIG. 57(A) shows a valve lift pattern when the cam face 28*a* which is closest to the front end face 28*b* abuts on the cam follower (not shown) on the valve lifters 21*a*, and FIG. 57(B) shows a valve lift pattern when the cam face 28*a* which is closest to the rear end face 28*c* abuts on the cam follower. In the present embodiment, when the exhaust camshaft 23 moves in the axial direction, the rotational phase of the exhaust cam 28 is not changed with respect to the crankshaft 15. Therefore, the phases of both valve lift patterns shown in FIGS. 57(A) and 57(B) are identical.

Figure 58A:
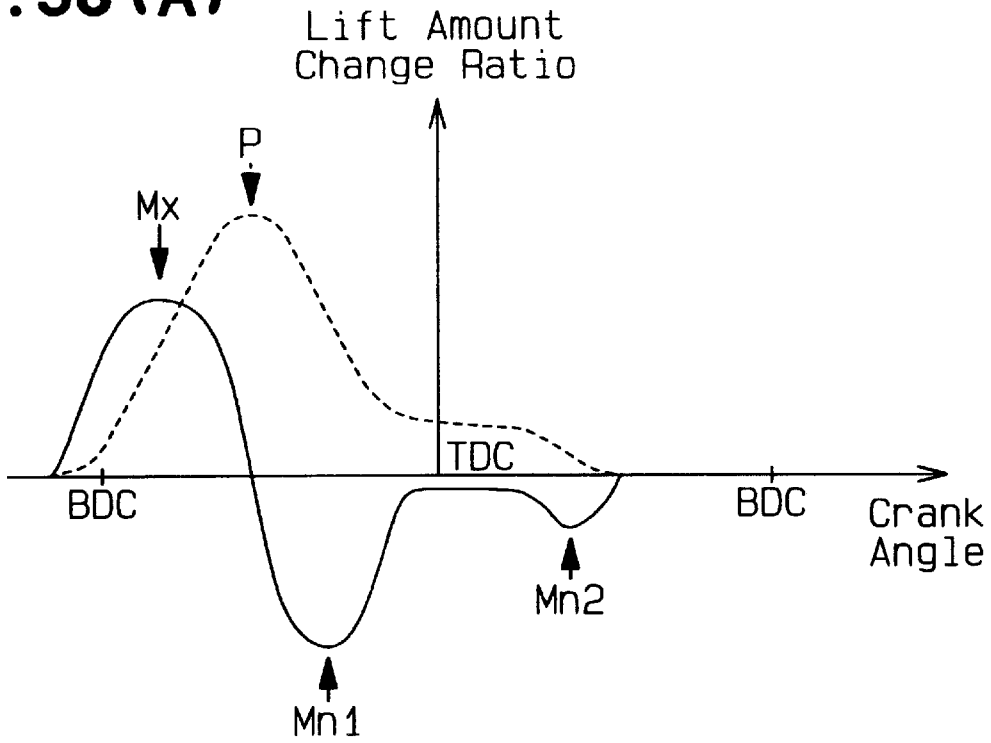
FIG. 58(A) and FIG. 58(B) are graphs showing change ratio patterns of a valve lift amount respectively in association with the valve lift patterns in FIG. 57(A) and FIG. 57(B).
Figure 58B:
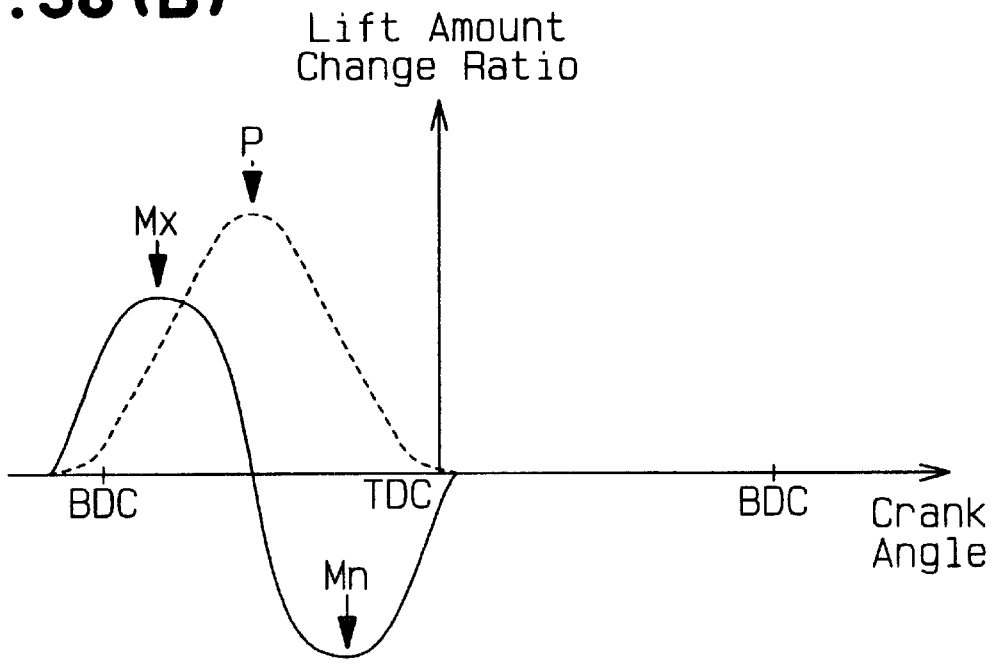

FIG. 58(A) and FIG. 58(B) are graphs showing change ratio patterns of a valve lift amount corresponding to the crank angle CA. The change ratio pattern in FIG. 58(A) corresponds to the valve lift pattern in FIG. 57(A) and the change ratio pattern in FIG. 58(B) corresponds to the valve lift pattern in FIG. 57(B). The corresponding valve lift patterns are indicated by broken lines.

The change ratio pattern shown in FIG. 58(A) has two minimum portions Mn1 and Mn2 on the valve closing side (angle delaying side) to the peak P of the valve lift pattern and a single maximum portion Mx on the valve opening side (angle advancing side) to the peak P of the valve lift pattern. The change ratio pattern shown in FIG. 58(B) has a single minimum portion Mn on the valve closing side to the peak P of the valve lift pattern and a single maximum portion Mx on the valve opening side to the peak P of the valve lift pattern.

In the valve lift pattern shown in FIG. 57(A), there is no minimum portion (valley portion) in the plateau-shaped sub lift pattern D2. In other words, with regard to the portion of the sub lift pattern D2, there is no minimum portion in the change pattern of the lift amount with respect to the rotational angle of the exhaust cam 28.

The cam face 28*a* continuously changes in the axial direction between the front end face 28*b* and the rear end face 28*c*. This can allow the valve-characteristic changing actuator 222*a* to steplessly adjust the valve lift pattern between the pattern in FIG. 57(A) and the pattern in FIG. 57(B).

According to the present embodiment, as described above, the cam face 28*a* which is closest to the front end face 28*b* is formed in such a way that the change ratio pattern of the valve lift amount with respect to the rotational angle of the exhaust cam 28 has two minimum portions Mn1 and Mn2 on the valve closing side and the change ratio pattern of the valve lift amount with respect to the rotational angle of the exhaust cam 28 does not have a minimum portion on the valve closing side.

In other words, according to the present embodiment, the cam face 28*a* which is closest to the front end face 28*b* has a sub lift portion on the valve closing side. The sub lift portion and the sub lift pattern D2 of the exhaust valve 21 which is realized by the sub lift portion have relatively gentle plateau shapes and do not have hill portions or valley portion. Moreover, the sub lift portion and the main lift portion are gently linked together and there is no valley portion between both lift portions.

Therefore, the sub lift portion delays the closing timing of the exhaust valve 21 with the lift amount of the exhaust valve 21 kept almost constant. Moreover, the valve lift amount does not fall abruptly between the sub lift portion and the main lift portion.

When the cam face 28*a* which is closest to the front end face 28*b* abuts on the cam follower (not shown), the valve overlapping amount increases. Then, the exhaust gas is returned again to the combustion chamber 17 from the exhaust port 19 at the time of the intake stroke of the piston 12, and the amount of the exhaust gas to be taken into the combustion chamber 17 becomes sufficiently large. At this time, the plateau-like or highland-like sub lift portion increases the amount of the exhaust gas to be taken without requiring the provision of a high hill portion locally in the sub lift portion.

The exhaust cam 28 of the present embodiment has the same advantages as the advantages of the intake cam 27 in the embodiment in FIGS. 49 to 53(B).

Sixth Embodiment

A sixth embodiment of the present invention will now be described in accordance with FIGS. 59(A) to 62(B), centering on the differences from the fourth embodiment in FIGS. 49 to 53(B). Same symbols are given to components equivalent to those of the embodiment in FIGS. 49 to 53(B) to omit a detailed description.

Figure 59B:
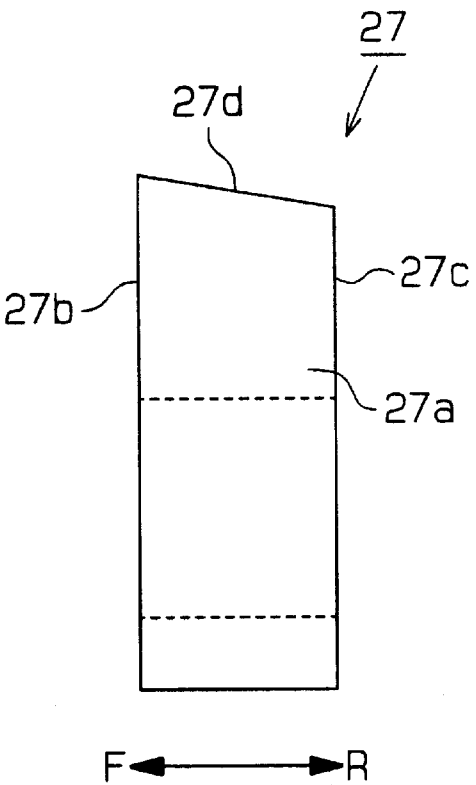
FIG. 59(B) is a side view of the intake cam in FIG. 59(A).
Figure 59A:
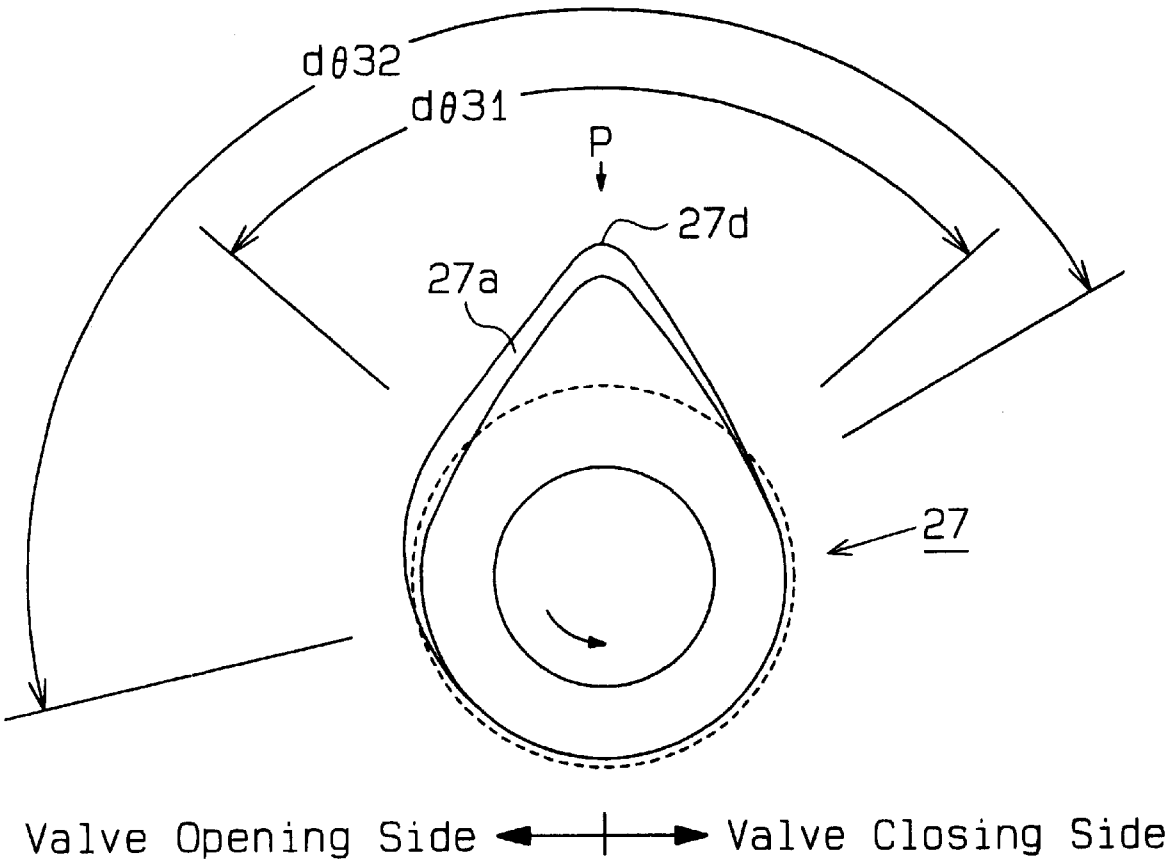
FIG. 59(A) is a rear view of an intake cam according to a sixth embodiment of the present invention.
Figure 61:
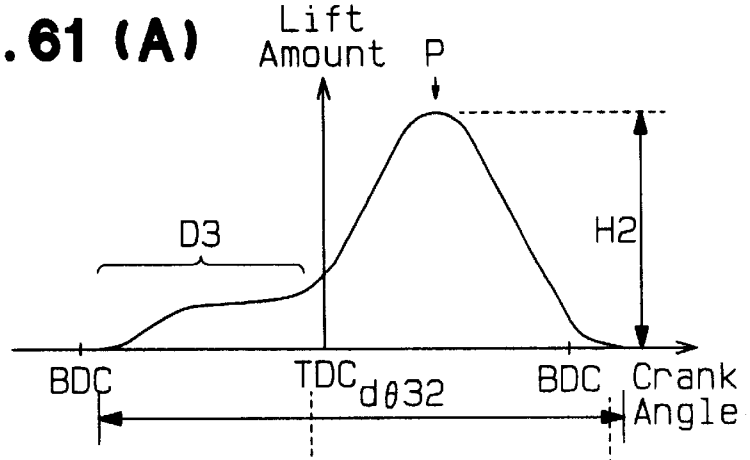
FIG. 61(A) and FIG. 61(B) are graphs showing lift patterns of an intake valve which are realized by the intake cam in FIG. 59(A).
Figure 61:
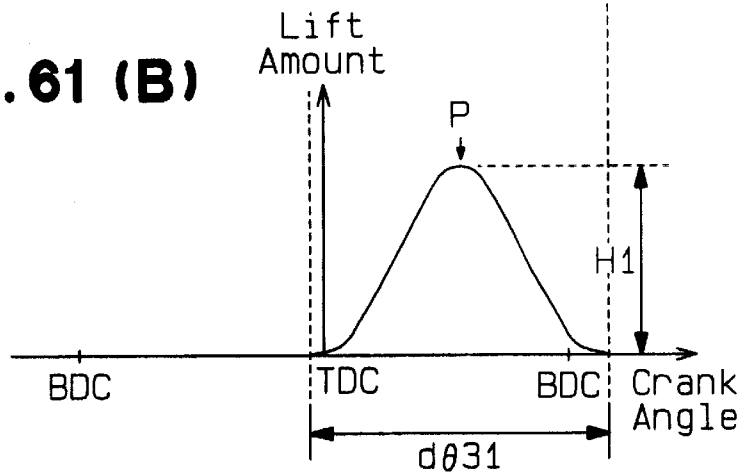
Figure 60:
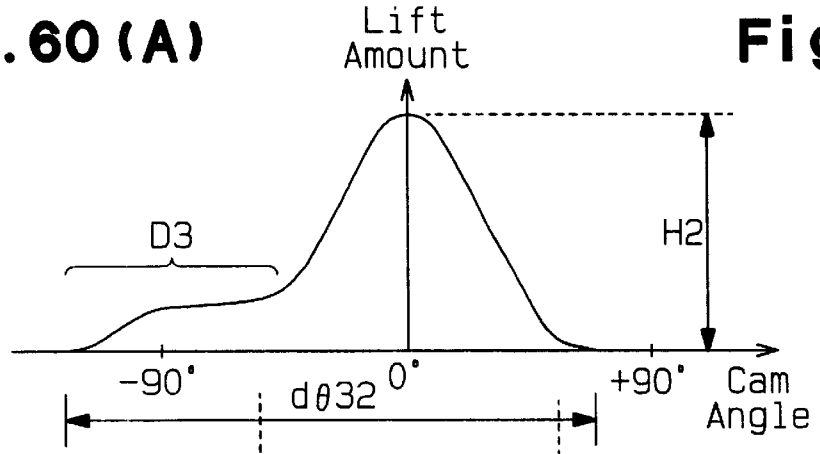
FIG. 60(A) and FIG. 60(B) are graphs showing lift patterns of the intake cam in FIG. 59(A).
Figure 60:
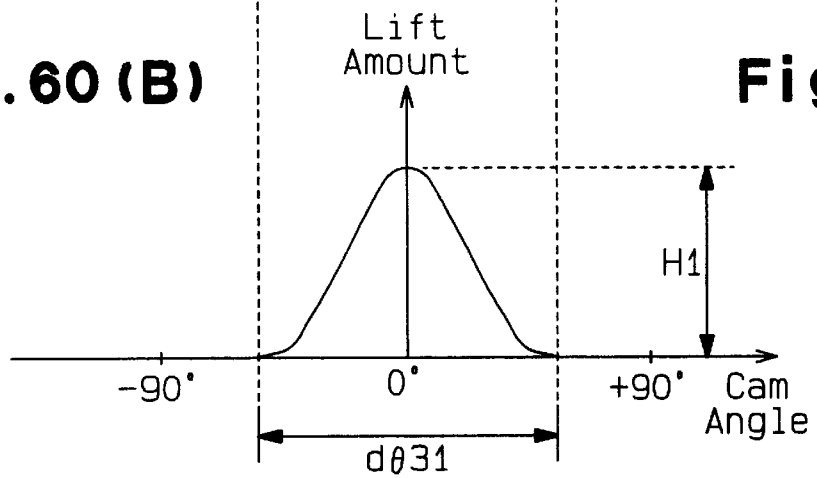

FIGS. 59(A) and 59(B) show the intake cam 27 of the present embodiment. The intake cam 27 of the present embodiment differs from the intake cam 27 in FIG. 49 in that the height of the cam nose 27*d* continuously changes in the axial direction, i.e., the main lift portion of the cam face 27*a* continuously changes between the rear end face 27*c* and the front end face 27*b*. The height of the cam nose 27*d* gradually increases in a direction toward the front end face 27*b* from the rear end face 27*c*. The other is the same as that of the embodiment in FIGS. 49 to 53(B).

FIG. 60(A) shows the cam lift pattern of the cam face 27*a* which is closest to the front end face 27*b*. A plateau-like sub lift pattern D3 corresponding to the sub lift portion remarkably appears in this cam lift pattern. FIGS. 59(A) and 60(A) show the angle of action at the cam face 27*a* which is closest to the front end face 27*b* as a maximum angle of action dθ32. FIG. 60(B) shows the cam lift pattern of the cam face 27*a* which is closest to the rear end face 27*c*. In this cam lift pattern, a sub lift pattern does not exist and only a main lift pattern corresponding to the main lift portion appears. FIGS. 59(A) and 60(B) show the angle of action at the cam face 27*a* which is closest to the rear end face 27*c* as a minimum angle of action dθ31. The difference between the minimum angle of action dθ31 and the maximum angle of action dθ32 is greater than that of the intake cam 27 of the embodiment in FIGS. 49 to 53(B).

FIG. 61(A) shows a valve lift pattern when the cam face 27*a* which is closest to the front end face 27*b* abuts on the cam follower 20*b*, and FIG. 61(B) shows a valve lift pattern when the cam face 27*a* which is closest to the rear end face 27*c* abuts on the cam follower 20*b*. The valve lift pattern shown in FIG. 61(A) is shifted further in the angle advancing direction than the valve lift pattern shown in FIG. 61(B). A height H2 of the peak P of the valve lift pattern shown in FIG. 61(A) is greater than a height H1 of the peak P of the valve lift pattern shown in FIG. 61(B). The valve lift patterns show tendencies similar to those of the valve lift patterns in FIGS. 52(A) and 52(B).

Figure 62A:
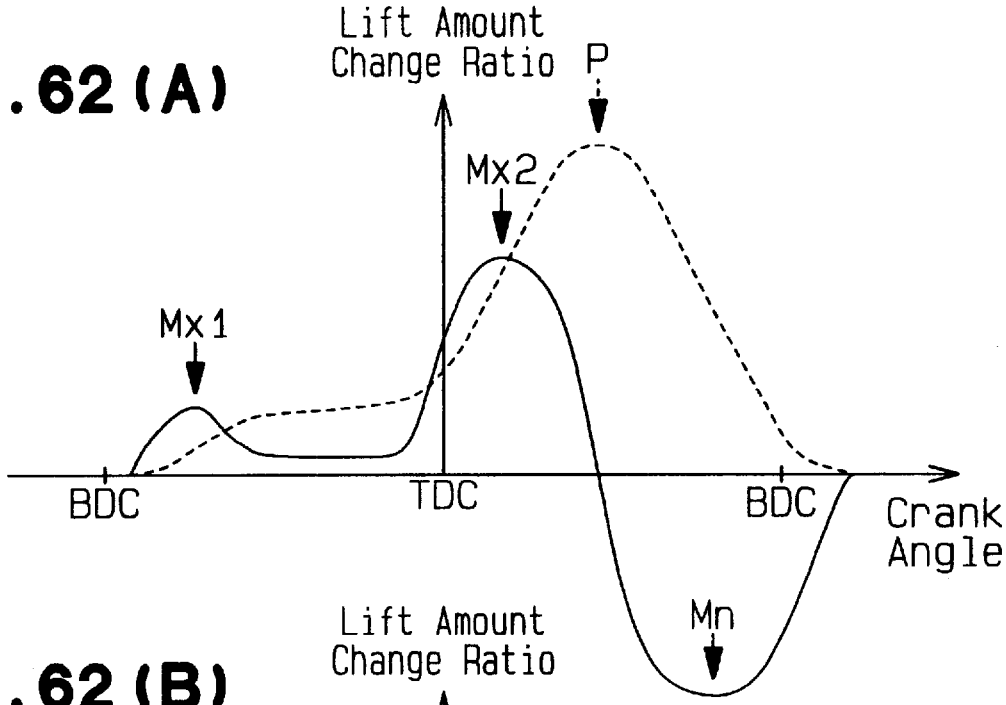
FIG. 62(A) and FIG. 62(B) are graphs showing change ratio patterns of a valve lift amount respectively in association with the valve lift patterns in FIG. 61(A) and FIG. 61(B).
Figure 62B:
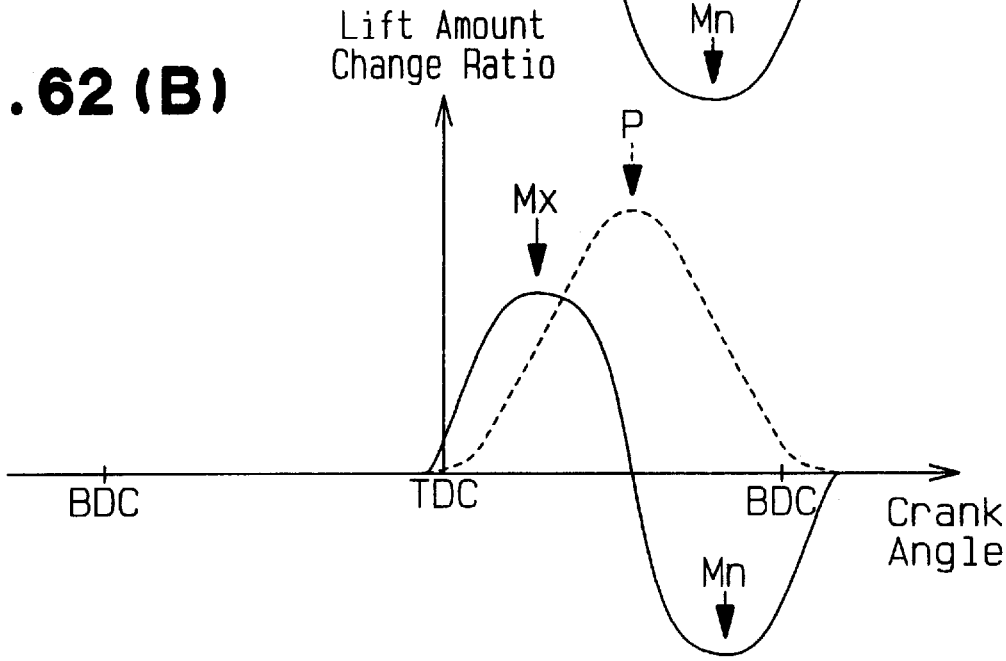

FIG. 62(A) and FIG. 62(B) are graphs showing change ratio patterns of a valve lift amount corresponding to the crank angle CA. The change ratio pattern in FIG. 62(A) corresponds to the valve lift pattern in FIG. 61(A) and the change ratio pattern in FIG. 62(B) corresponds to the valve lift pattern in FIG. 61(B). The corresponding valve lift patterns are indicated by broken lines. The change ratio patterns show tendencies similar to those of the change ratio patterns in FIGS. 53(A) and 53(B).

The above-described present embodiment has the same advantages as those of the embodiment in FIGS. 49 to 53(B). In the present embodiment, particularly, the height of the cam nose 27*d* gradually increases in the direction toward the front end face 27*b* from the rear end face 27*c*. It is therefore possible to make the alteration range of the angle of action or the alteration range of the opening period of the intake valve 20 greater than that of the embodiment in FIGS. 49 to 53(B) without rapidly changing the size of the sub lift portion itself in the axial direction of the intake cam 27. This contributes to making the intake cam 27 and the valve drive mechanism compact.

Seventh Embodiment

A seventh embodiment of the present invention will now be described in accordance with FIGS. 63(A) to 66(B), centering on the differences from the fifth embodiment in FIGS. 54 to 58(B). Same symbols are given to components equivalent to those of the embodiment in FIGS. 54 to 58(B) to omit a detailed description.

Figure 63B:
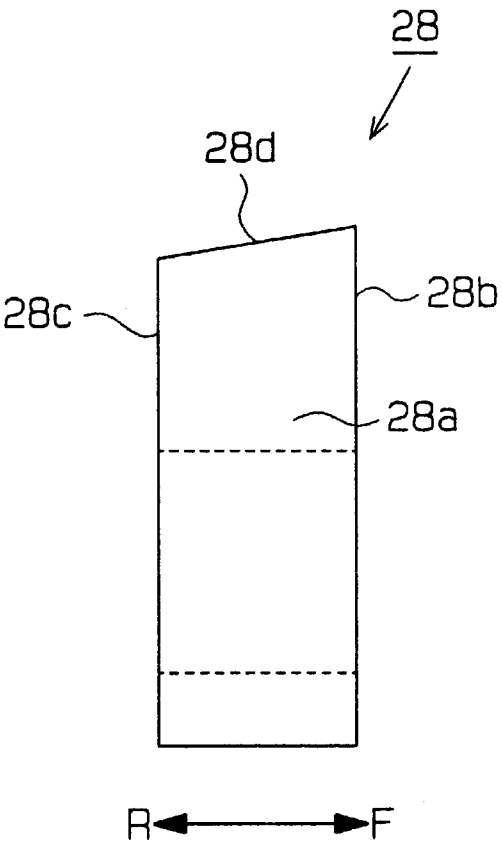
FIG. 63(B) is a side view of the exhaust cam in FIG. 63(A).
Figure 63A:
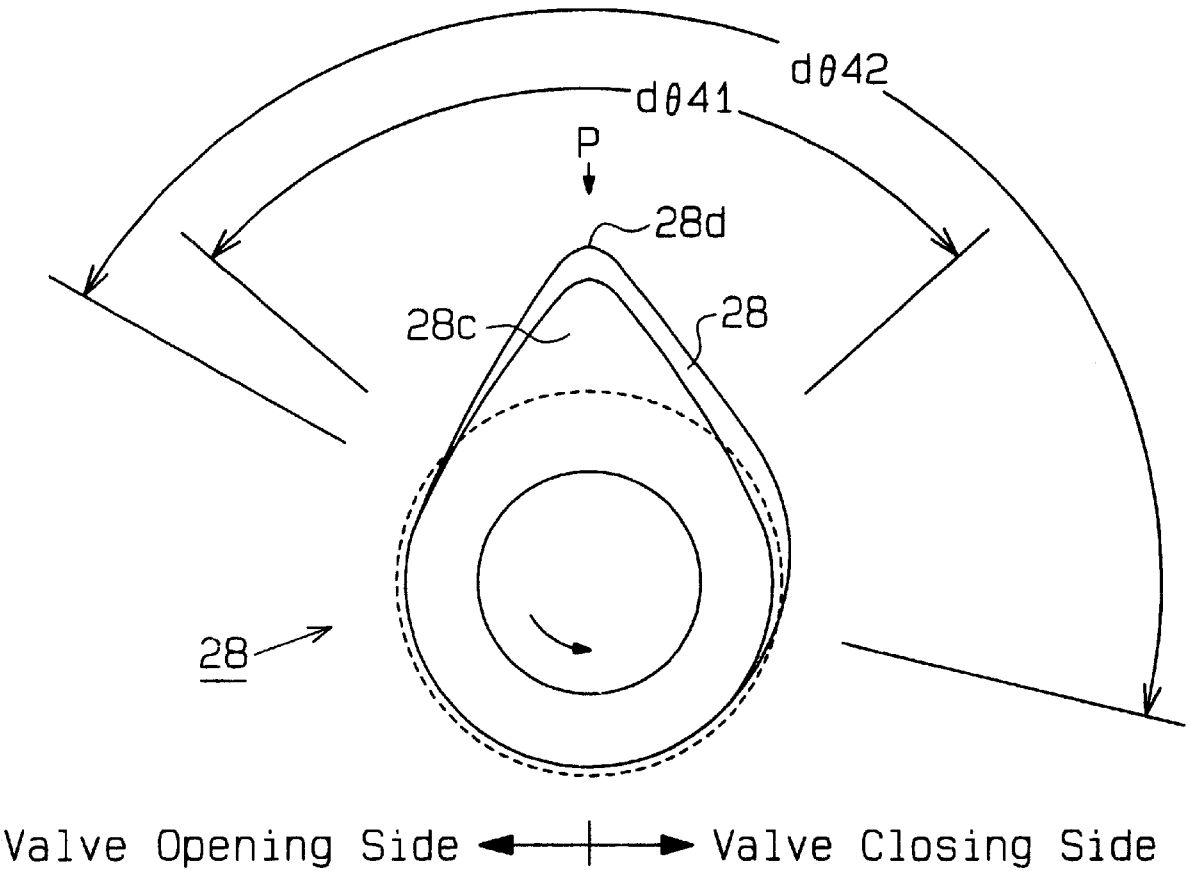
FIG. 63(A) is a rear view of an exhaust cam according to a seventh embodiment of the present invention.

FIGS. 63(A) and 63(B) show the exhaust cam 28 of the present embodiment. The exhaust cam 28 of the present embodiment differs from the exhaust cam 28 in FIG. 55(A) in that the height of the cam nose 28*d* continuously changes in the axial direction, i.e., the main lift portion of the cam face 28*a* continuously changes between the rear end face 28*c* and the front end face 28*b*. The height of the cam nose 28*d* gradually increases in a direction toward the front end face 28*b* from the rear end face 28*c*.

Further, with regard to the valve-characteristic changing actuator 222*a*, the present embodiment differs from the embodiment in FIGS. 54 to 58(B) in that the cover 254 and the ring gear 262 are engaged with each other by helical teeth. When the ring gear 262 moves together with the exhaust camshaft 23 in the axial direction, therefore, the rotational phase of the exhaust camshaft 23 changes with respect to the crankshaft 15. The other is the same as that of the embodiment in FIGS. 54 to 58(B).

In the present embodiment, as the exhaust camshaft 23 moves in the rearward direction R, i.e., as the abutting position of the cam face 28*a* with respect to the cam follower (not shown) comes closer to the front end face 28*b* of the exhaust cam 28, the exhaust cam 28 delays its angle with respect to the crankshaft 15.

Figures 64A, 64B, 65A, 65B:
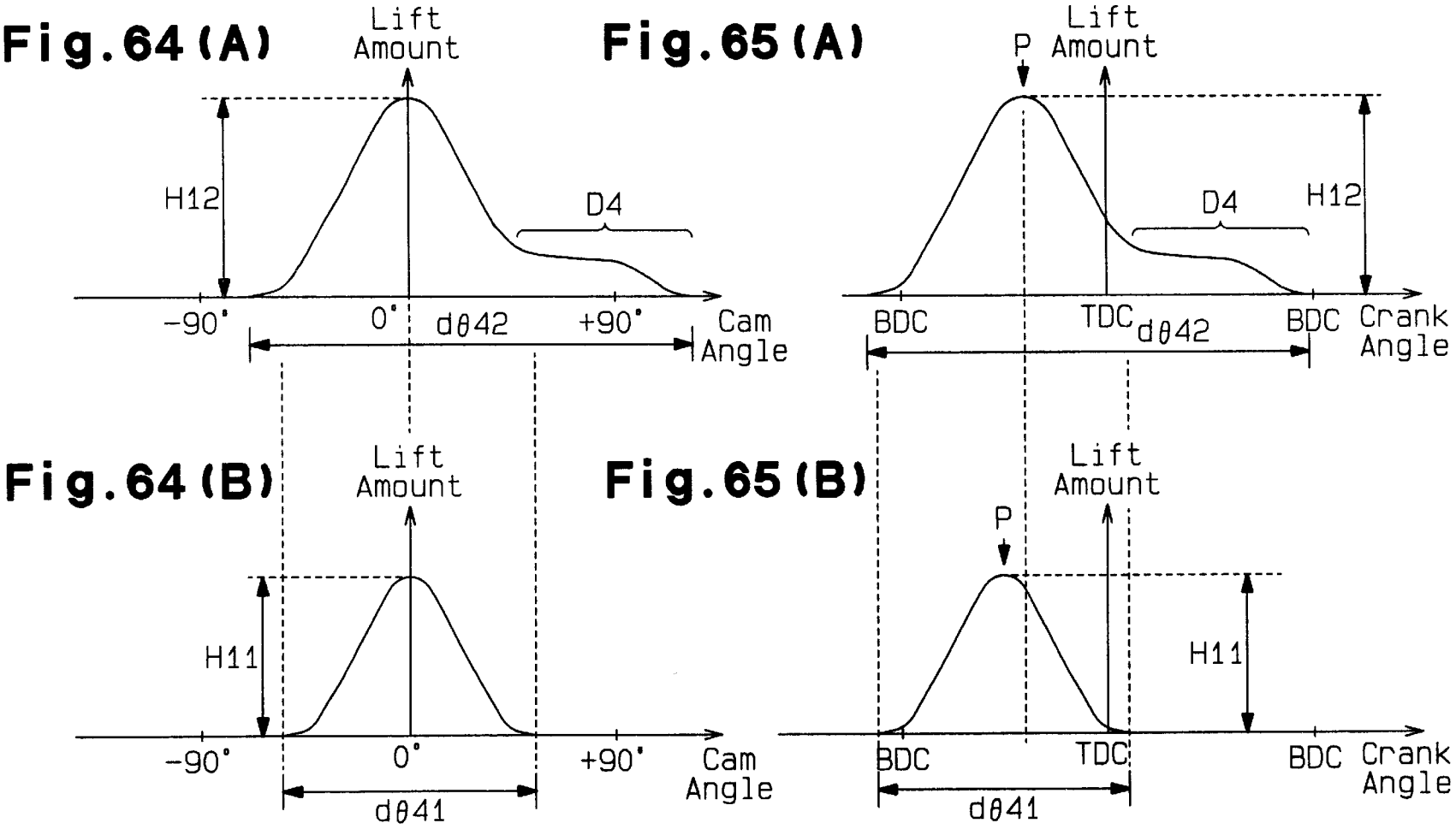
FIG. 64(A) and FIG. 64(B) are graphs showing lift patterns of the exhaust cam in FIG. 63(A).
FIG. 65(A) and FIG. 65(B) are graphs showing lift patterns of an exhaust valve which are realized by the exhaust cam in FIG. 63(A).

FIG. 64(A) shows the cam lift pattern of the cam face 28*a* which is closest to the front end face 28*b*. A plateau-like sub lift pattern D4 corresponding to the sub lift portion remarkably appears in this cam lift pattern. FIGS. 63(A) and 64(A) show the angle of action at the cam face 28*a* which is closest to the front end face 28*b* as a maximum angle of action dθ42. FIG. 64(B) shows the cam lift pattern of the cam face 28*a* which is closest to the rear end face 28*c*. In this cam lift pattern, a sub lift pattern does not exist and only a main lift pattern corresponding to the main lift portion appears. FIGS. 63(A) and 64(B) show the angle of action at the cam face 28*a* which is closest to the rear end face 28*c* as a minimum angle of action dθ41. The difference between the minimum angle of action dθ41 and the maximum angle of action dθ42 is greater than that of the exhaust cam 28 of the embodiment in FIGS. 54 to 58(B).

FIG. 65(A) shows a valve lift pattern when the cam face 28*a* which is closest to the front end face 28*b* abuts on the cam follower, and FIG. 65(B) shows a valve lift pattern when the cam face 28*a* which is closest to the rear end face 28*c* abuts on the cam follower. The valve lift pattern shown in FIG. 65(A) is shifted further in the angle delaying direction than the valve lift pattern shown in FIG. 65(B). A height H12 of the peak P of the valve lift pattern shown in FIG. 65(A) is greater than a height H11 of the peak P of the valve lift pattern shown in FIG. 65(B). The valve lift patterns show tendencies similar to those of the valve lift patterns in FIGS. 57(A) and 57(B).

Figure 66A:
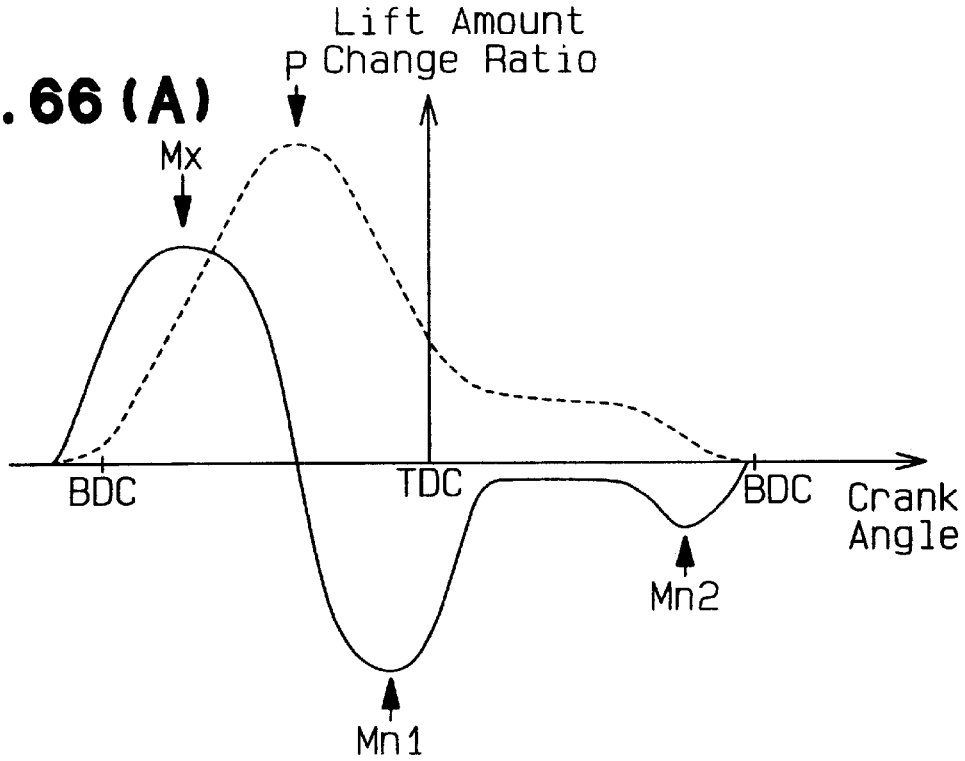
FIG. 66(A) and FIG. 66(B) are graphs showing change ratio patterns of a valve lift amount respectively in association with the valve lift patterns in FIG. 65(A) and FIG. 65(B).
Figure 66B:
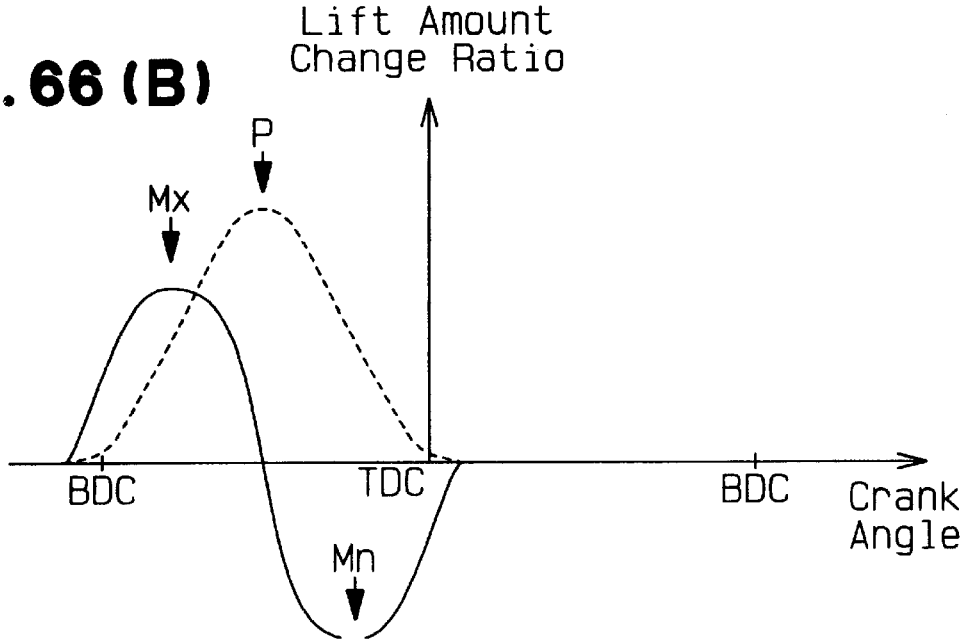

FIG. 66(A) and FIG. 66(B) are graphs showing change ratio patterns of a valve lift amount corresponding to the crank angle CA. The change ratio pattern in FIG. 66(A) corresponds to the valve lift pattern in FIG. 65(A) and the change ratio pattern in FIG. 66(B) corresponds to the valve lift pattern in FIG. 65(B). The corresponding valve lift patterns are indicated by broken lines. The change ratio patterns show tendencies similar to those of the change ratio patterns in FIGS. 58(A) and 58(B).

The above-described embodiment has the same advantages as those of the embodiment in FIGS. 54 to 58(B). In the present embodiment, particularly, the height of the cam nose 28*d* gradually increases in the direction toward the front end face 28*b* from the rear end face 28*c*. It is therefore possible to make the alteration range of the angle of action or the alteration range of the opening period of the exhaust valve 21 greater than that of the embodiment in FIGS. 54 to 58(B) without rapidly changing the size of the sub lift portion itself in the axial direction of the exhaust cam 28. This contributes to making the exhaust cam 28 and the valve drive mechanism compact.

Eighth Embodiment

An eighth embodiment of the present invention will now be described in accordance with FIGS. 67 to 70(B), centering on the differences from the fourth embodiment in FIGS. 49 to 53(B). Same symbols are given to components equivalent to those of the embodiment in FIGS. 49 to 53(B) to omit a detailed description.

Figure 67B:
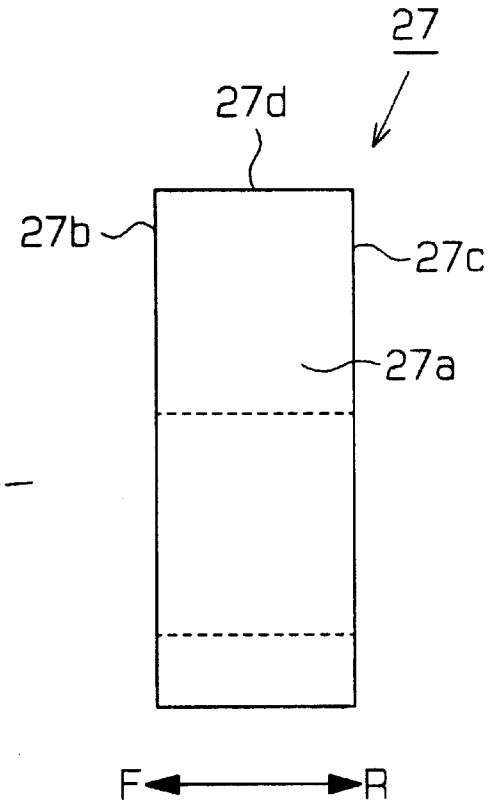
FIG. 67(B) is a side view of the intake cam in FIG. 67(A).
Figure 67A:
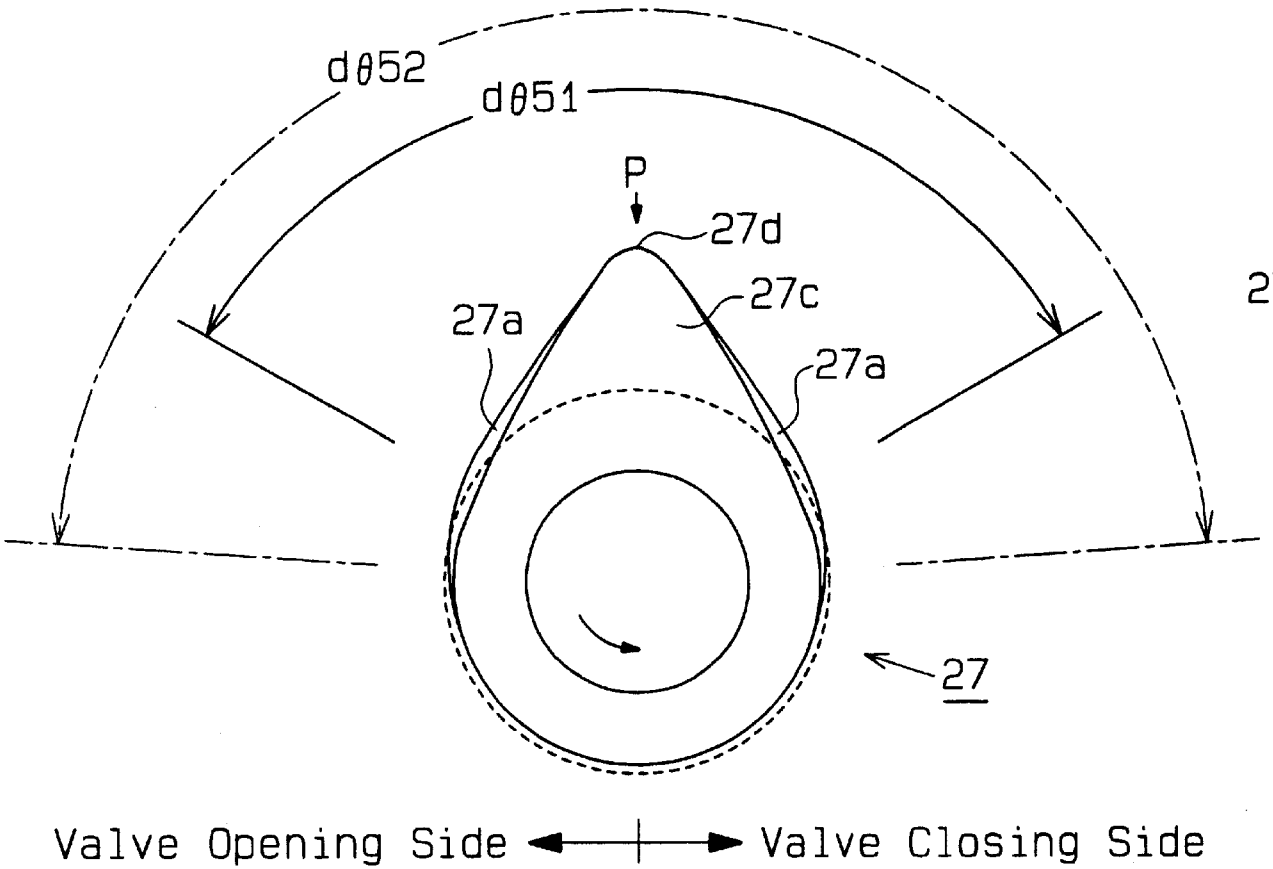
FIG. 67(A) is a rear view of an intake cam according to an eighth embodiment of the present invention.

FIGS. 67(A) and 67(B) show the intake cam 27 of the present embodiment. The intake cam 27 of the present embodiment differs from the intake cam 27 in FIG. 49 in that the sub lift portion which continuously changes in the axial direction is provided not only on the valve opening side but also on the valve closing side.

Further, with regard to the valve-characteristic changing actuator 222*a*, the present embodiment differs from the embodiment in FIGS. 49 to 53(B) in that the cover 254 and the ring gear 262 are engaged with each other by a straight spline extending in the axial direction. When the ring gear 262 moves together with the intake camshaft 22 in the axial direction, therefore, the rotational phase of the intake camshaft 22 does not change with respect to the crankshaft 15. The other is the same as that of the embodiment in FIGS. 49 to 53(B).

Figure 68A:
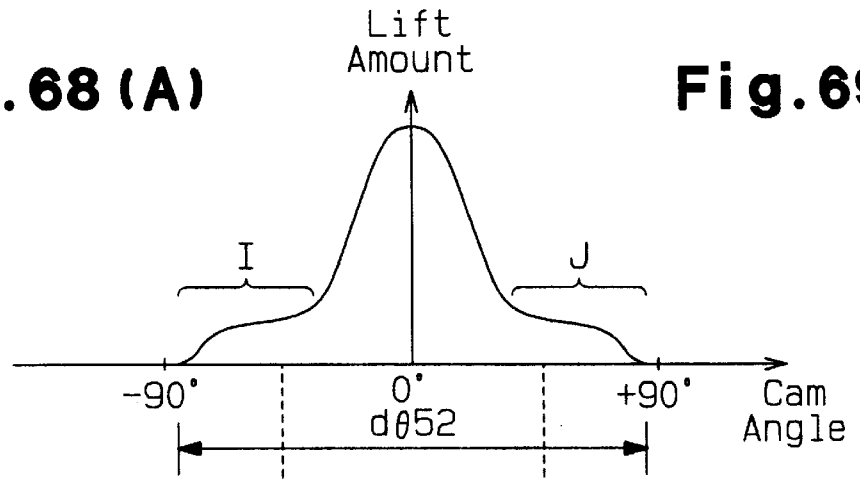
FIG. 68(A) and FIG. 68(B) are graphs showing lift patterns of the intake cam in FIG. 67(A).
Figure 68B:
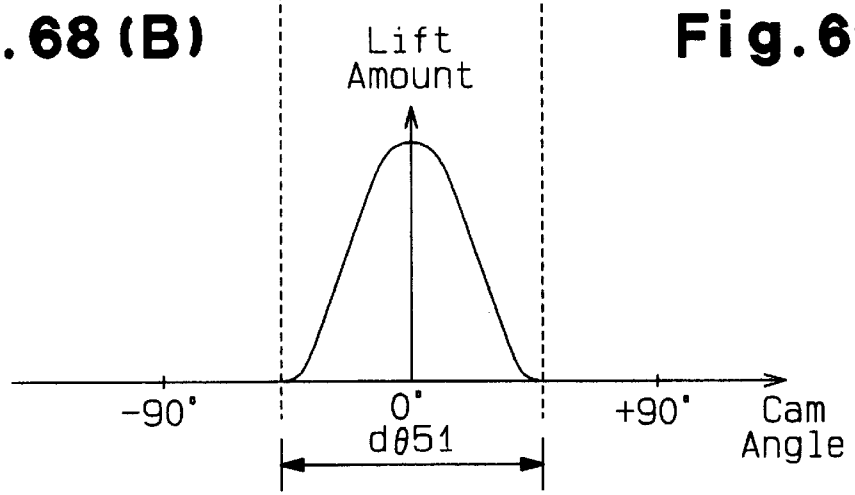

FIG. 68(A) shows the cam lift pattern of the cam face 27*a* which is closest to the front end face 27*b*. This cam lift pattern becomes almost symmetrical on the valve opening side and the valve closing side of the cam face 27*a*. A pair of plateau-like sub lift patterns I and J corresponding to a pair of sub lift portions noticeably appear in this cam lift pattern. FIGS. 67(A) and 68(A) show the angle of action at the cam face 27*a* which is closest to the front end face 27*b* as a maximum angle of action dθ52. FIG. 68(B) shows the cam lift pattern of the cam face 27*a* which is closest to the rear end face 27*c*. In this cam lift pattern, a sub lift pattern does not exist and only a main lift pattern corresponding to the main lift portion appears. FIGS. 67(A) and 68(B) show the angle of action at the cam face 27*a* which is closest to the rear end face 27*c* as a minimum angle of action dθ51.

Figure 69A:
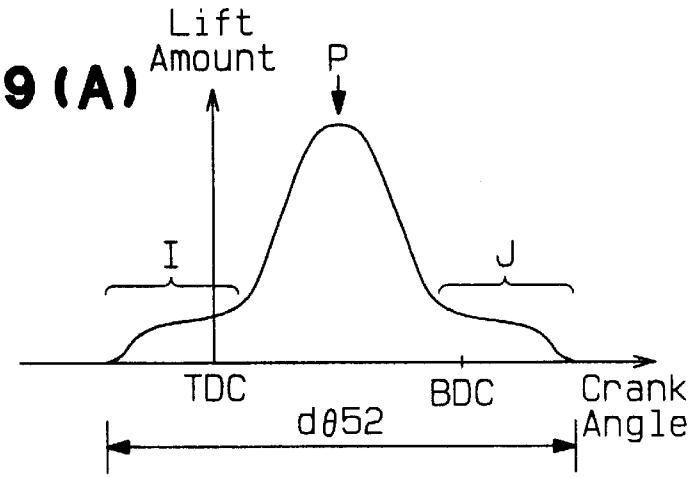
FIG. 69(A) and FIG. 69(B) are graphs showing lift patterns of an intake valve which are realized by the intake cam in FIG. 67(A).
Figure 69B:
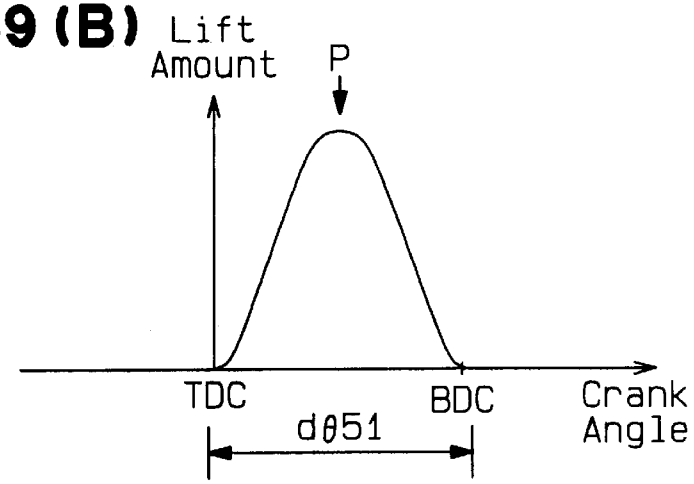

FIG. 69(A) shows a valve lift pattern when the cam face 27*a* which is closest to the front end face 27*b* abuts on the cam follower 20*b*, and FIG. 69(B) shows a valve lift pattern when the cam face 27*a* which is closest to the rear end face 27*c* abuts on the cam follower 20*b*. The phases of both valve lift patterns shown in FIGS. 69(A) and 69(B) are identical.

Figure 70A:
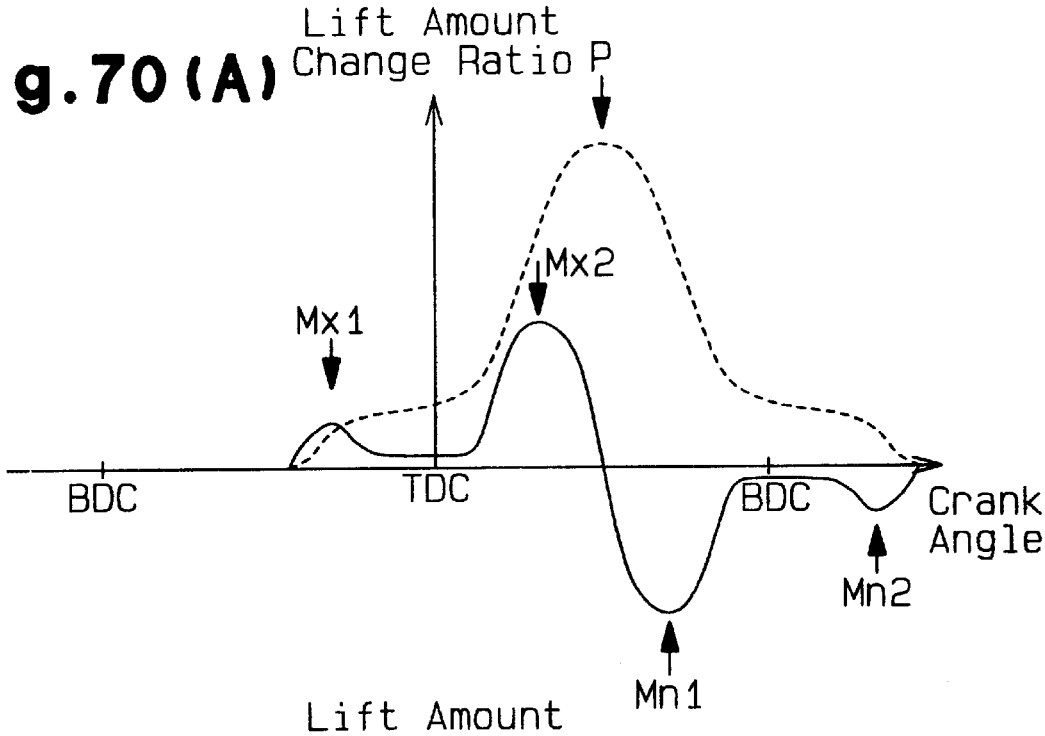
FIG. 70(A) and FIG. 70(B) are graphs showing change ratio patterns of a valve lift amount respectively in association with the valve lift patterns in FIG. 69(A) and FIG. 69(B).
Figure 70B:
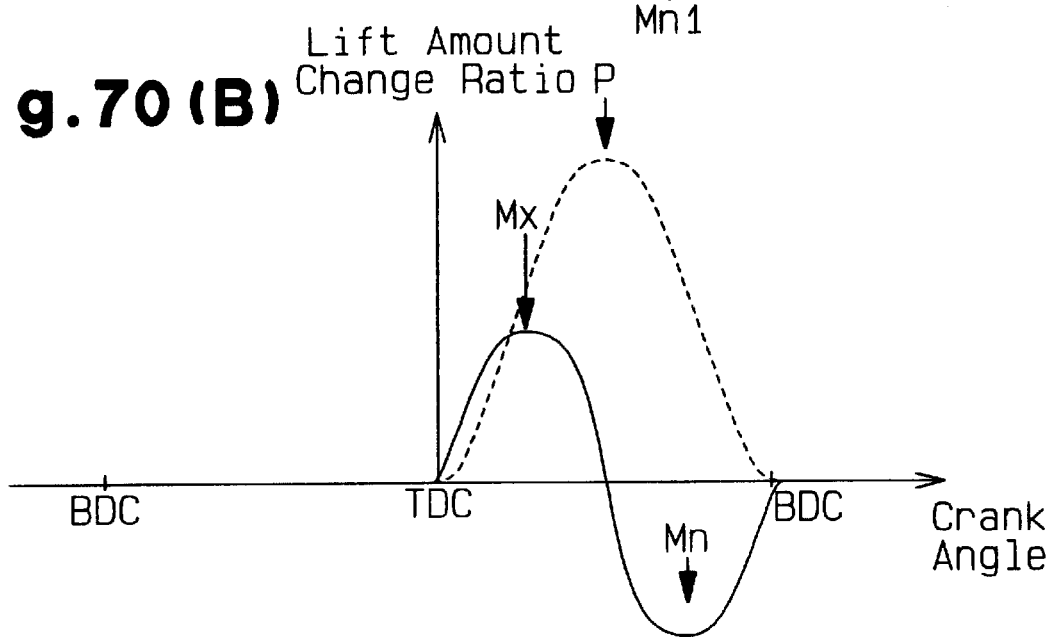
Figure 71:
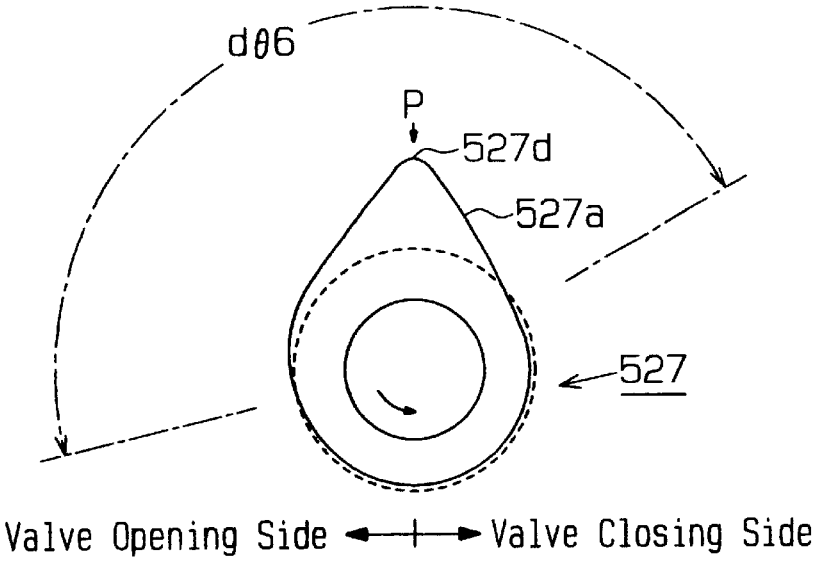
FIG. 71(A) is a rear view of a first intake cam according to a ninth embodiment of the present invention.
FIG. 71(B) is a side view of the first intake cam in FIG. 71(A)
Figure 71:
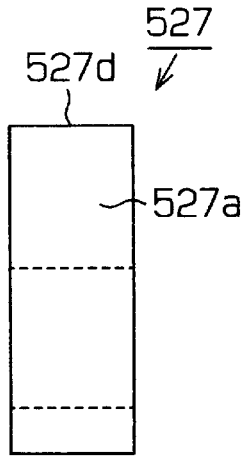

FIG. 70(A) and FIG. 70(B) are graphs showing change ratio patterns of a valve lift amount corresponding to the crank angle CA. The change ratio pattern in FIG. 70(A) corresponds to the valve lift pattern in FIG. 65(A) and the change ratio pattern in FIG. 70(B) corresponds to the valve lift pattern in FIG. 69(B). The corresponding valve lift patterns are indicated by broken lines.

The change ratio pattern shown in FIG. 70(A) has two maximum portions Mx1 and Mx2 on the valve opening side (angle advancing side) to the peak P of the valve lift pattern and two minimum portions Mn1 and Mn2 on the valve closing side (angle delaying side) to the peak P of the valve lift pattern. The change ratio pattern shown in FIG. 70(B) shows a tendency similar to that of the change ratio pattern shown in FIG. 53(B).

In the valve lift pattern shown in FIG. 69(A), there are no minimum portions (valley portions) in the plateau-shaped sub lift patterns I and J. In other words, with regard to the portions of the sub lift patterns I and J, there are no minimum portions in the change patterns of the lift amount with respect to the rotational angle of the intake cam 27.

The above-described present embodiment has the same advantages as those of the embodiment in FIGS. 49 to 53(B). In the embodiment, particularly, a pair of sub lift portions are provided on the valve opening side and the valve closing side of the intake cam 27. Each sub lift portion contributes to increasing the angle of action of the intake cam 27. It is therefore possible to make the alteration range of the angle of action greater even if the size of each sub lift portion is gently changed in the axial direction of the intake cam 27, as compared with the embodiment in FIGS. 49 to 53(B) where only one sub lift portion is provided. This contributes to making the intake cam 27 and the valve drive mechanism compact.

In the present embodiment, the height of the cam nose 27*d* may be changed continuously in the axial direction. The sub lift patterns I and J respectively corresponding to both sub lift portions may be made different between the valve opening side and the valve closing side. Further, the structure of the present embodiment may be adapted to the exhaust cam 28.

Ninth Embodiment

A ninth embodiment of the present invention will now be described in accordance with FIGS. 71(A) to 78, centering on the differences from the fourth embodiment in FIGS. 49 to 53(B). Same symbols are given to components equivalent to those of the embodiment in FIGS. 49 to 53(B) to omit a detailed description.

In the present embodiment, a pair of intake cams 527 and 529 having different shapes are provided with respect to each intake valve 20. One intake cam 527 is a first intake cam and the other intake cam 529 is a second intake cam. Neither of the profiles of the intake cams 527 and 529 changes in the axial direction. In the present embodiment, the valve-characteristic changing actuator 222*a* is not provided.

Therefore, the intake camshaft 22 is not movable in the axial direction. A selected one of both intake cams 527 and 529 drives one intake valve 20 via a locker arm (not shown).

FIGS. 71(A) and 71(B) show the first intake cam 527 of the present embodiment. A cam face 527*a* of the first intake cam 527 has a sub lift portion on its valve opening side. The profile of the cam face 527*a* is almost identical to the profile of the cam face 27*a* of the intake cam 27 in FIG. 50(A) which is closest to the front end face 27*b*.

Figure 72:
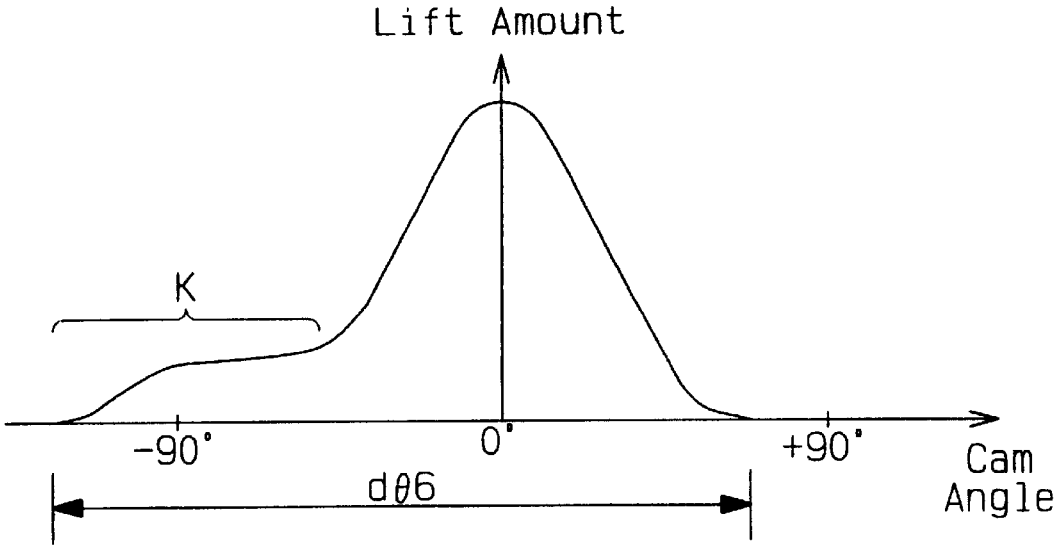
FIG. 72 is a graph showing a lift pattern of the first intake cam in FIG. 71(A).
Figure 73:
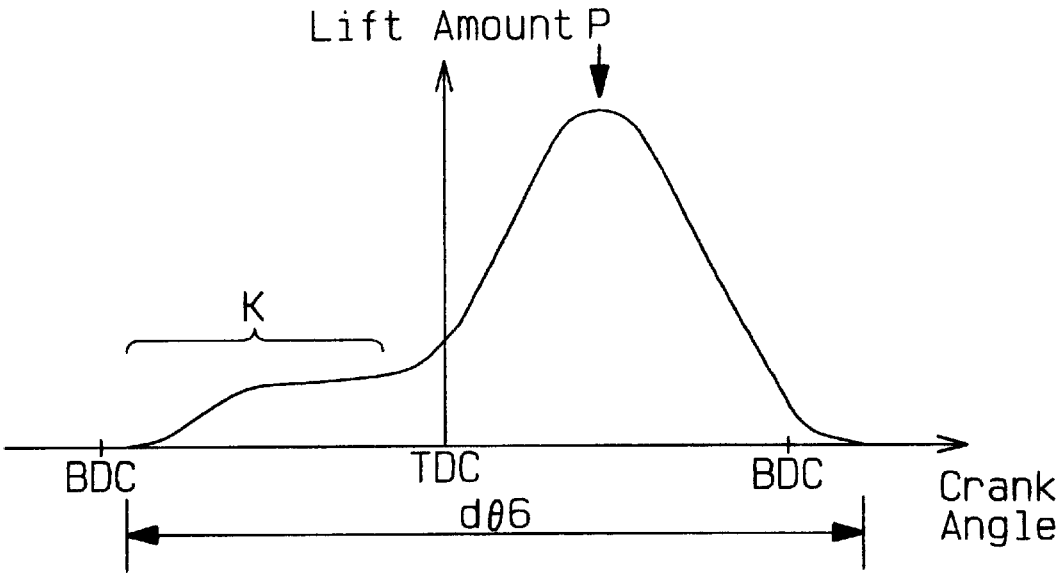
FIG. 73 is a graph showing a lift pattern of an intake valve which is realized by the first intake cam in FIG. 71(A).
Figure 74:
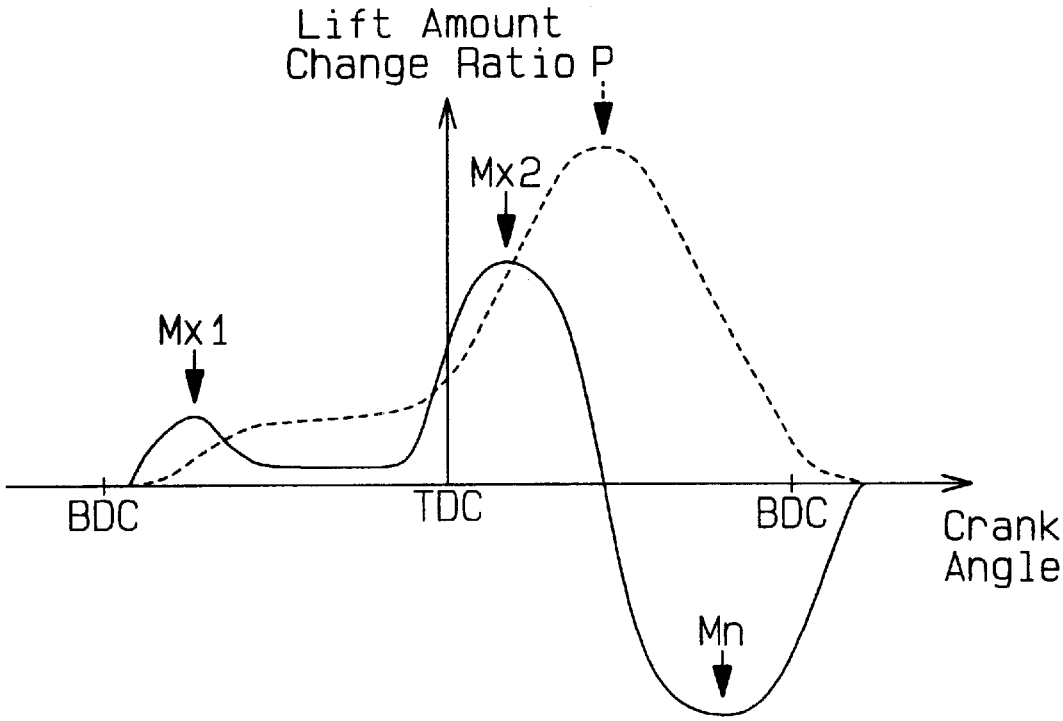
FIG. 74 is a graph showing a change ratio pattern of a valve lift amount in association with the valve lift pattern in FIG. 73.

FIG. 72 shows the cam lift pattern of the cam face 527*a*. A plateau-like sub lift pattern K corresponding to the sub lift portion appears in this cam lift pattern. FIGS. 71(A) and 72 show the angle of action of the cam face 527*a* as dθ6. FIG. 73 shows a valve lift pattern realized by the cam face 527*a*. This valve lift pattern shows a tendency similar to that of the valve lift pattern in FIG. 52(A). FIG. 74 is a graph showing the change ratio pattern of the valve lift amount associated with the valve lift pattern in FIG. 73. This change ratio pattern shows a tendency similar to that of the change ratio pattern in FIG. 53(A).

Figure 75A:
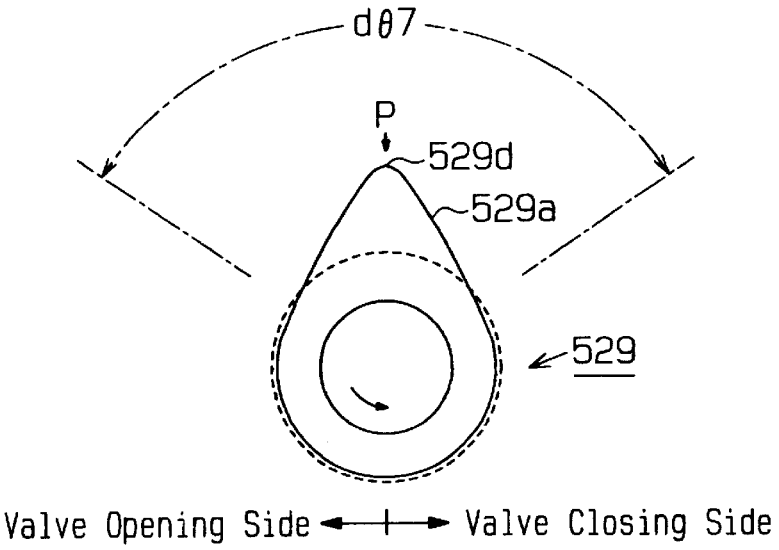
FIG. 75(A) is a rear view of a second intake cam according to the ninth embodiment.
Figure 75B:
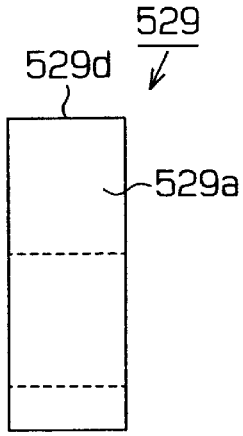
FIG. 75(B) is a side view of the second intake cam in FIG. 75(A).

FIGS. 75(A) and 75(B) show the second intake cam 529 of the present embodiment. A cam face 529*a* of the second intake cam 529 comprises only a main lift portion. The profile of the cam face 529*a* is almost identical to the profile of the cam face 27*a* of the intake cam 27 in FIG. 50(A) which is closest to the rear end face 27*c*.

Figure 76:
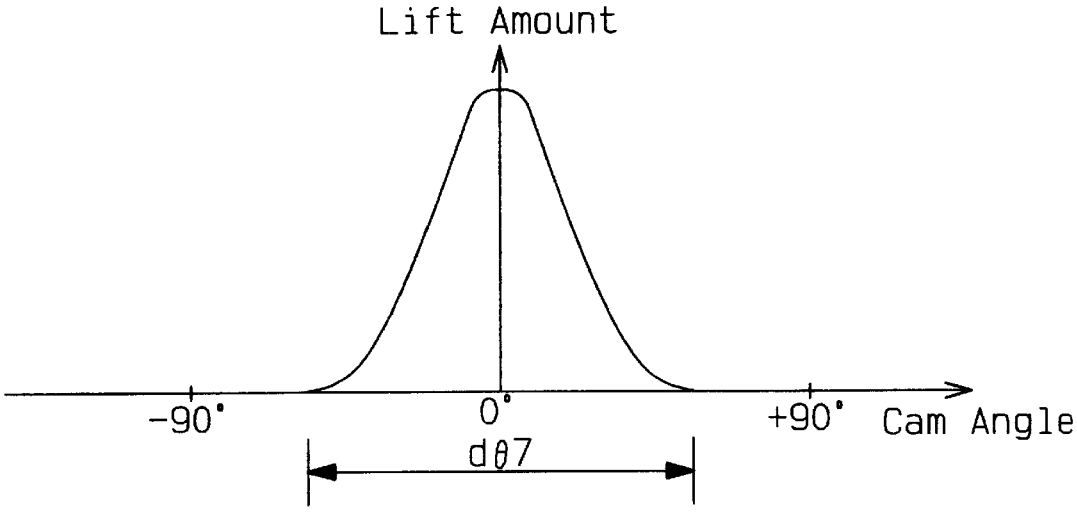
FIG. 76 is a graph showing a lift pattern of the second intake cam in FIG. 75(A).
Figure 77:
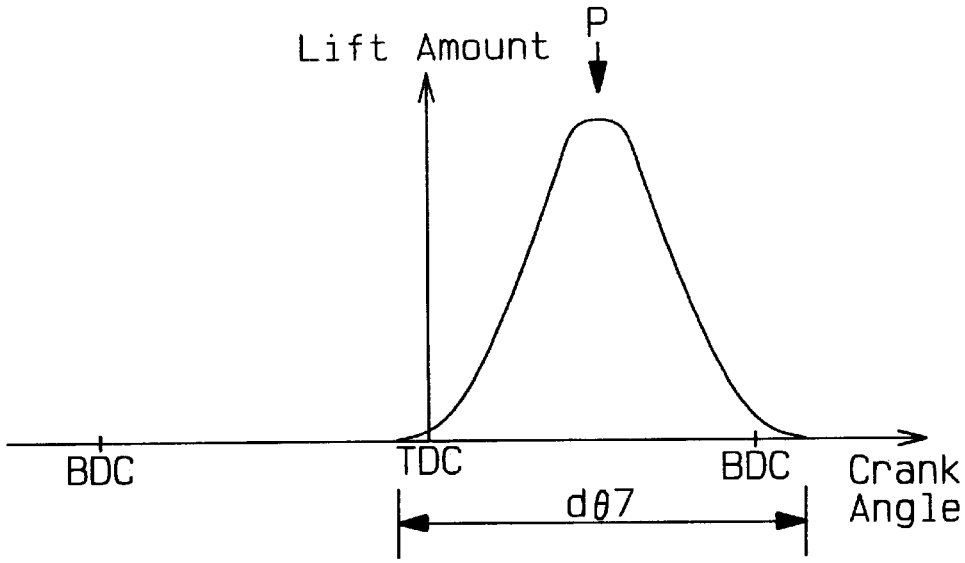
FIG. 77 is a graph showing a lift pattern of an intake valve which is realized by the second intake cam in FIG. 75(A).
Figure 78:
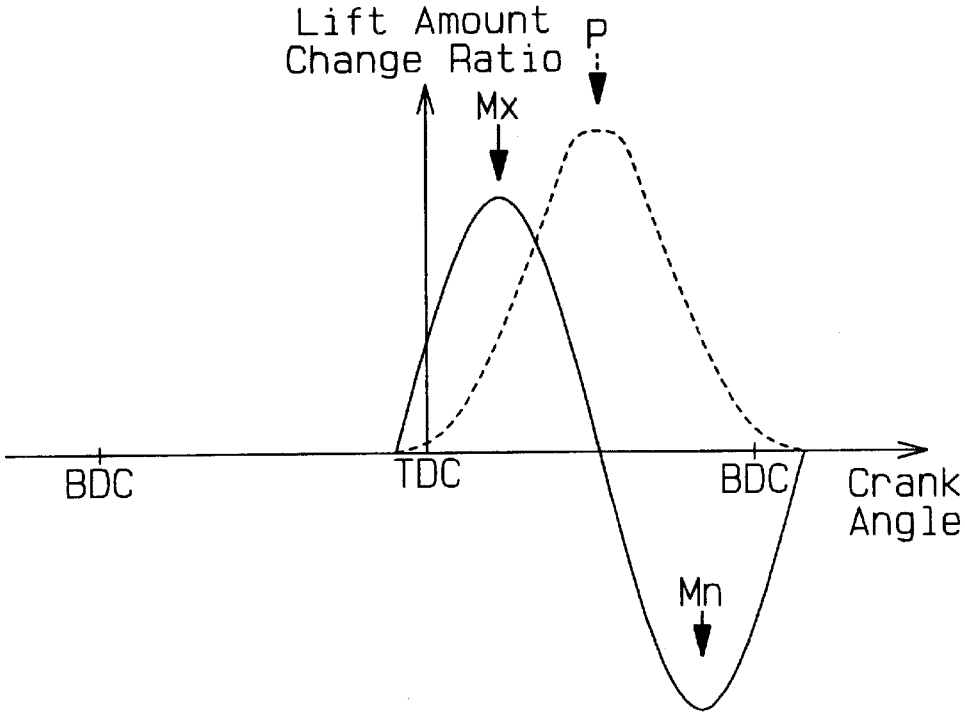
FIG. 78 is a graph showing a change ratio pattern of a valve lift amount in association with the valve lift pattern in FIG. 77.

FIG. 76 shows the cam lift pattern of the cam face 529*a*. In this cam lift pattern, there is no sub lift pattern but only a main lift pattern appears. FIGS. 75(A) and 76 show the angle of action of the cam face 529*a* as dθ7. FIG. 77 shows a valve lift pattern realized by the cam face 529*a*. This valve lift pattern shows a tendency similar to that of the valve lift pattern in FIG. 52(B). FIG. 78 is a graph showing the change ratio pattern of the valve lift amount associated with the valve lift pattern in FIG. 77. This change ratio pattern shows a tendency similar to that of the change ratio pattern in FIG. 53(B).

In accordance with the engine operational state, the cam that should drive the intake valve 20 is selected from the first intake cam 527 and the second intake cam 529. The intake valve 20 is driven by the selected cam. Such a mechanism of changing over a plurality of cams is disclosed in, for example, Japanese Patent Laid-Open No. Hei 5-125966, Japanese Unexamined Patent Publication No. Hei 7-150917, Japanese Unexamined Patent Publication No. Hei 7-247815 and Japanese Unexamined Patent Publication No. Hei 8-177434.

Tenth Embodiment

A tenth embodiment of the present invention will now be described in accordance with FIGS. 79(A) to 83, centering on the differences from the fifth embodiment in FIGS. 54 to 58(B). Same symbols are given to components equivalent to those of the embodiment in FIGS. 54 to 58(B) to omit a detailed description.

In the present embodiment, a pair of exhaust cams having different shapes are provided with respect to each exhaust valve 21. One exhaust cam is a first exhaust cam 628 and the other exhaust cam is a second exhaust cam (not shown). Neither of the profiles of those exhaust cams changes in the axial direction. In the present embodiment, the valve-characteristic changing actuator 222*a* is not provided. Therefore, the exhaust camshaft 23 is not movable in the axial direction. A selected one of both exhaust cams drives one exhaust valve 21 via a locker arm (not shown).

Figure 79A:
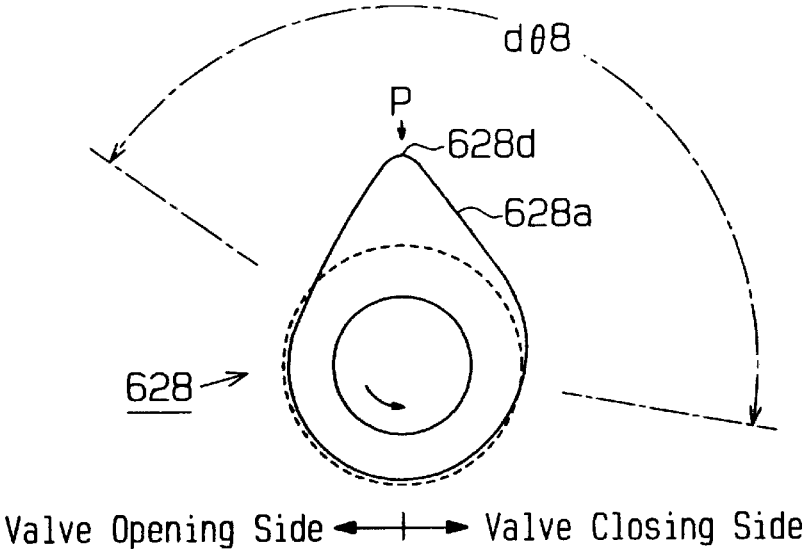
FIG. 79(A) is a rear view of a first exhaust cam according to a tenth embodiment of the present invention.
Figure 79B:
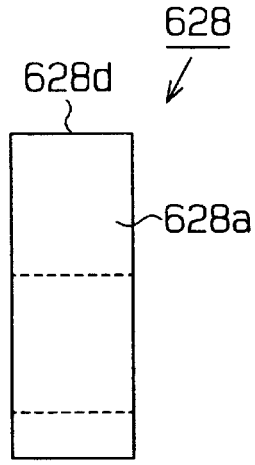
FIG. 79(B) is a side view of the first exhaust cam in FIG. 79(A).

FIGS. 79(A) and 79(B) show the first exhaust cam 628 of the present embodiment. A cam face 628*a* of the first exhaust cam 628 has a sub lift portion on its valve closing side. The profile of the cam face 628*a* is almost identical to the profile of the cam face 28*a* of the exhaust cam 28 in FIG. 55(A) which is closest to the front end face 28*b*.

Figure 80:
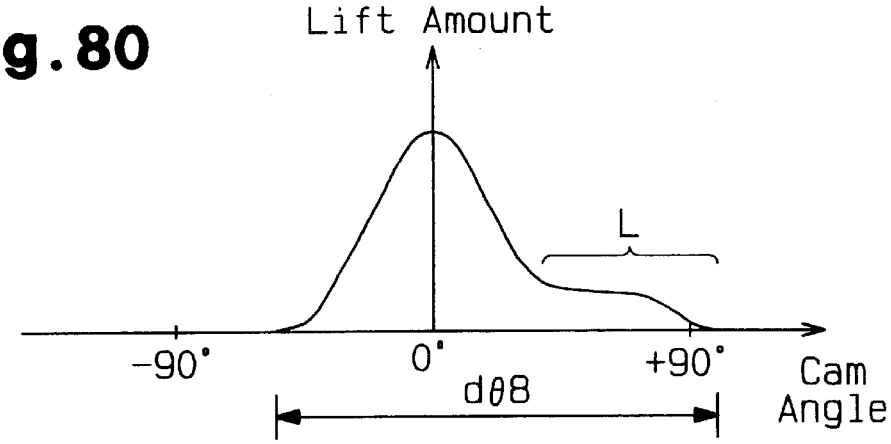
FIG. 80 is a graph showing a lift pattern of the first exhaust cam in FIG. 79(A).
Figure 81:
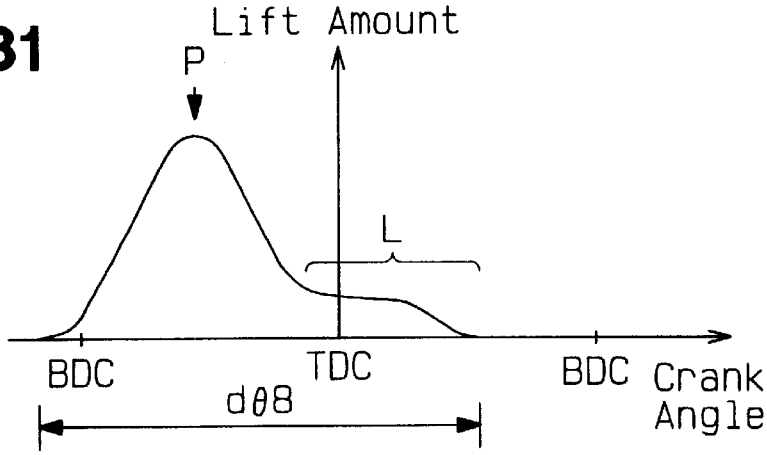
FIG. 81 is a graph showing a lift pattern of an exhaust valve which is realized by the first exhaust cam in FIG. 79(A).
Figure 82:
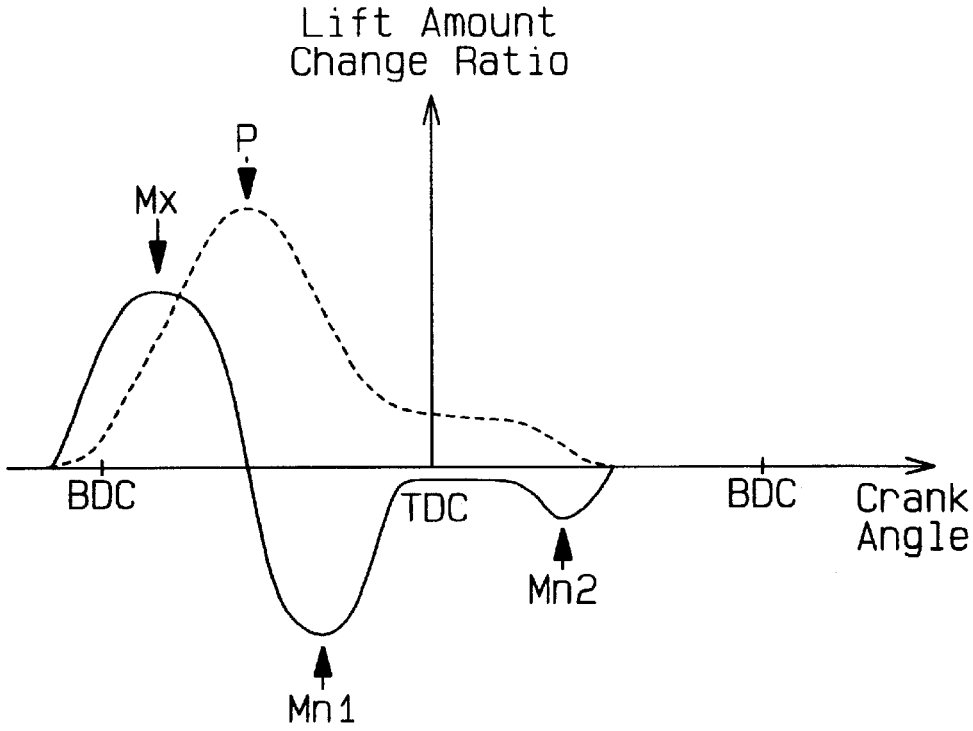
FIG. 82 is a graph showing a change ratio pattern of a valve lift amount in association with the valve lift pattern in FIG. 81.

FIG. 80 shows the cam lift pattern of the cam face 628*a*. A plateau-like sub lift pattern L corresponding to the sub lift portion appears in this cam lift pattern. FIGS. 79(A) and 80 show the angle of action of the cam face 628*a* as dθ8. FIG. 81 shows a valve lift pattern realized by the cam face 628*a*. This valve lift pattern shows a tendency similar to that of the valve lift pattern in FIG. 57(A). FIG. 82 is a graph showing the change ratio pattern of the valve lift amount associated with the valve lift pattern in FIG. 81. This change ratio pattern shows a tendency similar to that of the change ratio pattern in FIG. 58(A).

Figure 83:
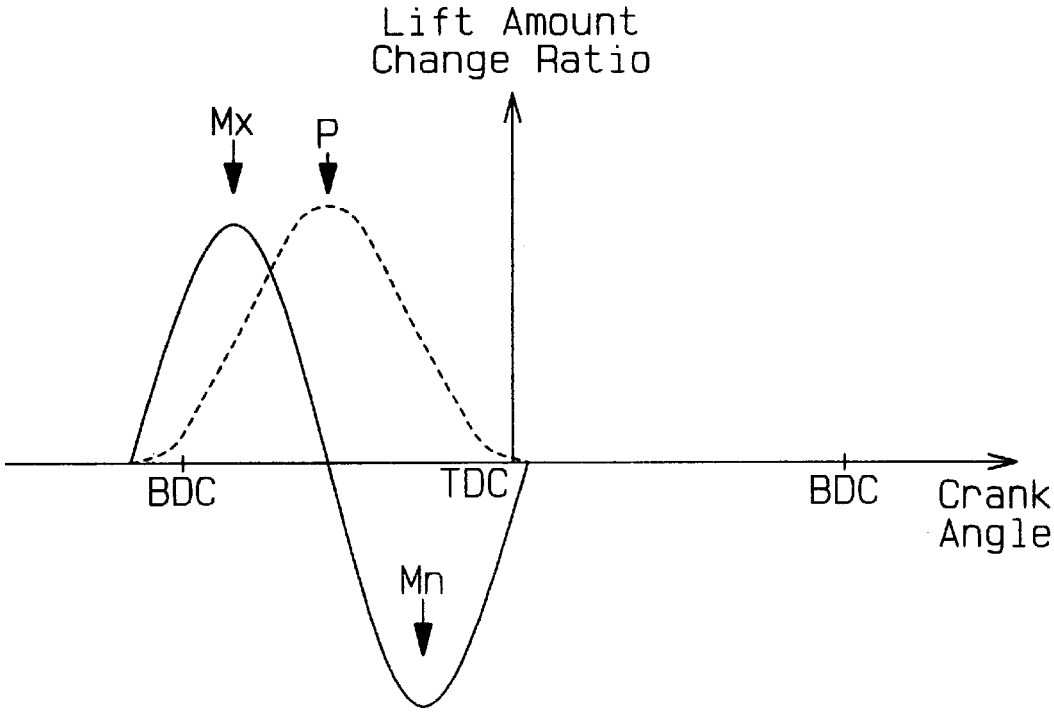
FIG. 83 is a graph showing a change ratio pattern of an exhaust valve lift amount which is realized by a second exhaust cam according to the tenth embodiment.

Although not illustrated, the cam face of the second exhaust cam of the present embodiment comprises only a main lift portion and has a profile which is almost identical to the profile of the cam face 28*a* of the exhaust cam 28 in FIG. 55(A) which is closest to the rear end face 28*c*. The broken line in FIG. 83 shows a valve lift pattern realized by the cam face of the second exhaust cam. This valve lift pattern shows a tendency similar to that of the valve lift pattern in FIG. 57(B). The solid line in FIG. 83 shows the change ratio pattern of the valve lift amount corresponding to the valve lift pattern indicated by the broken line. This change ratio pattern shows a tendency similar to that of the change ratio pattern in FIG. 58(B).

In accordance with the engine operational state, the cam that should drive the exhaust valve 21 is selected from the first exhaust cam 628 and the second exhaust cam. The exhaust valve 21 is driven by the selected cam. A mechanism of changing over a plurality of cams is well known as mentioned in the ninth embodiment.

The above-described embodiment has almost the same advantages as the embodiment in FIGS. 54 to 58(B), except that two exhaust cams are changed over.

In the present embodiment, the height of a cam nose 628*d* may be made different between the first exhaust cam 628 and the second exhaust cam.

Other Embodiments

In the embodiments in FIGS. 49 to 53(B), FIGS. 59(A) to 62(B), FIGS. 67(A) to 70(B) and FIGS. 71(A) to 78, the change ratio of the lift amount between both maximum portions Mx1 and Mx2 may be zero. There may be three or more maximum portions associated with the change ratio of the lift amount on the valve opening side.

In the embodiments in FIGS. 54(A) to 58(B), FIGS. 63(A) to 66(B), FIGS. 67(A) to 70(B) and FIGS. 79(A) to 83, the change ratio of the lift amount between both minimum portions Mn1 and Mn2 may be zero. There may be three or more minimum portions associated with the change ratio of the lift amount on the valve closing side.

In the fourth to eight embodiments in FIGS. 49 to 70(B), the axial movement actuator 22*a* in FIG. 6 and the rotational phase changing actuator 24 in FIG. 7 may be used in place of the valve-characteristic changing actuator 222*a*.

The present invention can also be adapted to, for example, a gasoline engine which injects fuel toward intake ports and a diesel engine besides a direct injection type gasoline engine.

What is claimed is:

1. A valve characteristic controller for an engine that generates power by combusting a mixture of air and fuel in a combustion chamber, wherein the engine has a valve for selectively opening and closing the combustion chamber, the valve characteristic controller comprising:

a cam for driving the valve, the cam having a cam face about an axis thereof, the cam face having a main lift portion, which causes the valve to execute a basic lift operation, and a sub lift portion, which assists the action of the main lift portion, the main lift portion and the sub lift portion continuously changing in an axial direction of the cam, the cam face realizing different valve motion characteristics in accordance with the axial position of the cam face; and an axial movement mechanism for moving the cam in the axial direction in order to adjust the axial position of the cam face that drives the valve.

2. The valve characteristic controller according to claim 1, wherein the engine has a crankshaft for rotating the cam, and wherein the valve characteristic controller includes a rotational phase changing mechanism for continuously changing the rotational phase of the cam with respect to the crankshaft.

3. The valve characteristic controller according to claim 2, wherein the rotational phase changing mechanism has a function of changing the rotational phase of the cam with respect to the crankshaft irrespective of axial movement of the cam and a function of changing the rotational phase of the cam with respect to the crankshaft in accordance with axial movement of the cam.

4. The valve characteristic controller according to claim 1, wherein the engine has a crankshaft for rotating the cam, wherein the axial movement mechanism has a function of continuously changing the rotational phase of the cam with respect to the crankshaft in accordance with axial movement of the cam.

5. The valve characteristic controller according to claim 1, wherein the sub lift portion has a generally plateau shape.

6. The valve characteristic controller according to claim 1, wherein the cam face has axial ends, one of the axial ends defining a first profile and the other defining a second profile, wherein the first and second profiles realizes different valve lift patterns, and wherein the sub lift portion is gradually conspicuous toward the second profile from the first profile.

7. The valve characteristic controller according to claim 6, wherein the first profile does not substantially have a sub lift portion.

8. The valve characteristic controller according to claim 6, wherein the main lift portion becomes gradually higher toward the second profile from the first profile.

9. The valve characteristic controller according to claim 1, wherein the valve is an intake valve, the cam is an intake cam, the cam face has a valve opening side for moving the intake valve in an opening direction and a valve closing side for permitting movement of the intake valve in a closing direction, and the sub lift portion is provided on the valve opening side.

10. The valve characteristic controller according to claim 1, wherein the valve is an exhaust valve, the cam is an exhaust cam, the cam face has a valve opening side for moving the exhaust valve in an opening direction and a valve closing side for permitting movement of the exhaust valve in a closing direction, and the sub lift portion is provided on the valve closing side.

11. The valve characteristic controller according to claim 6, wherein the cam face has a valve opening side for moving the valve in an opening direction and a valve closing side for permitting movement of the valve in a closing direction, and the second profile is determined in such a way that on the valve opening side, a change ratio pattern of valve lift amount with respect to a cam's rotational angle has a plurality of maximum portions and a change pattern of the valve lift amount with respect to the cam's rotational angle does not have a minimum portion.

12. The valve characteristic controller according to claim 11, wherein the first profile is determined in such a way that on the valve opening side, a change ratio pattern of valve lift amount with respect to a cam's rotational angle has a single maximum portion.

13. The valve characteristic controller according to claim 11, wherein the valve is an intake valve, the cam is an intake cam, and the sub lift portion is provided on at least the valve opening side.

14. The valve characteristic controller according to claim 6, wherein the cam face has a valve opening side for moving the valve in an opening direction and a valve closing side for permitting movement of the valve in a closing direction, and the second profile is determined in such a way that on the valve closing side, both a change ratio pattern of valve lift amount with respect to a cam's rotational angle having a plurality of minimum portions and a change pattern of the valve lift amount with respect to the cam's rotational angle not having a minimum portion are allowed.

15. The valve characteristic controller according to claim 14, wherein the first profile is determined in such a way that on the valve closing side, a change ratio pattern of valve lift amount with respect to a cam's rotational angle has a single minimum portion.

16. The valve characteristic controller according to claim 14, wherein the valve is an exhaust valve, the cam is an exhaust cam, and the sub lift portion is provided on at least the valve closing side.

17. The valve characteristic controller according to claim 1, wherein the engine has a fuel injection valve for directly injecting fuel into the combustion chamber.

18. A valve characteristic controller for an engine that generates power by combusting a mixture of air and fuel in a combustion chamber, wherein the engine has a fuel injection valve for directly injecting fuel into the combustion chamber, first and second intake passages for guiding air to the combustion chamber, first and second intake valves for selectively connecting and disconnecting the associated intake passages with the combustion chamber, and an airflow control valve for regulating an opening amount of the second intake passage at an upstream of the second intake valve, the valve characteristic controller comprising:

a first intake cam for driving the first intake valve, the first intake cam having a first cam face about an axis thereof, the profile of the first cam face continuously changing in an axial direction;

a second intake cam for driving the second intake valve, the second intake cam having a second cam face about an axis thereof, the profile of the second cam face being different from the profile of the first cam face and continuously changing in an axial direction;

an axial movement mechanism for moving both intake cams in the axial direction in order to adjust the axial positions of both cam faces that drive the associated intake valves; and wherein the first cam face has a main lift portion, which causes the first intake valve to execute a basic lift operation, and a sub lift portion, which assists the action of the main lift portion, and the second cam face has only a main lift portion, which causes the second intake valve to execute a basic lift operation.

19. The valve characteristic controller according to claim 18, wherein the main lift portion of the first cam face does not change in the axial direction, the sub lift portion of the first cam face is gradually conspicuous as the sub lift portion approaches one of the axial ends of the first cam face, and the height of the main lift portion of the second cam face changes in the axial direction.

20. The valve characteristic controller according to claim 18, wherein the engine has a crankshaft for rotating both intake cams, and wherein the valve characteristic controller includes a rotational phase changing mechanism for continuously changing the rotational phases of both intake cams with respect to the crankshaft.

* * * * *